US008109684B2

(12) United States Patent
Yamaguchi

(10) Patent No.: US 8,109,684 B2
(45) Date of Patent: Feb. 7, 2012

(54) TAPE PRINTING SYSTEM WITH AUXILIARY CASSETTE CONTAINING AUXILIARY MEDIUM FOR CONTACTING PRINTED TAPE

(75) Inventor: Koshiro Yamaguchi, Kakamigahara (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 912 days.

(21) Appl. No.: 12/157,266

(22) Filed: Jun. 9, 2008

(65) Prior Publication Data

US 2008/0304894 A1 Dec. 11, 2008

(30) Foreign Application Priority Data

Jun. 11, 2007 (JP) ..... 2007-154413
Dec. 27, 2007 (JP) ..... 2007-337422

(51) Int. Cl.
*B41J 3/36* (2006.01)
*B41J 32/00* (2006.01)
*B41J 35/28* (2006.01)
*B41J 11/70* (2006.01)

(52) U.S. Cl. ..... 400/621; 400/613; 400/208

(58) Field of Classification Search ..... 400/88, 400/613, 621, 120.18, 208; 347/212
See application file for complete search history.

(56) References Cited

U.S. PATENT DOCUMENTS 5,614,928 A 3/1997 Matsuda
5,647,676 A * 7/1997 Ito et al. ..... 400/65
5,749,038 A * 5/1998 Fromm et al. ..... 399/327
6,031,553 A 2/2000 Nagamoto et al.
6,116,796 A * 9/2000 Yamaguchi et al. ..... 400/615.2
6,190,065 B1 * 2/2001 Brzuskiewicz ..... 400/120.01
6,402,402 B1 * 6/2002 Suzuki et al. ..... 400/120.02
2007/0071524 A1 3/2007 Nakamura
2008/0170896 A1 * 7/2008 Kubota et al. ..... 399/340
2010/0239348 A1 * 9/2010 Yamaguchi ..... 400/621

FOREIGN PATENT DOCUMENTS

EP 0 841 183 5/1998
EP 1 356 947 10/2003
EP 1 671 802 6/2006
JP 7314831 12/1995
JP 2003211593 7/2003
JP 2007102194 4/2007

* cited by examiner

*Primary Examiner* — Daniel J Colilla
(74) *Attorney, Agent, or Firm* — Day Pitney LLP

(57) ABSTRACT

A tape cassette includes an ink ribbon provided with a base film coated with an ink layer thereon and a film tape provided with a transparent film with an adhesive layer formed on one surface thereof. When an adhesive layer of the film tape and the ink layer of the ink ribbon of the tape cassette come into contact at a print position, the ink layer is adhered onto the adhesive layer on condition that the adhesive layer is heated to exhibit self-adhesive properties, and characters and the like are printed on the film tape. Also, an auxiliary sheet medium comes into contact with the adhesive layer. Further, a conveying roller does not come into contact with the adhesive layer.

11 Claims, 36 Drawing Sheets

TAPE PRINTING SYSTEM WITH AUXILIARY CASSETTE CONTAINING AUXILIARY MEDIUM FOR CONTACTING PRINTED TAPE

CROSS-REFERENCE TO RELATED APPLICATIONS

This application is based upon and claims priorities from the prior Japanese Patent Applications No. 2007-154413 filed on Jun. 11, 2007 and No. 2007-337422 filed on Dec. 27, 2007, the entire contents of which are incorporated herein by reference.

TECHNICAL FIELD

One or more aspects of disclosure relate to a tape cassette for use in a printing mechanism employing an ink ribbon having an ink layer formed on one surface thereof, and a printing tape formed of a transparent film having an adhesive layer formed on one surface thereof, and a tape printing apparatus using the above-described tape. Also, one or more aspects of the disclosure relate to a printing system including the tape cassette and the tape printing apparatus.

BACKGROUND

Various types of tape printing apparatuses have been conventionally proposed for producing a tape with characters printed thereon. Generally, a tape cassette to be used in a tape printing apparatus has a cassette case comprising a ribbon spool onto which an ink ribbon is wound, a film tape spool onto which a film tape serving as a printing medium is wound, and an adhesive tape spool onto which an adhesive tape is wound. In the above-described tape cassette, characters and the like are printed on the film tape by a thermal head provided in the tape printing apparatus, through the ink ribbon, while the ink ribbon and the film tape are being conveyed, to thereby produce a tape with characters printed thereon.

In general, to improve the scratch resistance of the characters and the like formed on the film after the printing operation in the tape printing apparatus, an adhesive tape is pasted on the character printed surface of the post-printing film tape by a pasting roller or the like, after which the tape is cut.

However, since the adhesive tape needs to be pasted on the character printed surface of the film tape after the characters and the like have been printed thereon, the adhesive tape spool onto which the adhesive tape is wound and the pasting roller must be accommodated in the tape cassette used in the conventional tape printing apparatus.

As a result, the size of the tape cassette becomes larger, thereby creating a problem that the overall size of the printing apparatus must inevitably be made larger to allow for installation of a cassette mounting unit. Further, since the pasting roller provided inside the tape cassette is configured so as to be arranged between the thermal head and the cutting mechanism provided in the tape printing apparatus, the thermal head is inevitably arranged far away from the cutting mechanism. As a result, a front blank space (blank space portion corresponding to the distance between a cutting position of the printing tape and the thermal head of the tape printing apparatus) of the produced printing tape becomes large, thereby creating a problem that the amount of consumed printing tape increases which leads to a sudden increase in the running cost.

One or more disclosure is applied in the process of pasting the adhesive tape to a character-printed surface of the film tape for producing a so-called laminated-type printing tape with an improved scratch resistance of the characters and the like.

To solve the above-described problems, there have been required a compact tape cassette from which the adhesive tape spool onto which the adhesive tape is wound and the pasting roller for pasting the adhesive tape onto the character-printed surface of the film tape are removed. Also, there have been required a tape printing apparatus which employs the above compact tape cassette and is capable of reducing the running cost of the printing tape with structure that the tape cassette, the thermal head, and the cutting mechanism are arranged close to one another for shortening the front blank space of the printing tape.

In a configuration in which a conveying roller of the printing tape is arranged to directly face opposite the adhesive surface of the printing tape, if the adhesive force of the adhesive surface of the printing tape is strong, the adhesive is likely to be transferred (adhere) to the conveying roller, even if the conveying roller has been subjected to a release agent treatment.

Also, a printed tape which is discharged from a tape printing apparatus with its adhesive agent being unprotected cannot easily be stored for a long time without being adhered to a target body.

SUMMARY

One or more aspects of the disclosure has been made in view of the above-described circumstances and has an object to overcome the above-described problems in the background art by providing a tape cassette in which a laminated-type printing tape can be produced without using an adhesive tape spool onto which an adhesive tape to be pasted on a character printed surface of the film tape is wound and a pasting roller for pasting an adhesive tape onto a character printed surface of the film tape.

Also, one or more aspects of the disclosure also has as object to provide a printing apparatus in which the use of a tape cassette from which the adhesive tape spool and the pasting roller have been removed makes it possible to arrange the cutting mechanism immediately downstream the thermal head, and makes it possible to cut the film tape immediately after printing the characters and the like onto the film tape, thereby reducing the running cost of the film tape.

Further, an object of one or more aspects of the disclosure is to provide a tape cassette and a printing apparatus capable of preventing transfer of the adhesive agent to the conveying roller of the printing tape.

A further object of the present invention is to provide a printing apparatus and the like capable of forming a printing tape which can be stored for a long time.

To achieve the above object, according to a first aspect of the disclosure, there is provided a tape cassette comprising: a conveying roller; a tape-shaped auxiliary medium; a cassette case that accommodates the conveying roller and the tape-shaped auxiliary medium; and an opening arranged on the cassette case; wherein the tape cassette is detachably mounted on a printing tape conveying apparatus, the conveying roller comes into contact with a heat roller arranged in the printing tape conveying apparatus through the opening, the conveying roller and the heat roller face each other when the tape cassette is mounted on the printing tape conveying apparatus, the conveying roller and the heat roller mounted on the printing tape conveying apparatus cooperate with each other to convey a printing tape having an adhesive layer formed thereon, the adhesive layer exhibiting adhesive properties when one face thereof is heated, the tape-shaped auxiliary medium comes into contact with the printing tape, and the tape-shaped auxiliary medium is sequentially conveyed as the printing tape is conveyed.

In the above tape cassette, the adhesive layer never comes in directly contact with a thermal head or the like. Therefore, failures such as that the adhesive layer adheres the thermal head can be prevented.

According to a second aspect of the disclosure, there is also provided a tape printing system comprising: a tape cassette, the tape cassette comprising; a conveying roller, a tape-shaped auxiliary medium, a cassette case that accommodates the conveying roller and the tape-shaped auxiliary medium, and an opening arranged on the cassette case, a printing tape conveying apparatus, the printing tape conveying apparatus comprising; a heat roller, wherein the tape cassette is detachably mounted on a printing tape conveying apparatus, the conveying roller comes into contact with the heat roller through the opening, the conveying roller and the heat roller face each other when the tape cassette is mounted on the printing tape conveying apparatus, the conveying roller and the heat roller mounted on the printing tape conveying apparatus cooperate with each other to convey a printing tape having an adhesive layer formed thereon, the adhesive layer exhibiting adhesive properties when one face thereof is heated, the tape-shaped auxiliary medium comes into contact with the printing tape, the tape-shaped auxiliary medium is sequentially conveyed as the printing tape is conveyed, and the heat roller conveys the printing tape when the tape cassette is mounted on the printing tape conveying apparatus.

In the above tape printing system, the tape cassette from which the adhesive tape spool and the pasting roller have been removed is used. Also, cutting device is arranged and can cutting device can be arranged immediately downstream the thermal head.

Therefore, since the printing tape can be immediately cut after printing the characters and the like onto the printing tape, the running cost of the printing tape can be reduced.

According to a third aspect of the disclosure, there is also provided a tape cassette comprising: a pair of conveying rollers; a tape-shaped auxiliary medium; a cassette case that accommodates the pair of conveying rollers and the tape-shaped auxiliary medium; and a tape discharge port arranged on the cassette case, wherein one conveying roller of the pair of conveying rollers is a heat roller, the tape cassette is detachably mounted on a printing tape conveying apparatus, the conveying roller and the heat roller mounted on the printing tape conveying apparatus cooperate with each other to convey a printing tape having an adhesive layer formed thereon, the adhesive layer exhibiting adhesive properties when one face thereof is heated, the tape-shaped auxiliary medium comes into contact with the printing tape, and the tape-shaped auxiliary medium is sequentially conveyed as the printing tape is conveyed, and the printing tape thus conveyed is discharged from the tape discharge port.

In the above tape cassette, the conveying roller does not come into contact with the adhesive layer. Also, the heat roller is arranged on the tape cassette.

Therefore, faulty conveyance can be prevented. Also, even in the event the heat roller fails, it is sufficient to replace the auxiliary cassette alone.

BRIEF DESCRIPTION OF THE DRAWINGS

The accompanying drawings, which are incorporated in and constitute a part of this specification illustrate embodiments of the disclosure and, together with the description, serve to explain the objects, advantages and principles of the disclosure.

FIG. 40 an explanatory diagram showing a pattern of a transferring mechanism in which the ink layer is transferred to the adhesive layer upon being heated by the thermal head according to a fourth embodiment and the like.

DETAILED DESCRIPTION

The various aspects summarized previously may be embodied in various forms. The following description shows by way of illustration of various combinations and configurations in which the aspects may be practiced. It is understood that the described aspects and/or embodiments are merely examples, and that other aspects and/or embodiments may be utilized and structural and functional modifications may be made, without departing from the scope of the present disclosure.

It is noted that various connections are set forth between items in the following description. It is noted that these connections in general and, unless specified otherwise, may be direct or indirect and that this specification is not intended to be limiting in this respect.

A detailed description of an exemplary embodiment of a tape cassette and a printing apparatus according to the disclosure will now be given referring to the accompanying drawings.

First Embodiment

A description will now be given of a tape cassette and a tape printing apparatus according to a first embodiment, based on FIG. 1 and FIG. 2. Here, tape printing apparatus includes a tape conveying apparatus.

Figure 1:
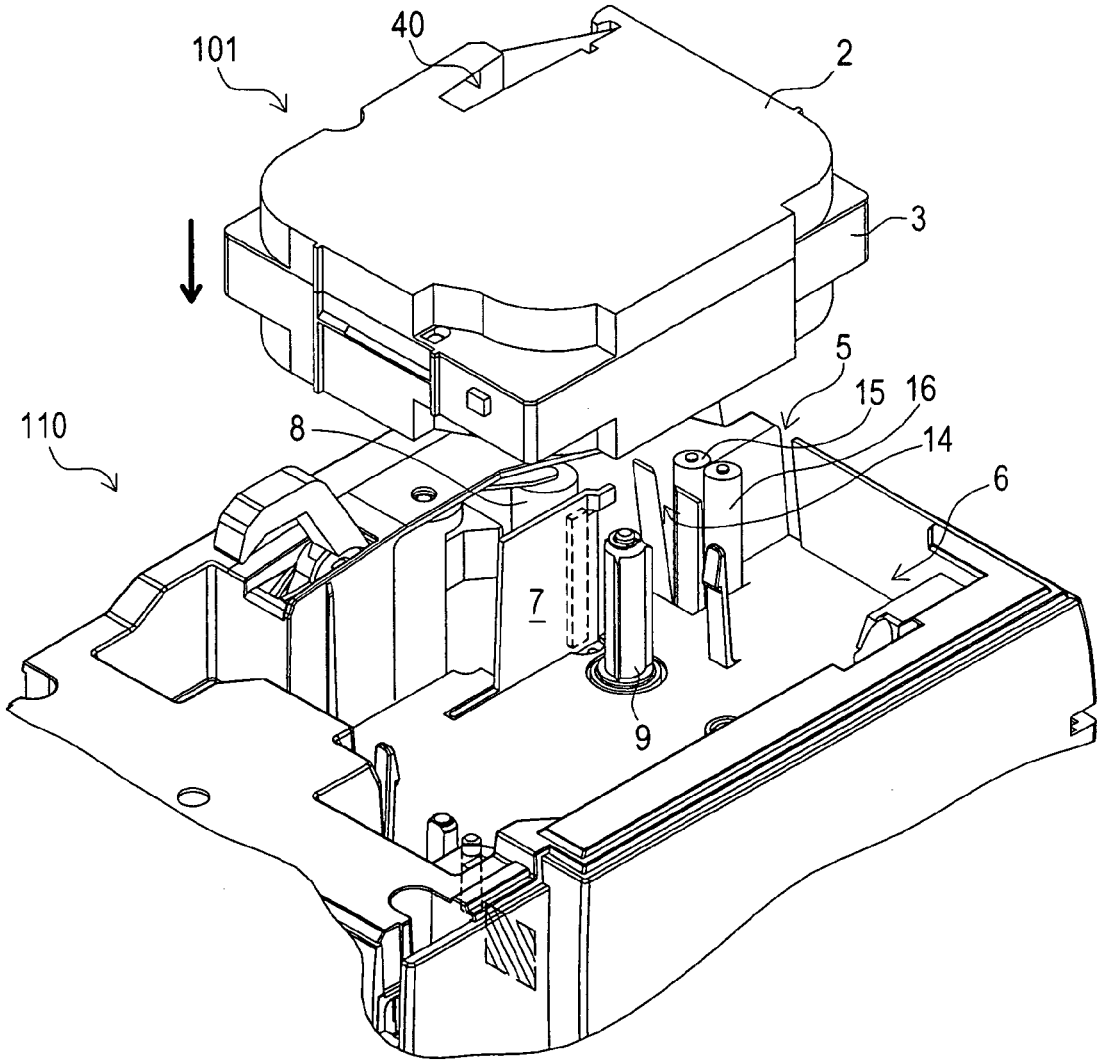
FIG. 1 is an enlarged perspective view of a relevant part showing mounting of a tape cassette in a cassette housing part of a tape printing apparatus according to a first embodiment.
Figure 2:
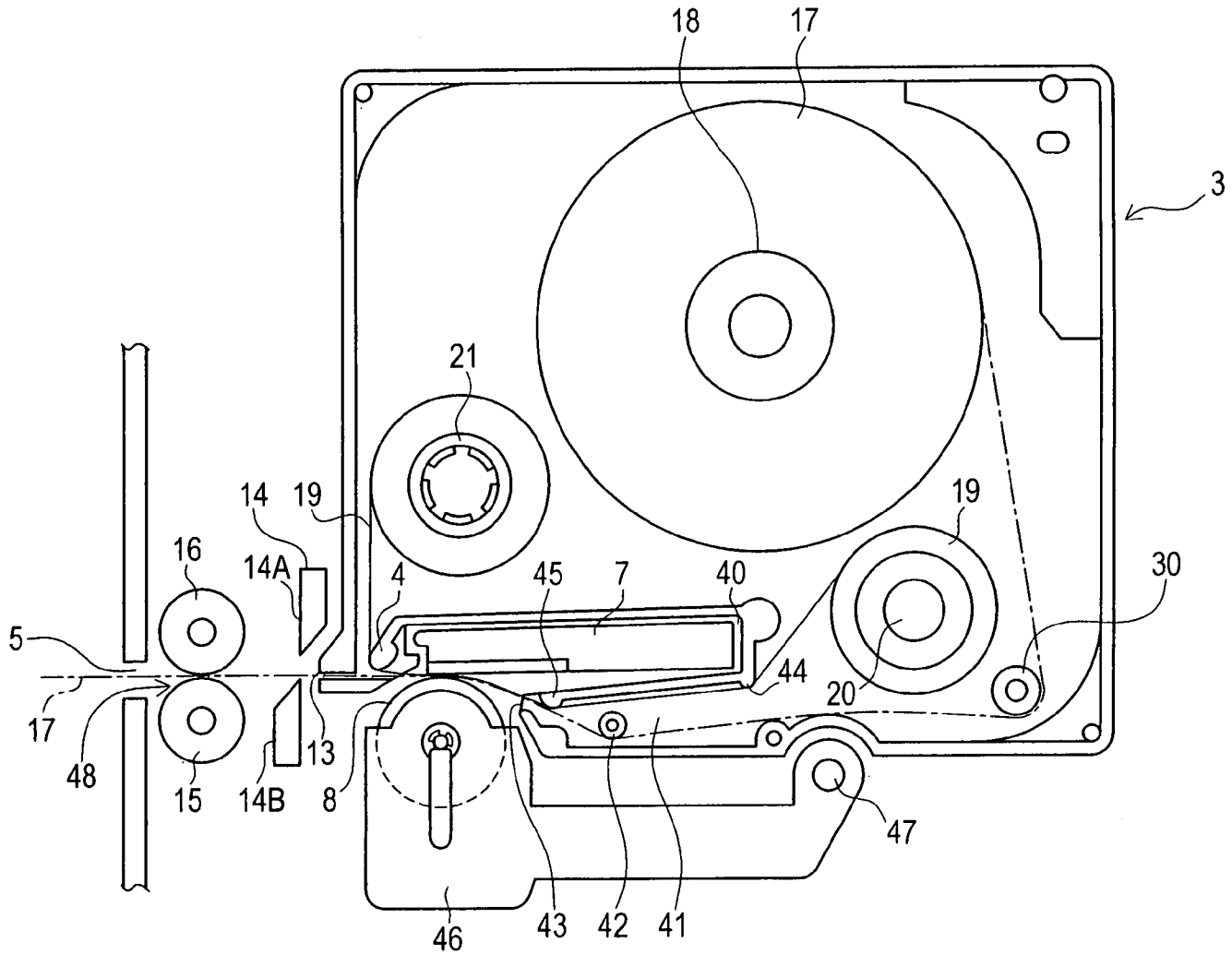
FIG. 2 is plan view showing a pattern of an internal configuration of the tape cassette according to the first embodiment.

In FIG. 1, a tape cassette 101 is detachably mounted on a cassette housing part 6 provided in a tape printing apparatus 110. The tape cassette 101 has an upper case 2 and a lower case 3. The upper case 2 serves as a lid member for covering an upper surface of the lower case 3. The lower case 3 has a tape spool 18 onto which a film tape 17 is wound arranged at a slightly upper position than a center part thereof, as shown in FIG. 2. The lower case 3 also has a ribbon spool 20 onto which an ink ribbon 19 is wound, and a ribbon reel-in spool 21 that draws out ink ribbon 19 from the ribbon spool 20 and reels in the ink ribbon 10 consumed in character printing, arranged at a lower right position of the tape spool 18.

The tape cassette 101 has a head insertion opening 40 formed so as to pass through the upper case 2 and the lower case 3. Upon loading the tape cassette 101 in the cassette housing part 6, a thermal head 7 to be described later is inserted in the head insertion opening 40. The head insertion opening 40 has a separating member 4 formed downstream (center left side in FIG. 2) the thermal head 7. The separating member 4 has the role of reversing the feed direction of the ink ribbon 19 which is pressed onto the film tape 17 by being clamped between a platen roller 8 and a thermal head 7 and separating the ink ribbon 19 from the film tape 17, at the time of character printing using the thermal head 7, as will be described later.

The tape cassette 101 is formed with a discharge port 13 for discharging the film tape 17 onto which characters and the like have been printed to the exterior of the cassette case 1, after the ink ribbon 19 has been separated from the film tape 17 by the separating member 4.

Next, a description will be given on the configuration of the tape housing part 6 in the tape printing apparatus 110. As shown in FIG. 1 and FIG. 2, the thermal head 7 is fixed in the cassette housing part 6 of the tape printing apparatus 110. The thermal head 7 is tabular with a substantially rectangular shape in a longitudinal direction thereof when viewed from the front, and has a predetermined number of heat generating elements formed at a left-hand margin at a front surface thereof, the heat generating elements being aligned along the above-described left-hand margin. The cassette housing part 6 has a platen holder 46 which is rotatably supported therein around a holder shaft 47. The platen holder 46 has a platen roller 8 rotatably supported therein. The platen holder 46 is biased in a counterclockwise direction around the holder shaft 47 by an elastic member which is not shown to be driven in a clockwise direction by a motor or the like at the time of printing onto the film tape 17. This enables the platen roller 8 to come into contact with or move away with respect to the thermal head 7.

The cassette housing part 6 has a ribbon reel-in shaft 9 that is coupled to the ribbon reel-in spool 21 of the tape cassette 101. The ribbon reel-in shaft 9 is coupled to a driving mechanism such as a motor and the like which is not shown and is adapted to drive and rotate the ribbon reel-in spool for taking up ink ribbon 19 which has been separated from the film tape 17 by the separating member 4, as described above.

The cassette housing part 6 has a clipper-type cutter unit 14 arranged adjacent the tape discharge port 13 of the tape cassette 101. The cutter unit 14 is composed of a fixed blade 14A and a movable blade 14B which is actuated with respect to the fixed blade 14A to cut the post-printing film tape 17.

A pair of conveying rollers 48 are arranged downstream the cutter unit 14. The conveying rollers 48 are composed of a heat roller 15 that heats the adhesive layer (to be described later) formed in the film tape 17 and a tape conveying roller 16 arranged opposite the heat roller 15 and adapted to feed the post-printing film tape 17 to the exterior of the tape printing apparatus 110 through the cooperation with the heat roller.

Upon loading the tape cassette 101 having the above-described configuration in the cassette housing part 6 of the tape printing apparatus 110 to thereby print characters and the like onto the film tape 17, the film tape 17 wound onto the tape spool 18 is guided from a tape guiding skid 30 provided at a corner of the lower case 3 over a guiding pin 42 formed in an arm part 41 at an inner wall of the lower case 3, and through an opening 43 of the arm part 41, towards the thermal head 7 and the platen roller 8. The ink ribbon 19 is guided through the opening 43 towards the thermal head 7 and the platen roller 8 while being regulated by regulating protruding parts 44 and 45 of the arm part 41.

The film tape 17 and the ink ribbon 19 guided as described above are superimposed between the thermal head 7 and the platen roller 8. Each of the heat generating elements of the thermal head 7 is driven to generate heat, with the film tape 17 being superimposed on the ink ribbon 19. As a result, characters and the like are printed onto the film tape 17 through the ink ribbon 19. Thereafter, the ink ribbon 19 is fed downstream the thermal head 7, and after being separated from the film tape 17 through the separating member 4, it is reeled in by the ribbon reel-in spool 21.

After characters and the like are printed onto the film tape through the ink ribbon 19 and the thermal head 7, and the ink ribbon 19 is separated therefrom through the separating member 4, the film tape 17 is discharged to the exterior of the tape cassette 101 from the tape discharging port 13 and is further discharged to the exterior of the tape printing apparatus 110 through the pair of conveying rollers 48. At this time, the adhesive layer of the film tape 17 is heated by the heat roller 15 of the pair of conveying rollers 48, thereby making the adhesive layer exhibit adhesive properties as will be described later.

Then, when the film tape 17 has reached a predetermined length, the cutter unit 14 is driven to cut the film tape 17 at a predetermined length through the cooperation of the fixed blade 14A and the movable blade 14B.

Figure 3:
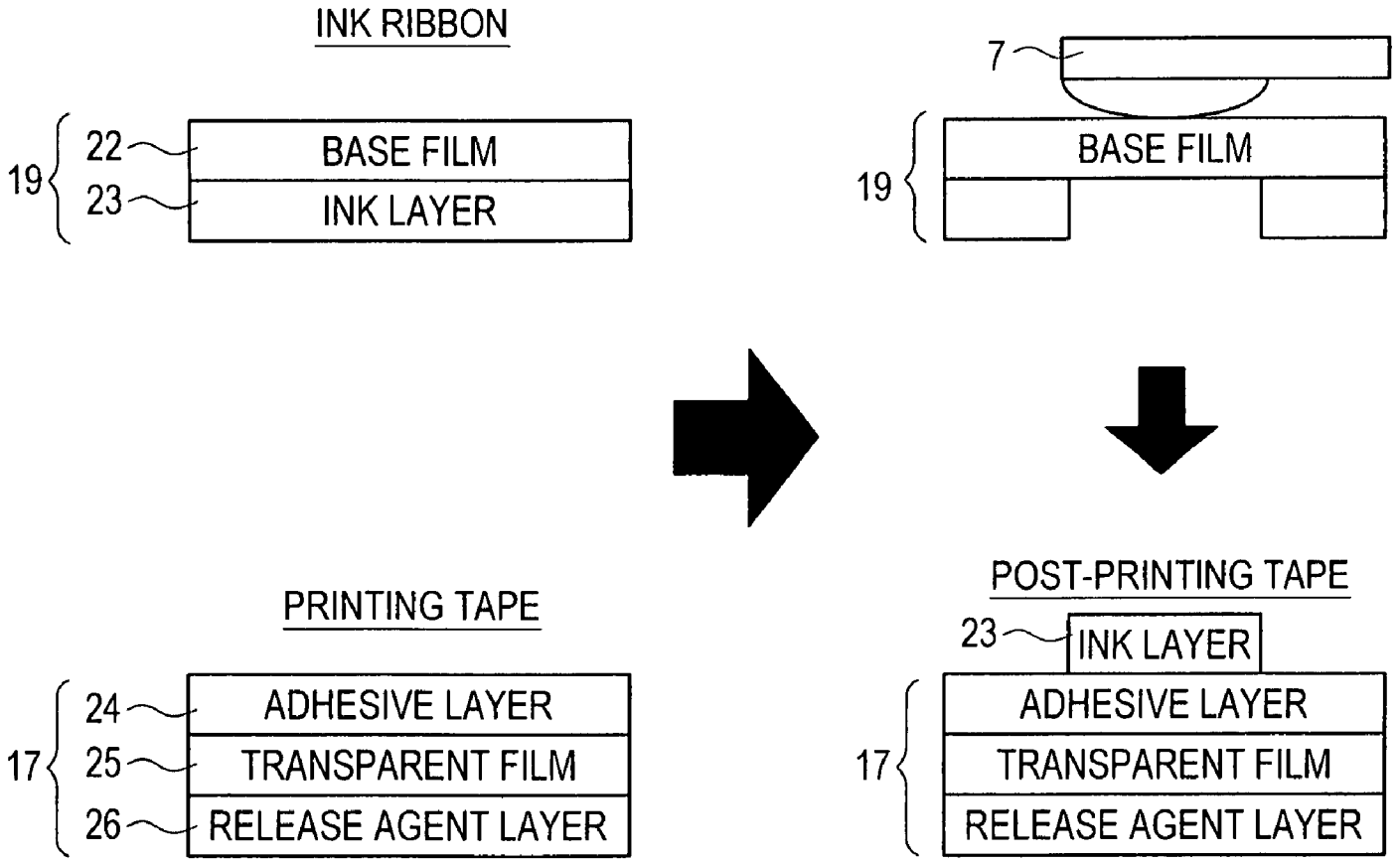
FIG. 3 is an explanatory diagram showing a pattern of the relationship between the ink ribbon and the film tape in a character printing process according to the first embodiment.

Next, the configuration of the ink ribbon and the printing tape according to the first embodiment will be described based on FIG. 3. As shown in FIG. 3, the ink ribbon 19 is composed of a base film 22 and an ink layer 23. The film tape 17 having the role of a printing tape has an adhesive layer 24 formed on one surface (upper side of the transparent film in FIG. 3) of a transparent film tape 25 and a release agent layer 26 formed on the other surface (lower side of the transparent film in FIG. 3) of the transparent film tape 25.

The above-described adhesive layer 24 is composed of a material having special properties in that it does not exhibit adhesive properties at ambient temperature, but starts exhibiting adhesive properties upon being heated, and maintains these adhesive properties after it has been heated once, even if its temperature decreases. This adhesive agent 24 may include an adhesive agent employed for heat seal labels, as described in U.S. Pat. No. 5,614,928, for instance. This type of adhesive agent melts upon being heated to 80° C. to 100° C. by the heat roller and the like, thereby exhibiting adhesive properties. In the first embodiment, the heat roller 15 heats the adhesive agent up to 80° C. or more but below 90° C.

The above-described film tape 17, having the adhesive layer 24 superimposed on a single side of the transparent film tape 25, is wound for loading in the tape spool 18 with the adhesive layer 24 at an inner side and the release agent layer 26 of the transparent film 25 at an outer side. Since the adhesive layer 24 is wound through the release agent layer 26, direct adherence of the adhesive layer 24 to the transparent film 25 can be avoided.

The film tape 17 drawn from the tape spool 18 is conveyed from the tape guiding skid 30 and the like up to a printing position found between the thermal head 7 and the platen roller 8 of the tape printing apparatus 110, as was described earlier. The film tape 17 is superimposed onto the ink ribbon 19 at the printing position, whereby the adhesive layer 24 of the film tape 17 comes into contact with the ink layer 23 of the ink ribbon 19.

When the adhesive layer 24 of the film tape 17 comes into contact with the ink layer 23 of the ink ribbon 19, the location at which the adhesive layer 24 contacts the ink layer 23 is clamped between the thermal head 7 and the platen roller 8. As shown in FIG. 3, when the thermal head 7 is brought in contact with the other surface (back surface side of the ink layer 23) of the base film 22, the ink layer 23 of the ink ribbon 19 melts under the heat from the thermal head 7, thereby making the adhesive layer 24 exhibit adhesive properties. The melted ink layer 23 is adhered to the adhesive layer 24, whereby characters and the like are transferred to the film tape 17.

The tape printing apparatus 110 is provided with a drive control apparatus (not shown) for driving and controlling the heat generating parts of the thermal head. Thus, since control is carried out so that the transferred ink layer 23 is printed as mirror image with respect to the film tape 17, characters and the like printed as a normal image can be visually checked when looking from the side of the transparent film tape 25 of the film tape 17.

Figure 4:
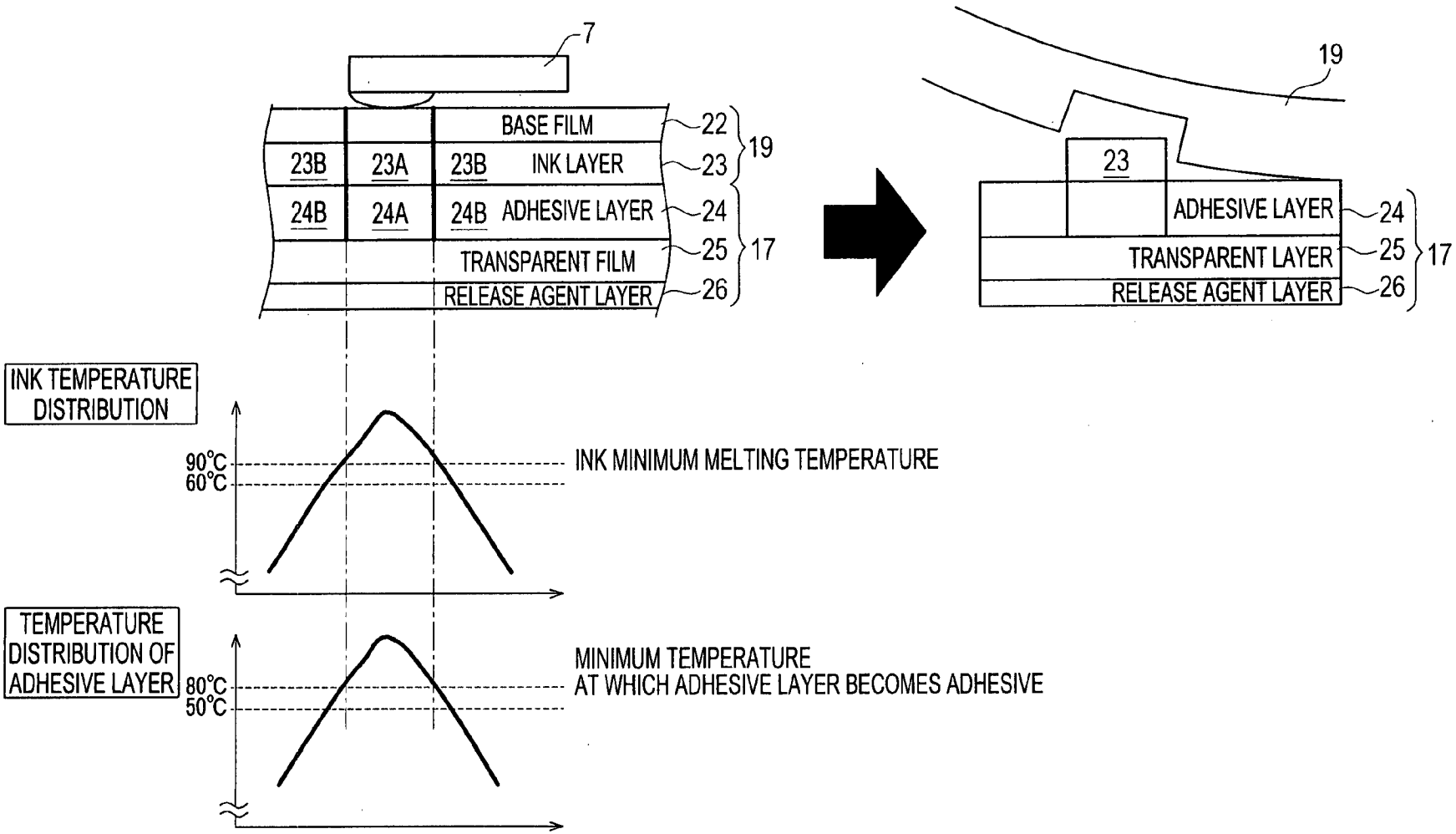
FIG. 4 an explanatory diagram showing a pattern of a transferring mechanism in which an ink layer is transferred to an adhesive layer upon being heated by a thermal head according to the first embodiment.

Next, a transfer mechanism in which an ink layer is transferred to an adhesive layer upon being heated by a thermal head 7 will be described based on FIG. 4. As shown in FIG. 4, when the film tape 17 and the ink ribbon 19 are superimposed at a printing position between the thermal head 7 and the platen roller 8, the adhesive layer 24 of the film tape 17 is brought in contact with the ink layer 23 of the ink ribbon 19. Although the ink layer 23 and the adhesive layer 24 are simultaneously heated at the above described contact portion by the thermal head 7, heat transfer loss occurs at the boundary portion when heat is transferred from the ink layer 23 to the adhesive layer 24, which leads to differences in temperature at the boundary part of the adhesive layer 24 and the ink layer 23. Since the ink layer 23 of the ink ribbon 19 to be used in the tape cassette 101 according to the first embodiment employs a high melting point-type ink which melts at a temperature of 90° C. or above, and the adhesive layer 24 of the film tape 17 employs an adhesive agent that exhibits adhesive properties when heated to 80° C. or above, when the temperature at a heated portion of the ink layer 23A becomes 90° C. or above, the temperature at a heated portion of the layer 24A as well, becomes 80° C. or above, and as a result, the ink layer 23A and the adhesive layer 24A are adhered at their heated portions, respectively.

Since the temperature of the adhesive layer 24B when it is not heated by the thermal head 7 is below 80° C. and thus exhibits no adhesive properties, and the temperature of the ink layer 23B at a portion corresponding to the adhesive layer 24B, as well, is below 90° C., after these layers pass the thermal head 7 and the separating part 4 arranged downstream the thermal head 7, they are heated and only the ink layer 23A which has been adhered to the adhesive layer 24A is transferred to the film tape 17, as shown in FIG. 4. The remaining portions of the ink ribbon are reeled in by the ribbon reel-in spool 21, as consumed ink ribbon 19.

As shown in FIG. 4, the thermal head 7 has a heat concentrated-type glaze structure. The ink layer 23 and the adhesive layer 24 are heated by focusing the heat into a pin-point. Accordingly, since the temperature difference between the heated portions of the ink layer 23A and the adhesive layer 24A and the unheated portions of the ink layer 23B and the adhesive layer 24B becomes large, the ink layer and the adhesive layer can be adhered, with the boundary between the heated portions 23A and the unheated portions 23B of the ink layer and the heated portion 24A and the unheated portion 24B of the adhesive layer 24A clearly defined.

The ink layer 23 includes a wax-type ink so that only the heated portions of the ink later 23 are transferred, even if they cool down after being heated. Accordingly, the heated ink layer 23 can be reliably adhered to the adhesive agent 24A at the heated portion even if the ink 23 cools down, thereby being reliably transferred to a film tape 17 onto which characters and the like are printed.

The film tape 17 onto which characters and the like have been printed is drawn up to the clipper-type cutter unit 14 serving as a cutting device, through the cooperation of the tape conveying roller 77 and the heat roller 15, as described above. The post-printing film tape 17 can thus be cut to a predetermined length through the cooperation of the fixed blade 14A and the movable blade 14B of the cutter unit 14. The cut film tape 17 is passed between the tape conveying roller 77 and the heat roller 15, and upon being heated by the heat roller 15, starts exhibiting adhesive properties in the adhesive layer 24B at portions other than portions where the ink layer 23 has been adhered. Then, the post-printing film tape 17 exhibiting adhesive properties is discharged to the exterior of the tape printing apparatus 210, as a linerless tape as was cut.

Each of drive controls of the above-described units is carried out by a processor (for instance, CPU) (not shown) which is provided in the printing apparatus. For instance, the thermal head 7 operates based on a head driving circuit. The tape feed motor operates based on a motor driving circuit. The cutter unit operates based on a cutter driving circuit. The press contact release motor operates based on a press contact release motor driving circuit. Also, these driving circuits operate based on the processor. This operating pattern is the same for the other embodiments to be described later.

As described in the above, since the tape cassette 101 does not house the adhesive tape spool and the pasting roller and the tape conveying roller 16 and the heat roller 15 are arranged downstream of the cutter unit 14, the post-printing film tape 17 can be cut by the cutter unit 14 arranged immediately downstream of the thermal head 7 immediately after characters and the like have been printed thereon. This makes it possible to shorten the front blank spaces of the post-printing film tape 17, thereby reducing the running cost of the film tape 17.

Further, since the heat roller 15 heats the target layers to 80° C. or above but below 90° C., but the ink to be used is a high melting point-type ink (the melting point of the ink is 90° C. or above), the heat roller 15 does not melt the ink that is adhered to the adhesive layer 24, thereby eliminating the risk of faulty printing caused by ink melting and the like.

Since the heat roller 15 is brought in contact with the tape film 17 from the side of the release agent layer 26 (the back surface side of the adhesive layer 24) of the post-printing film tape 17, direct contact between the heat roller 15 and the adhesive layer can be avoided, thereby preventing adherence of the heated layer 24 to the heat roller 15.

Since the heated adhesive layer 24 maintains its adhesive properties even after its temperature decreases, the linerless tape produced as described above is pasted onto the target body as is, through the adhesive layer 24. As a result, the user does not have to remove the release sheet, as was done in the case of using the conventional laminated tape. Further, since the characters and the like in the transferred ink layer 23 are printed as mirror image with respect to the film tape 17, the user can recognize the characters printed as normal image, through the transparent film. Here, the release adhesive layer is also transparent. Needless to say, the adhesive layer present between the film layer and the ink layer is necessarily transparent or semi-transparent, to thus make the ink layer visible through the transparent film.

The outer shape of the tape printing apparatus 110 and the tape cassette 101 as shown in the description of the first embodiment is given as merely one example, and the present disclosure is not limited to this outer shape.

Second Embodiment

Next, a tape cassette and a tape printing apparatus according to a second embodiment will be described based on FIG. 5 and FIG. 6.

The configuration of the tape cassette 101 according to the second embodiment is the same as the configuration of the tape cassette 101 according to the first embodiment. Also, the configuration of the tape printing apparatus 210 according to the second embodiment is substantially the same as the configuration of the tape printing apparatus 110 according to the first embodiment. In the following description, elements which are the same as those of the tape cassette 101 and the tape printing apparatus 110 according to the first embodiment are denoted by the same numerical symbols.

In the tape printing apparatus 110 according to the first embodiment, the tape conveying roller 16 is arranged in the tape printing apparatus 110. However, in the second embodiment, a conveying roller 77 having the same function as the tape conveying roller 16 in the first embodiment is provided in an auxiliary cassette 70. The tape printing apparatus 210 is not provided with a roller for tape conveying. In the second embodiment, the tape printing apparatus 210 is provided with a conveying roller shaft 72 coupled with the conveying roller 77 and an auxiliary sheet medium reel-in shaft 73 coupled with an auxiliary sheet medium reel-in spool 76.

Figure 5:
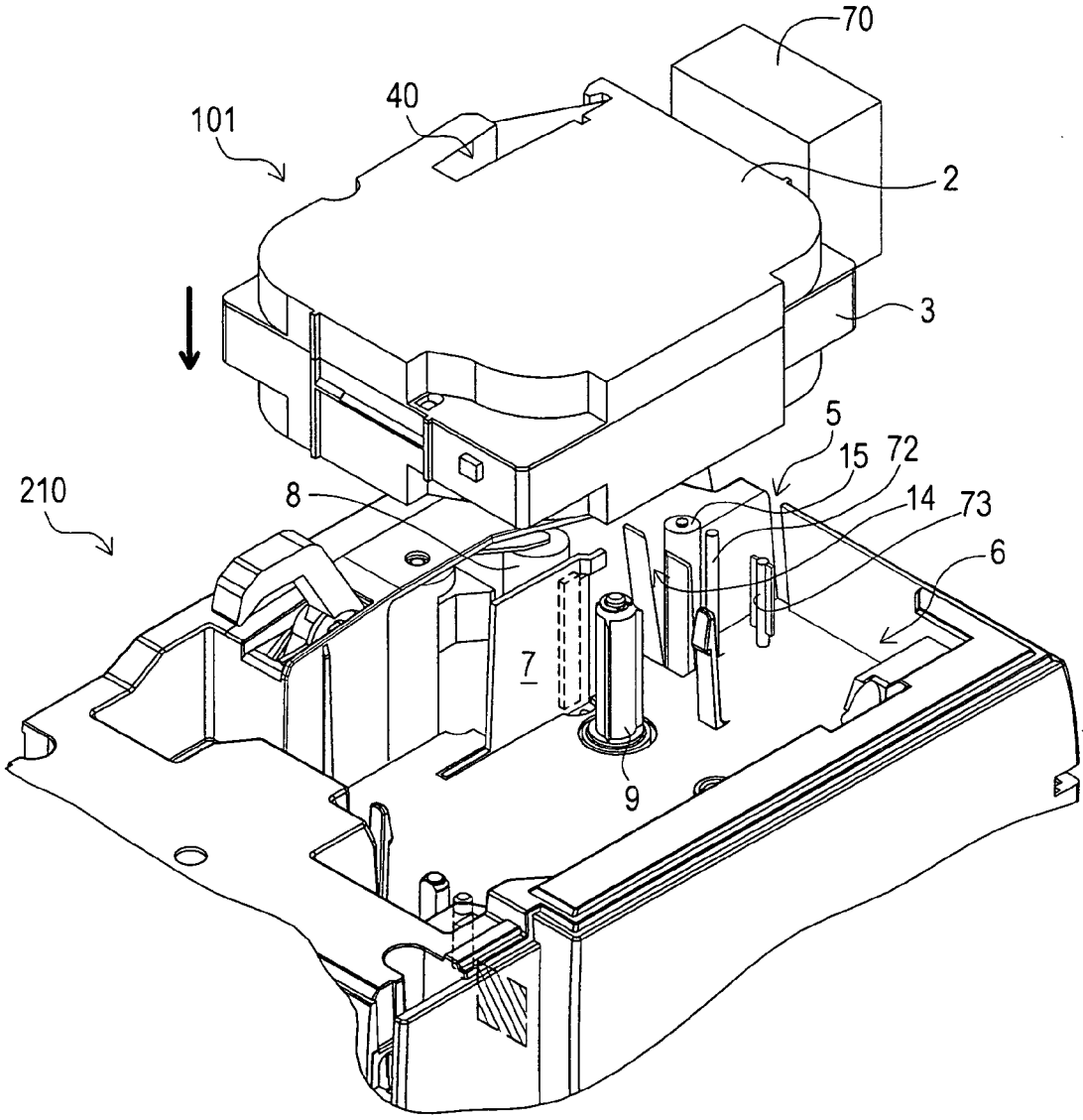
FIG. 5 is an enlarged perspective view of a relevant part showing mounting of a tape cassette and an auxiliary cassette in a cassette housing part of the tape printing apparatus according to a second embodiment.
Figure 6:
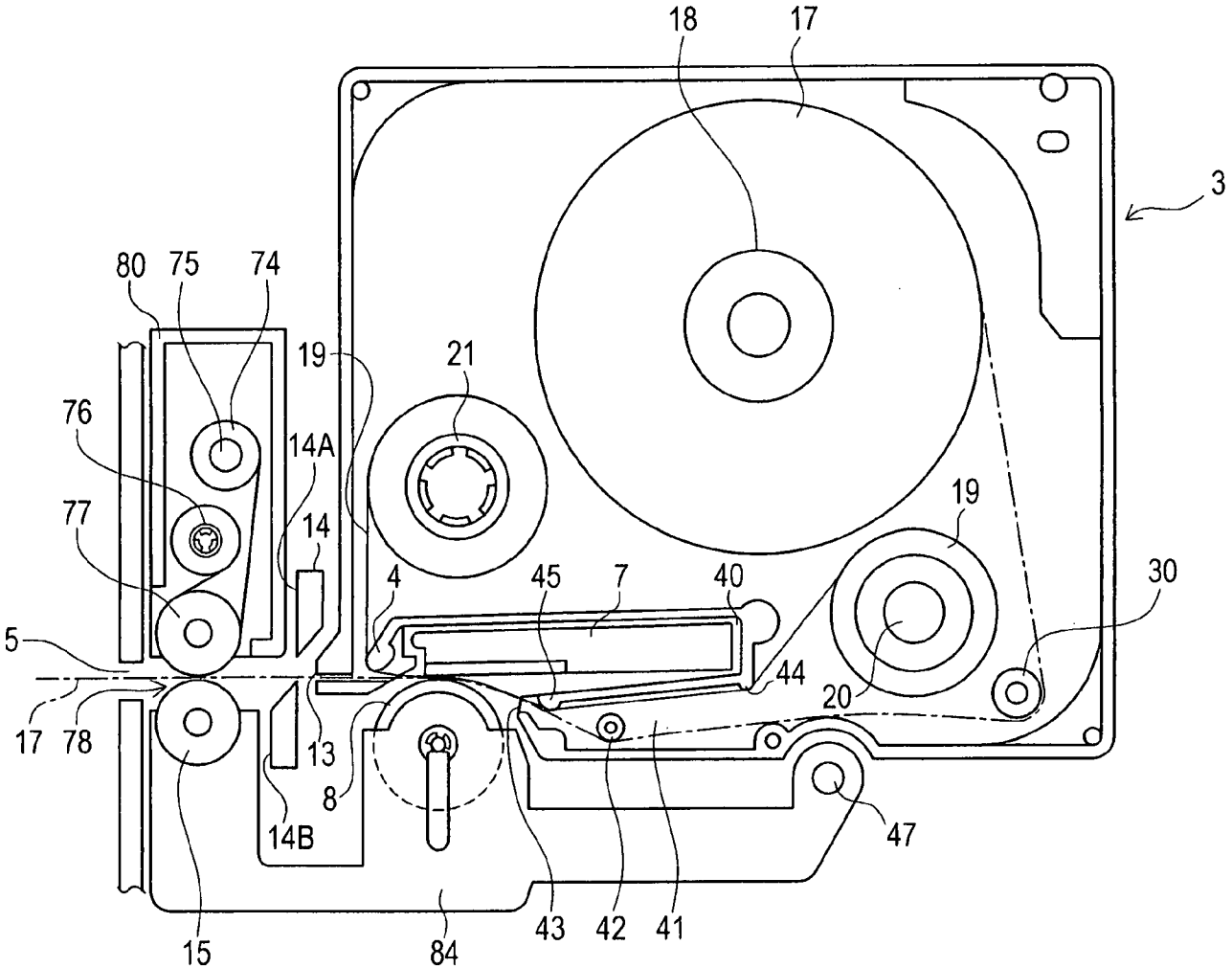
FIG. 6 is a plan view showing a pattern of an internal configuration of a tape cassette and an auxiliary cassette according to the second embodiment.

In FIG. 5, the tape cassette 101 is detachably loaded in the cassette housing part 6 provided in the tape printing apparatus 210. The tape cassette 101 of the second embodiment has the same configuration as the tape cassette 101 of the first embodiment, and further description thereof is hereby omitted.

Also, in FIG. 5, the auxiliary cassette 70 is detachably loaded into the cassette housing part 6 provided in the tape printing apparatus 210. The auxiliary cassette 70 is provided with an auxiliary sheet medium spool 75 onto which an auxiliary sheet medium 74 is wound, as shown in FIG. 6. The auxiliary cassette 70 is also provided with an auxiliary sheet medium reel-in spool 76 that draws and reels in the auxiliary sheet medium 74 from the auxiliary sheet medium spool 75.

The outer shape of the auxiliary cassette 70 is defined by the cassette case 80. In other words, the auxiliary cassette 70 is configured so that the auxiliary sheet medium 74 and the feed roller are accommodated inside the cassette case 80.

Further, the feed roller 77 is rotatably mounted on the auxiliary cassette 70, with one portion thereof being exposed from the auxiliary cassette 70. In other words, the cassette case 80 has an opening defined therein. At the time of printing, the feed roller 77 faces the heat roller 15 provided in the tape printing apparatus 210. Specifically, the feed roller 77 and the heat roller 15 can be press contacted against each other.

At the time of printing, the auxiliary sheet medium 74 is fed to the conveying roller 77, and is further fed in a downstream direction together with the post-printing film tape 17. Thereafter, the auxiliary sheet medium 74 is fed to the auxiliary sheet medium reel-in spool 76. In other words, since the film tape 17 and the auxiliary sheet medium 74 come into contact with each other at the time of printing, the conveying roller 77 and the film tape 17 do not touch. This contact position is the position where the heat roller 15 and the conveying roller 77 face each other, as shown in FIG. 6.

Next, a description will be given on the configuration of the tape housing part 6 in the tape printing apparatus 210. As shown in FIG. 5 and FIG. 6, a thermal head 7 is fixed in the cassette housing part 6 of the tape printing apparatus 210. The thermal head 7 is tabular with a substantially rectangular shape in a longitudinal direction thereof when viewed from the front and, as shown in FIG. 6, has a predetermined number of heat generating elements formed on a left margin at a front surface thereof, and aligned along the left margin. The cassette housing part 6 has a holder 84 that is rotatably supported around the holder shaft 47. In turn, the holder 84 has a platen roller 8 rotatably supported therein. The holder 84 is biased in a counterclockwise direction around the holder shaft 47 by an elastic member not shown, and at the time of printing onto the film tape 17, it is driven in a clockwise direction by a motor or the like. This allows the platen roller to come into contact and move away with respect to the thermal head 7. The holder 84 also has a heat roller 15 which is rotatably supported therein. As was described in the above, the holder 84 is biased in a counterclockwise direction around the holder shaft 47 by an elastic member which is not shown, and at the time of printing onto the film tape 17, it is driven in a clockwise direction by a motor or the like, thereby allowing the heat roller 15 to come into contact or move away with respect to the conveying roller 77.

As described above, the cassette housing part 6 is provided with an auxiliary sheet medium reel-in shaft 73 that is couple to the auxiliary sheet medium reel-in spool 76 of the auxiliary cassette 70. The auxiliary sheet medium reel-in shaft 73 is coupled to a driving mechanism such as a motor or the like, not shown, and serves to drive and rotate the auxiliary sheet medium reel-in spool 76. The cassette housing part 6 is also provided with a conveying roller shaft 72. The conveying roller shaft 72 is coupled to a driving mechanism such as a motor and the like, not shown, and serves to drive and rotate the conveying roller 77.

A heat roller 15 for heating the adhesive layer (to be described later) formed in the film tape 17 is provided downstream of the cutter unit 14. The post-printing film tape 17 is discharged to the exterior of the tape printing apparatus 210 through the cooperation of the heat roller 15 and the conveying roller 77. For convenience of the description to follow, the pair including the heat roller 15 and the conveying roller 77 may be denoted as the pair of conveying rollers 78. The auxiliary sheet medium reel-in spool 76 as well is driven and rotated to thus convey the auxiliary sheet medium, together with the post-printing film tape 17, through the cooperation of the heat roller 15 and the conveying roller 77.

After characters and the like are printed thereon through the ink ribbon 19 and the thermal head 7 and simultaneously, the ink ribbon 19 is separated therefrom by the separating member 4, the film tape 17 is discharged from the tape discharge port 13 to the exterior of the tape cassette 1, and further discharged to the exterior of the tape printing apparatus 210 through the pair of conveying rollers 78. At this time, the adhesive layer of the film tape 17 is heated by the heat roller 15 of the pair of conveying rollers 78, and as a result, the adhesive layer exhibits adhesive properties.

Since the ink ribbon and the printing tape according to the second embodiment have the same configuration as that described in the first embodiment (refer to FIG. 2), further description thereof is hereby omitted. Also, since the transfer mechanism in which the ink layer is transferred to the adhesive layer upon being heated by the thermal head 7, according to the second embodiment is the same as the mechanism in the above-described first embodiment (refer to FIG. 3 and FIG. 4), further description thereof is hereby omitted.

The film tape 17 onto which characters and the like have been printed is drawn up to the clipper-type cutter unit 14 serving as a cutting device, through the cooperation of the tape conveying roller 16 and the heat roller 15, as described above. The post-printing film tape 17 can thus be cut to a predetermined length through the cooperation of the fixed blade 14A and the movable blade 14B of the cutter unit 14. The cut film tape 17 is passed between the tape conveying roller 16 and the heat roller 15, and upon being heated by the heat roller 15, starts exhibiting adhesive properties in the adhesive layer 24B at portions other than portions where the ink layer 23 has been adhered. Then, the post-printing film tape 17 exhibiting adhesive properties is discharged to the exterior of the tape printing apparatus 210, as a linerless tape as was cut.

As described above, the adhesive agent of the post-printing film tape 17 exhibits adhesive properties upon being heated by the heat roller 15. Here, if the adhesive force of the post-printing film tape 17 is strong, there is a risk that the adhesive agent will be transferred to the surface coming in contact with the adhesive layer. In the second embodiment, the auxiliary sheet medium 74 and the adhesive surface of the printing tape are configured so as to come into contact. New (namely, clean) portions of auxiliary sheet medium 74 that come into contact with the adhesive surface are continuously fed to the pair of conveying rollers 78 by the auxiliary sheet medium reel-in spool 76. In this way, the adhesive agent of the post-printing film tape 17 does not adhere to the conveying roller 77. Even if the adhesive agent of the post-printing film tape 17 adheres to the auxiliary sheet medium 74, since the auxiliary sheet medium 74 is fed to the auxiliary sheet medium reel-in spool 76, the auxiliary sheet medium 74 onto which the adhesive agent is pasted cannot adhere to the post-printing film tape 17 that is to be subsequently fed.

Thus, since the tape cassette 101 does not accommodate an adhesive tape spool and a pasting roller and the pair of conveying rollers 78 are arranged downstream the cutter unit 14, the post-printing film tape 17 can be cut immediately after characters and the like have been printed thereon by the cutter unit 14 which is arranged immediately downstream the thermal head 14. This makes it possible to shorten the front blank spaces of the post-printing film tape 17, thereby reducing the running cost of the film tape 17.

The heat roller 15 heats the target layers to 80° C. or above but below 90° C., but since the ink to be used is a high melting point-type ink, (melting point of the ink is 90° C. or above), the ink which is adhered to the adhesive layer 24 is not melted by the heat roller, thereby eliminating the risk of faulty printing caused by ink melting or the like.

Since the heat roller 15 is brought in contact with the tape film 17 from the side of the release agent layer 26 (the back surface side of the adhesive layer 24) of the post-printing film tape 17, direct contact between the heat roller 15 and the adhesive layer can be avoided, thereby preventing adherence of the heated layer 24 to the heat roller 15.

Since the heated adhesive layer 24 maintains its adhesive properties even after its temperature decreases, the linerless tape produced as described above is pasted onto the target body as is, through the adhesive layer 24. As a result, the user does not have to remove the release sheet, as was done in the case of using the conventional laminated tape. Further, since the characters and the like in the transferred ink layer 23 are printed as mirror image with respect to the film tape 17, the user can recognize the characters printed as normal image, through the transparent film. Here, the release adhesive layer is also transparent. Needless to say, the adhesive layer present between the film layer and the ink layer is necessarily transparent or semi-transparent, to thus make the ink layer visible through the transparent film.

In the second embodiment, since the adhesive layer of the post-printing film tape 17 does not come into contact with the conveying roller 77 when the post-printing film tape 17 is heated, the adhesive agent does not adhere to the conveying roller 77, thereby making it possible to prevent faulty conveyance from occurring. Also, even if the adhesive agent adheres to the auxiliary sheet medium 74, it is possible to prevent the adhesive agent that adhered from smearing the post-printing film tape 17 which is subsequently fed.

Further, the auxiliary sheet medium 74 can include a medium having a release agent layer coated onto a surface thereof that comes into contact with the post-printing film tape 17. As a result, the auxiliary sheet medium 74 and the heated post-printing film 17 can be smoothly peeled, thereby allowing excellent tape conveyance.

Figure 7:
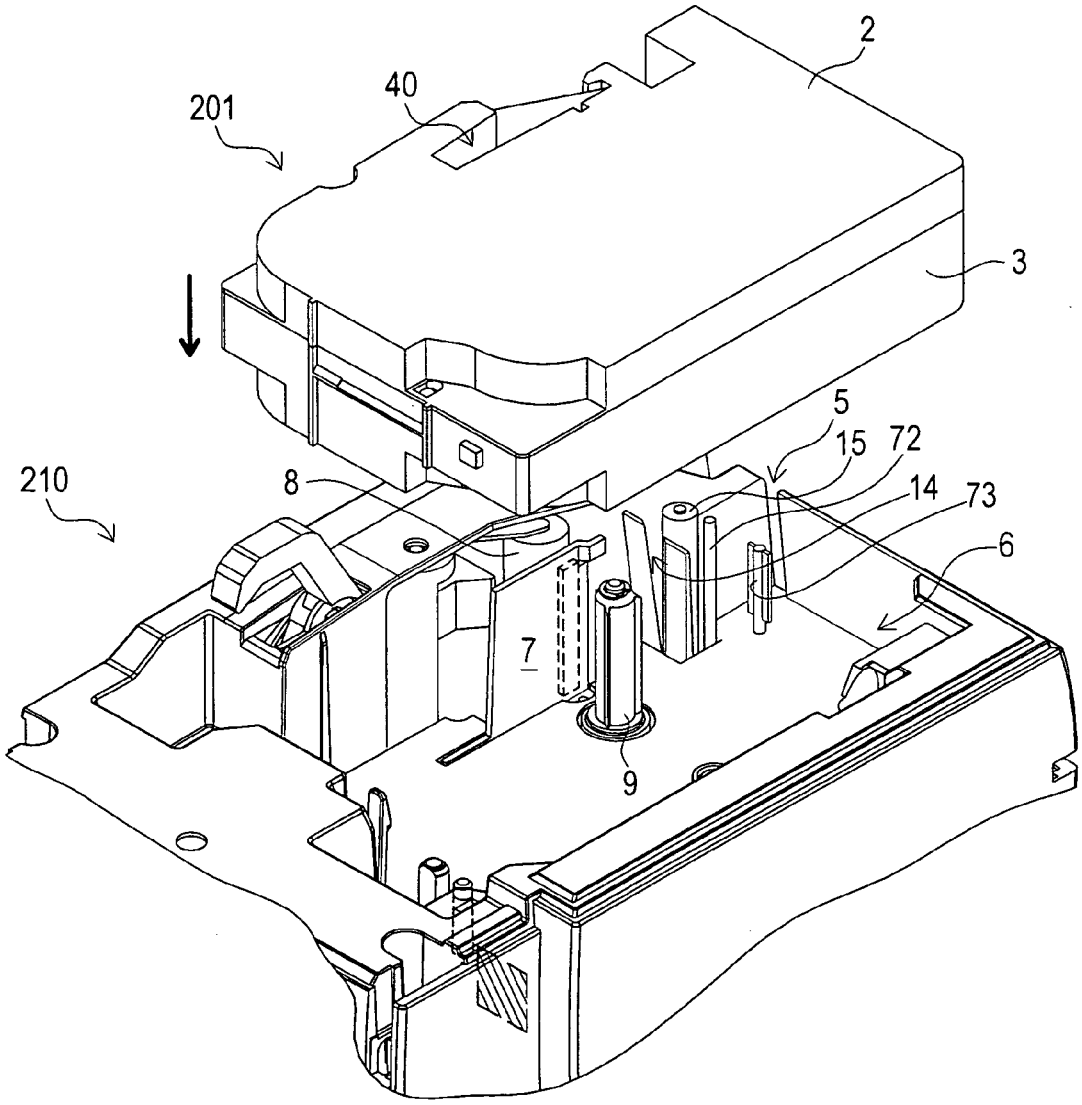
FIG. 7 is an enlarged perspective view of a relevant part showing mounting of a tape cassette in a cassette housing part of a tape printing apparatus according to the second embodiment.

In the second embodiment, the tape cassette 101 and the auxiliary cassette 70 are configured as individual units (namely, configured separately), but the tape cassette and the auxiliary cassette can also be integrally configured, as shown in FIG. 7.

Figure 8:
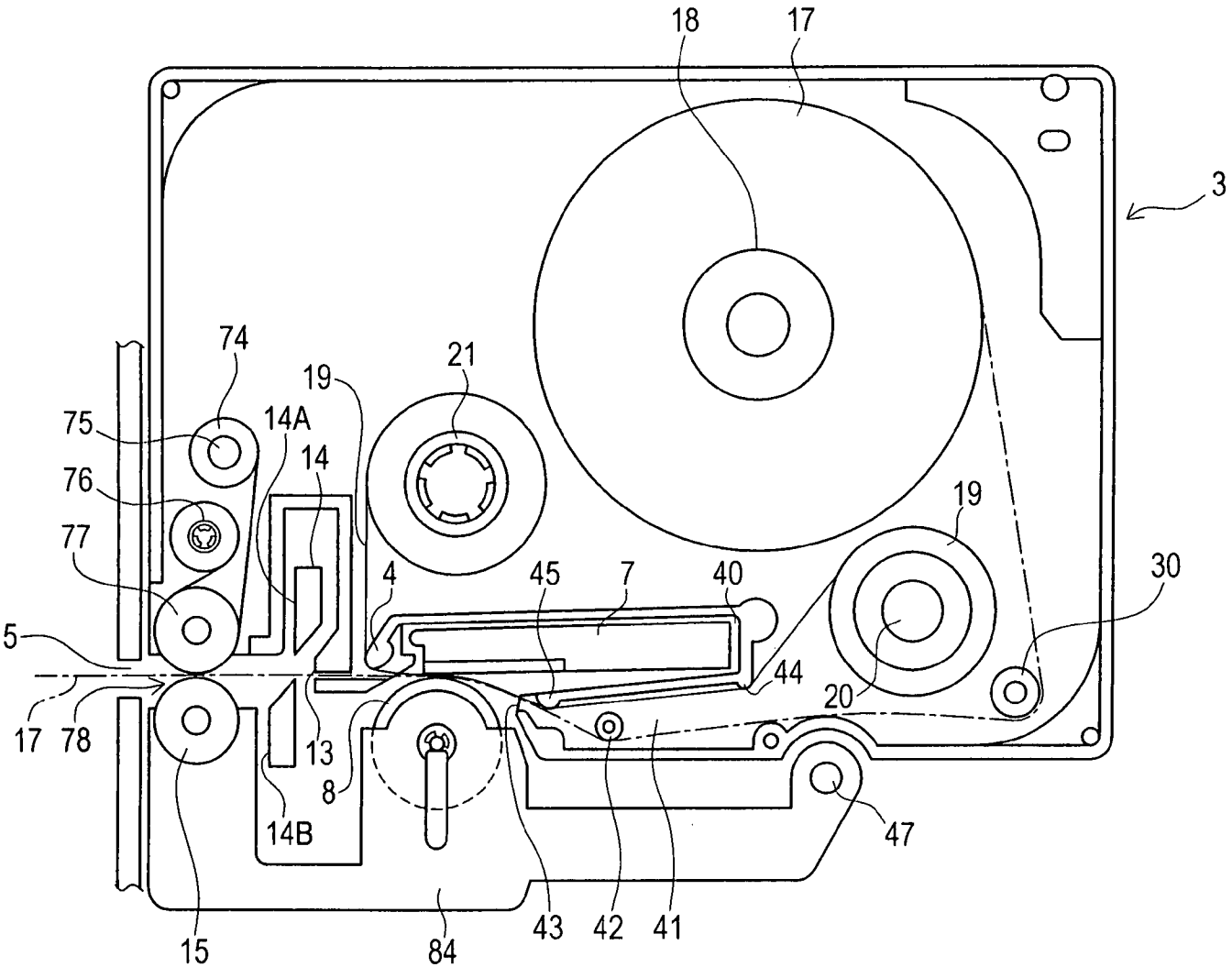
FIG. 8 is plan view showing a pattern of an internal configuration of the tape cassette according to the second embodiment.

In this case, the tape cassette 201 is provided with the auxiliary sheet medium 74, the auxiliary sheet medium reel-in spool 76, the conveying roller 77, the film 17, the ribbon 19 and the like, as shown in FIG. 8. The tape cassette 201 has a notch part, as shown in FIG. 8. If this notch part is present between the conveying roller 77 and the tape discharge port 13. When the tape cassette 201 is mounted on the tape printing apparatus 210, the cutter 14A of the tape printing apparatus 210 is positioned in this notch part. In the tape printing apparatus 201 using the tape cassette 201, as well, since the adhesive layer of the post-printing film tape 17 does not come into contact with the conveying roller 77 when the post-printing film tape 17 is heated, the adhesive agent does not adhere to the conveying roller 77, thereby making it possible to prevent faulty conveyance from occurring. Thus, even if the adhesive agent adheres to the auxiliary sheet medium 74, it is possible to prevent the adhesive agent that adhered to the auxiliary sheet medium from smearing the post-printing film tape 17 that is subsequently fed.

The outer shape of the tape printing apparatus 210, the tape cassette 101, the tape cassette 201, and the auxiliary cassette 70 as shown in the description of the second embodiment are given as merely one example, and the one or more aspects of the disclosure is not limited to this outer shape.

Third Embodiment

In the second embodiment described above, the auxiliary sheet medium is rewound onto the auxiliary sheet medium take-up spool as the printed film tape is conveyed. As a result, it is no longer necessary to peel off the auxiliary sheet medium at the time of adhering the printed film tape to the target body. At the same time, however, the adhesive layer of the film tape is not protected. This makes it difficult to store the film tape formed in the manner described above, for a long period of time without being adhered to the target body.

Figure 9:
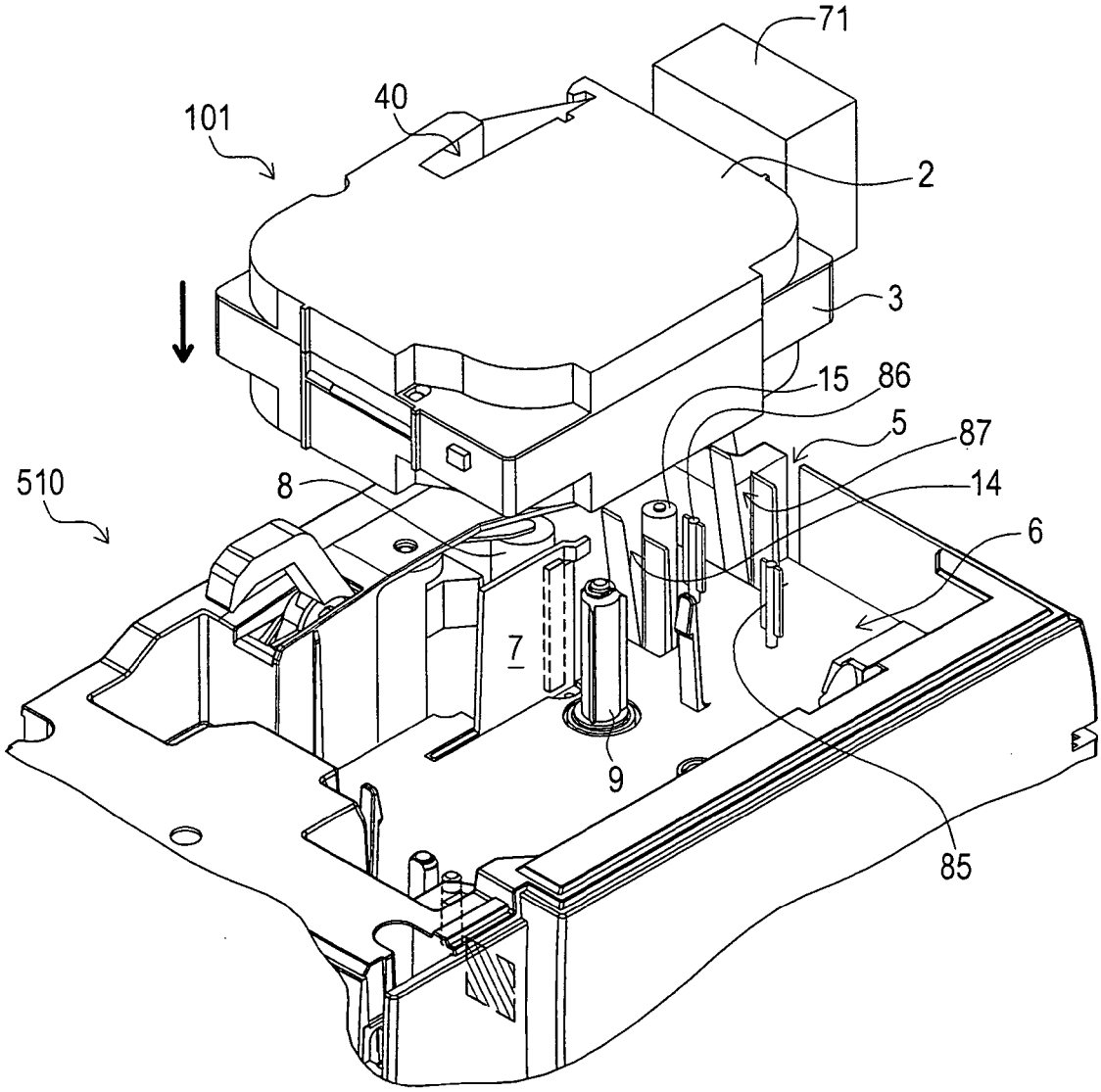
FIG. 9 is an enlarged perspective view of a relevant part showing mounting of a tape cassette in a cassette housing part of a tape printing apparatus according to a third embodiment.
Figure 10:
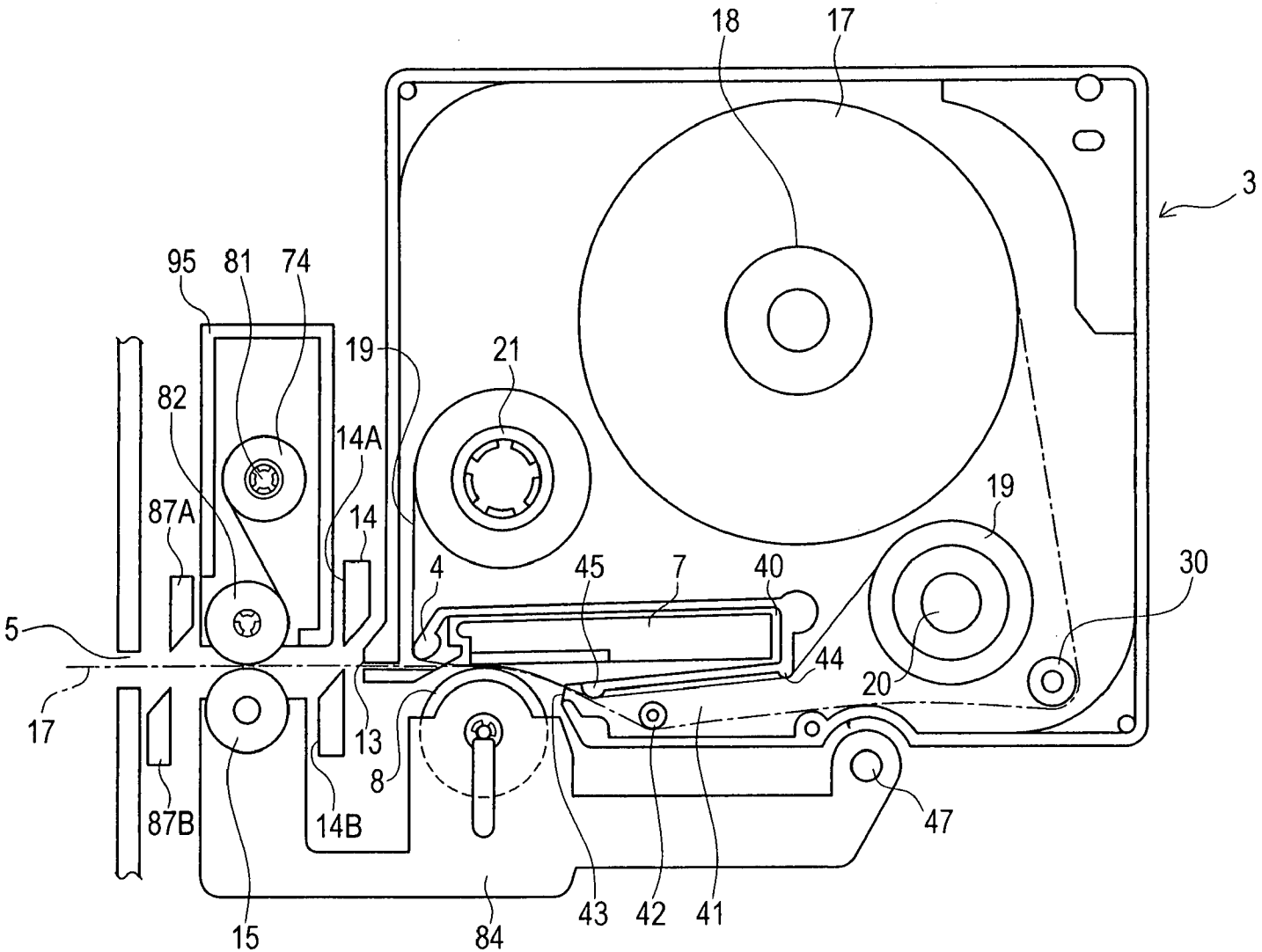
FIG. 10 is plan view showing a pattern of an internal configuration of the tape cassette according to the third embodiment.

The third embodiment that will be described next has been worked out to solve these problems. A tape cassette, auxiliary cassette, and tape printing apparatus according to the third embodiment will next be described based on FIG. 9 and FIG. 10.

The configuration of the tape cassette 101 according to the third embodiment is the same as the configuration of the tape cassette 101 according to the second embodiment.

Also, the configuration of the tape printing apparatus 510 according to the third embodiment is substantially the same as the configuration of the tape printing apparatus 210 according to the second embodiment.

Also, the configuration of the auxiliary cassette 71 according to the third embodiment is substantially the same as the configuration of the auxiliary cassette 70 according to the second embodiment.

In the following description, elements which are the same as those of the tape cassette 101, the tape printing apparatus 210, and the auxiliary cassette 70 according to the second embodiment are denoted by the same numerical symbols.

(Auxiliary Cassette)

First, an auxiliary cassette 71 according to the present embodiment will now be described. The auxiliary cassette 71 is detachably mounted on a cassette housing unit 6 provided in a tape printing apparatus 510.

An auxiliary sheet medium spool 81 and a feed roller 82 are mounted on the auxiliary cassette 71. An auxiliary sheet medium 74 is wound onto the auxiliary sheet medium spool 81.

The outer shape of the auxiliary cassette 71 is defined by a cassette case 95. Specifically, the auxiliary cassette 71 is configured so that the auxiliary sheet medium 74 and the feed roller 82 are accommodated inside the cassette case 95.

The feed roller 82 is rotatably mounted on the auxiliary cassette 71. A portion of the feed roller 82 is exposed from the auxiliary cassette 71. Specifically, the cassette case 95 has an opening defined therein. Also, the auxiliary cassette 71 is mounted on the cassette housing unit 6 at a location so as to face a heat roller 15. Specifically, the feed roller 82 and the heat roller 15 can be press contacted against each other.

(Tape Printing Apparatus)

Next, the tape printing apparatus 510 according to the present embodiment will be described. An auxiliary sheet medium rewind shaft 85 and a feed roller shaft 86 are mounted on the cassette housing unit 6. If the auxiliary cassette 71 is mounted on the cassette housing unit 6, the auxiliary sheet medium rewind shaft 85 is linked with the auxiliary sheet medium spool 81. The auxiliary sheet medium rewind shaft 85 is rotated by a driving mechanism not shown here. When the auxiliary sheet medium rewind shaft 85 is rotated, the auxiliary sheet medium 74 is rewound in an opposite direction with the conveying direction at the time of printing.

If the auxiliary cassette 71 is mounted on the cassette housing unit 6, the feed roller shaft 86 is linked with the feed roller 82. The feed roller shaft 86 is rotated by a driving mechanism not shown here. When the feed roller shaft 86 is rotated, the auxiliary sheet medium 74 is adhered to the printed film tape 17, and at the same time, the printed film tape 17 is conveyed towards a second cutter unit 87 (to be described later).

The second cutter unit 87 is mounted on a downstream side from the feed roller shaft 86 in the conveying direction. The second cutter unit 87 is configured by a fixed blade 87A and a movable blade 87B. The printed film tape 17 is cut by movement of the movable blade 87B towards the fixed blade 87A. The movable blade 87B is drive controlled by a driving mechanism not shown here.

The film tape 17 which was printed at the location of the thermal head 7 and the platen roller 8 is conveyed by rotation of the platen roller 8 to the location of the second cutter unit 87.

Figure 11:
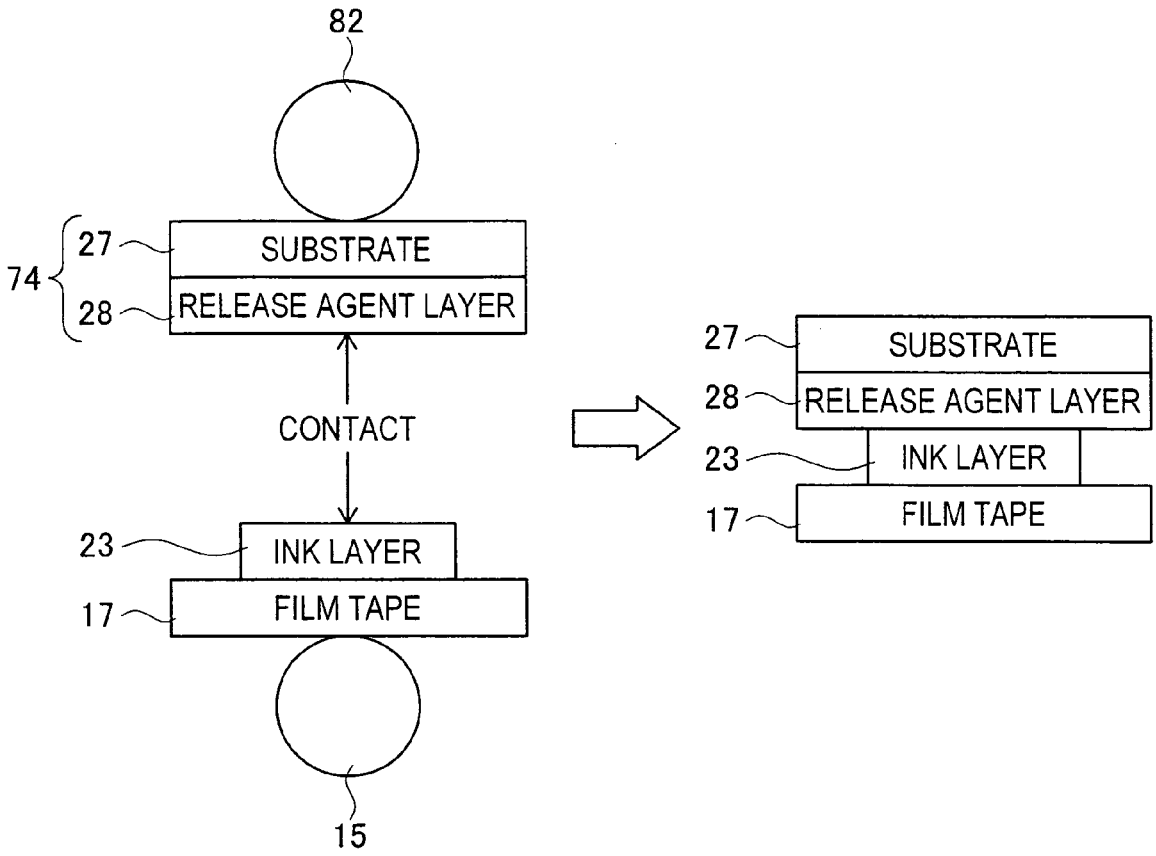
FIG. 11 is a schematic view showing a condition where the auxiliary sheet medium is adhered to the printed film tape.

As shown in FIG. 11, the auxiliary sheet medium 74 is constituted of a substrate 27 and a release agent layer 28. The printed film tape 17 having an ink layer 23 adhered thereto and the auxiliary sheet medium 74 come into contact with each other between the heat roller 15 and the feed roller 82, whereby the auxiliary sheet medium 74 is adhered to the printed film tape 17. The printed film tape 17 to which the auxiliary sheet medium 74 has been adhered is discharge to the exterior of the tape cassette 101 from a discharge port 5.

The adhesive layer 24 is thus protected by the auxiliary sheet medium 74, which enables easy storage of the film tape 17 which is formed in the manner described above, for a long period of time without being adhered to the target body. The auxiliary sheet medium 74 is peeled off upon being adhered to the target body. Since the adhesive layer 24 and the feed roller 82 do not come into contact with each other, it is unlikely that the adhesive agent of the adhesive layer 24 will adhere to the feed roller 82. Since the cutter unit 14 is mounted on the vicinity of a downstream side from the thermal head 7 in the conveying direction, a blank portion at the front end portion of the thus formed film tape 17 can be shortened. As a result, the amount of consumed film tape 17 can be reduced.

Figure 12:
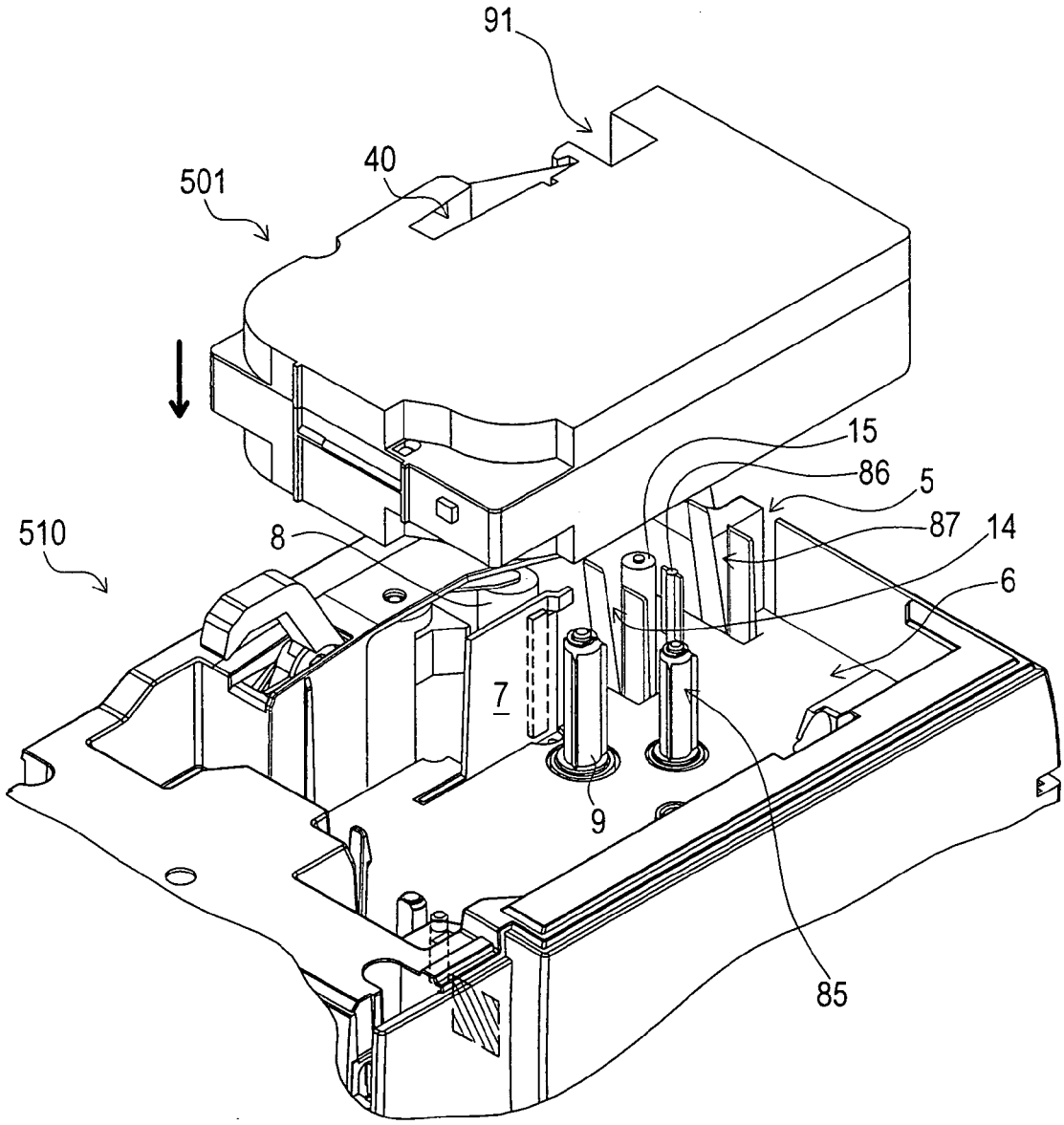
FIG. 12 is an enlarged perspective view of a relevant part showing mounting of a tape cassette in a cassette housing part of a tape printing apparatus according to the third embodiment.
Figure 13:
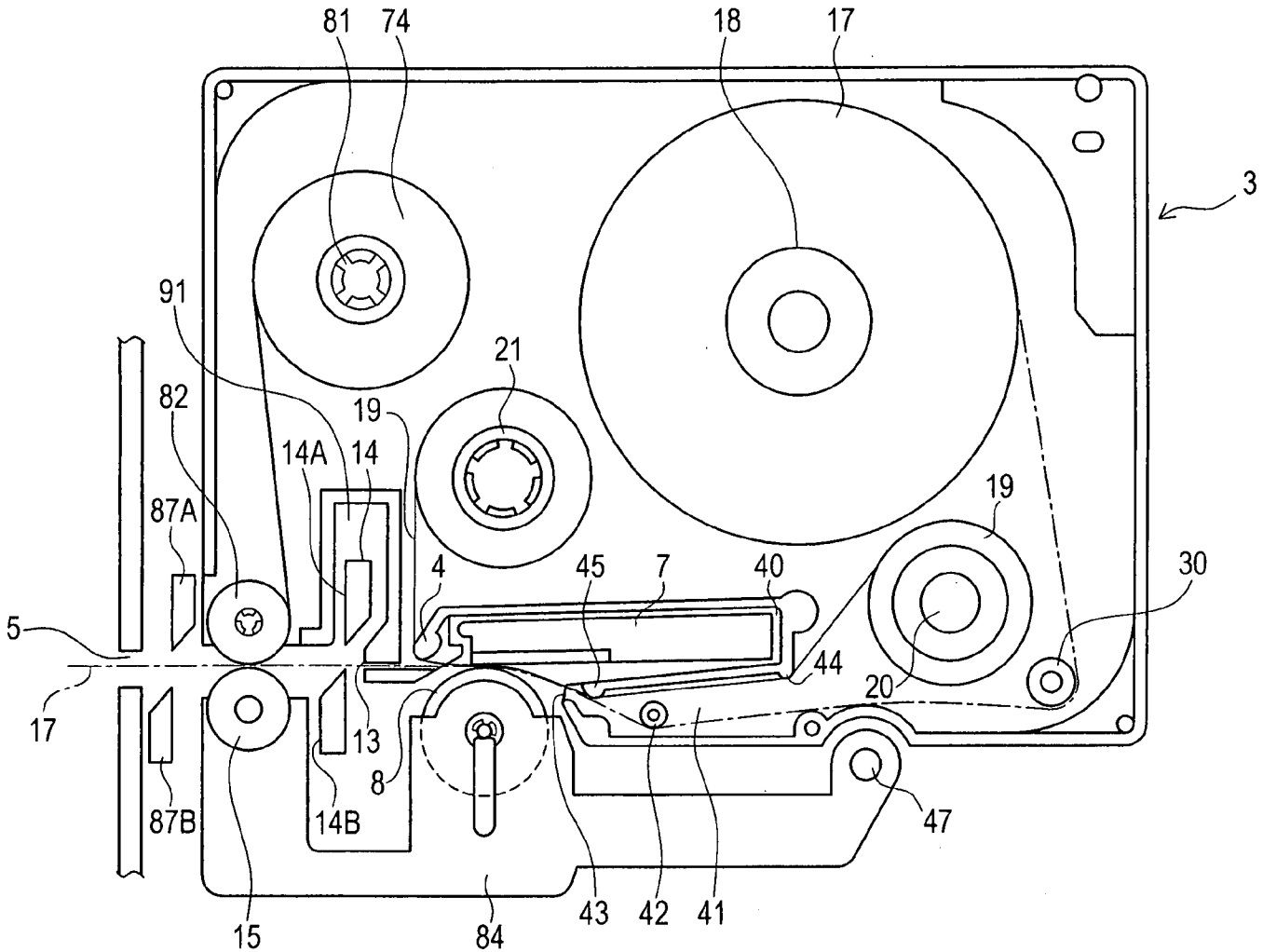
FIG. 13 is plan view showing a pattern of an internal configuration of the tape cassette according to the third embodiment.
Figure 14:
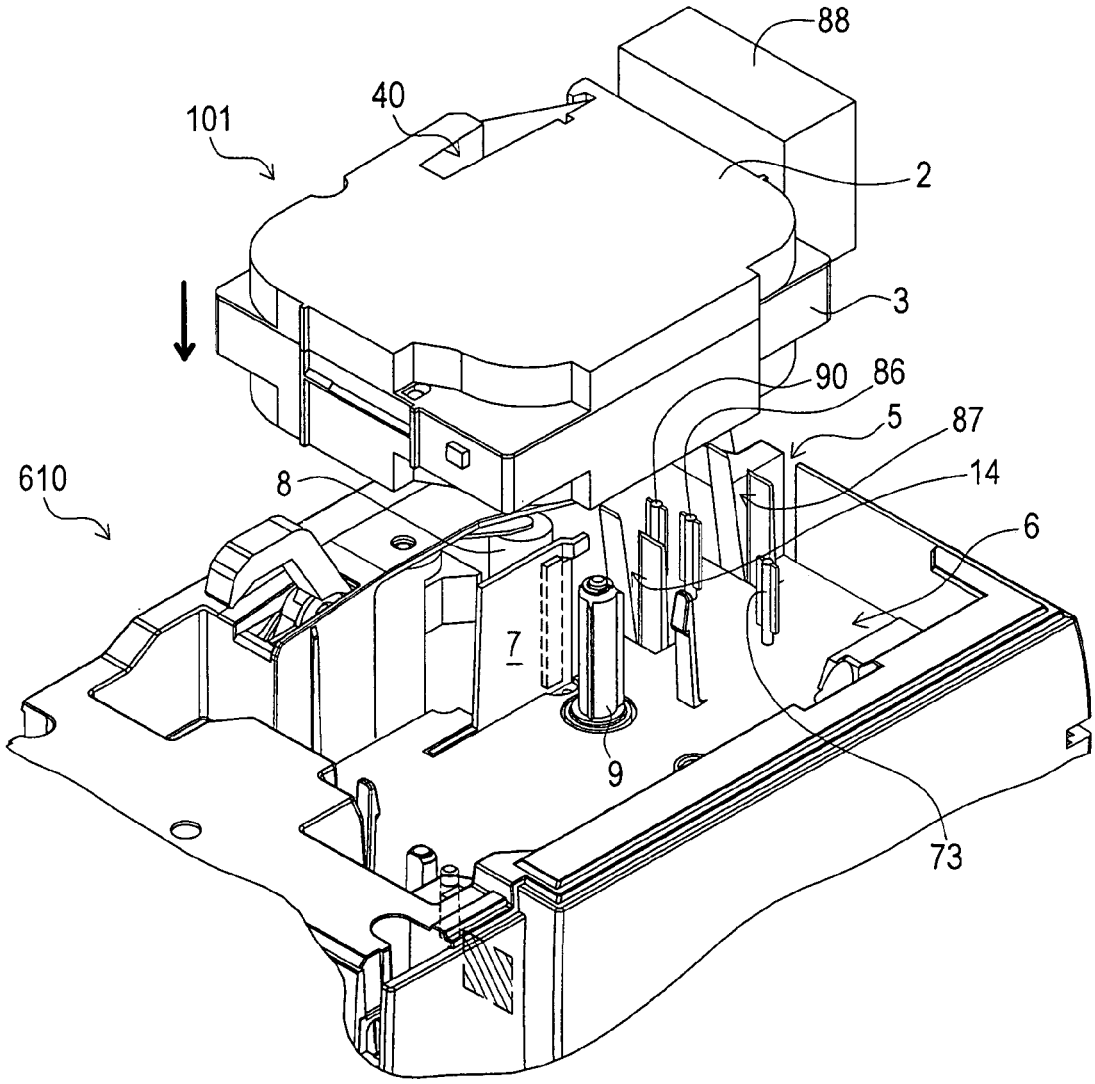
FIG. 14 is an enlarged perspective view of a relevant part showing mounting of a tape cassette in a cassette housing part of a tape printing apparatus according to a fourth embodiment.
Figure 15:
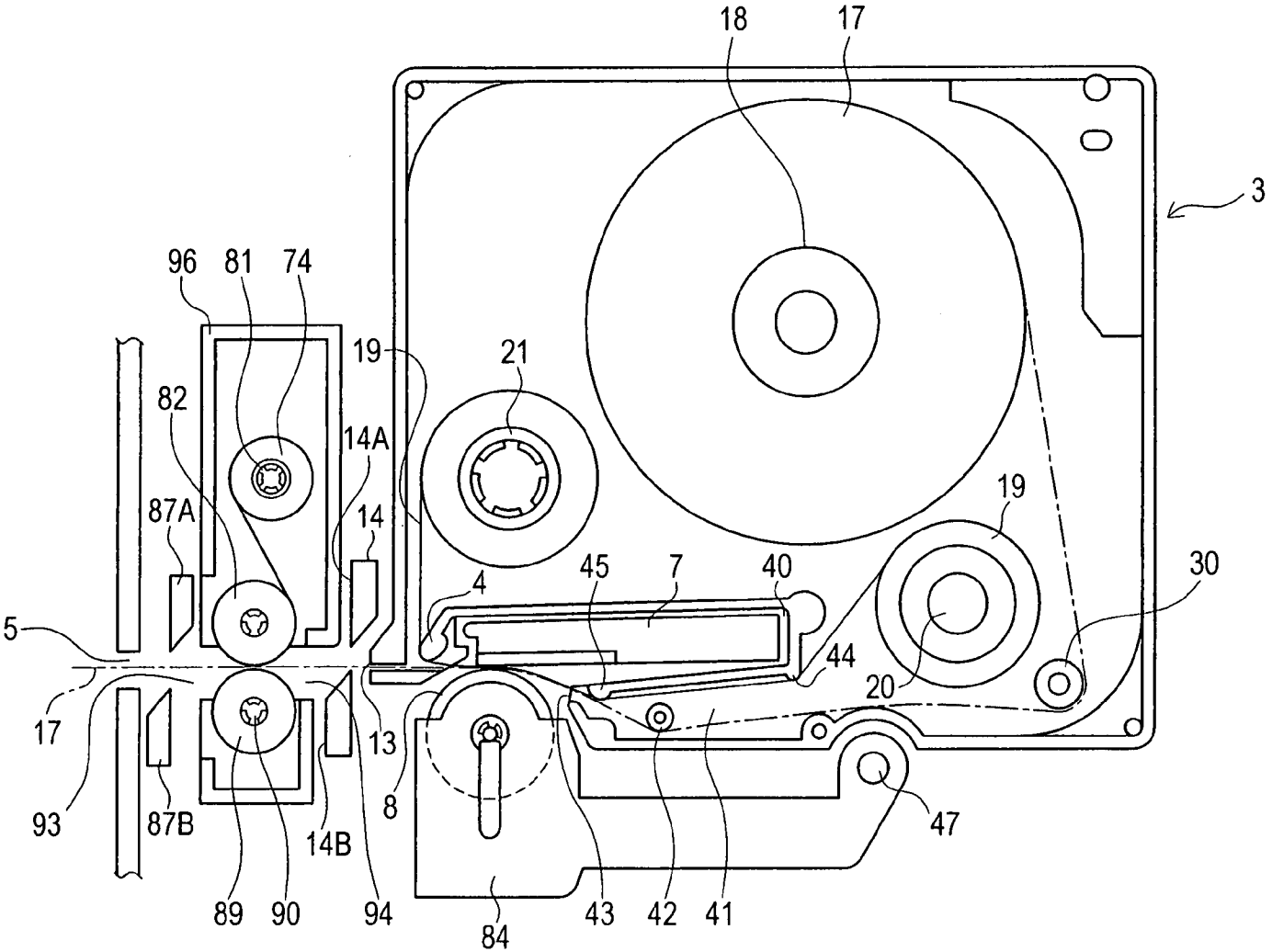
FIG. 15 is plan view showing a pattern of an internal configuration of the tape cassette according to the fourth embodiment.

In the third embodiment, the tape cassette 101 and the auxiliary cassette 71 are configured as individual units (namely, configured separately), but the tape cassette and the auxiliary cassette can also be integrally configured, as shown in FIG. 12 and FIG. 13.

In this case, the tape cassette 501 is provided with the auxiliary sheet medium 74, the conveying roller 82, the film 17, the ribbon 19 and the like, as shown in FIG. 13.

The tape cassette 501 has a notch part 91. If this notch part 91 is present between the tape conveying roller 82 and the tape discharge port 13. When the tape cassette 501 is mounted on the tape printing apparatus 510, the cutter 14A of the tape printing apparatus 510 is positioned in the notch part 91.

When the printed film tape 17 is heated in the tape printing apparatus 510 which employs the tape cassette 501, the adhesive layer of the printed film tape 17 does not come into contact with the feed roller 82. This prevents the adhesive agent from adhering to the feed roller 82. As a result, conveyance failures can be prevented from occurring. Since the adhesive layer is protected by the base, the film tape 17 which is discharged from the discharge port 5 can be easily stored for a long time without being adhered to the target body. The auxiliary sheet medium 74 is peeled off upon being adhered to the target body.

The outer shape of the tape printing apparatus, the tape cassette, and the auxiliary cassette as shown in the description of the third embodiment are given as merely one example, and the one or more aspects of the disclosure is not limited to this outer shape.

Fourth Embodiment

Next, the fourth embodiment will be described. Similarly with the third embodiment described earlier, in the fourth embodiment, the printed film tape is discharged with the auxiliary sheet medium adhered thereto. The fourth embodiment differs from the third embodiment described above in that the heat roller is mounted on the auxiliary cassette.

The configuration of the tape cassette 101 according to the third embodiment is the same as the configuration of the tape cassette 101 according to the third embodiment.

Also, the configuration of the tape printing apparatus 610 according to the fourth embodiment is substantially the same as the configuration of the tape printing apparatus 510 according to the third embodiment.

Also, the configuration of the auxiliary cassette 88 according to the fourth embodiment is substantially the same as the configuration of the auxiliary cassette 71 according to the third embodiment.

In the following description, elements which are the same as those of elements according to the above embodiments are denoted by the same numerical symbols.

A tape printing apparatus 610 is not provided with a heat roller but is provided with a heat roller shaft 90. If an auxiliary cassette 88 (to be described later) is mounted on the cassette housing unit 6, the heat roller shaft 90 is linked with a heat roller 89 (to be described later).

The specific configuration of the heat roller shaft 90 will now be described. A portion of or the entire front face of the heat roller shaft 90 (contact face with the heat roller 89) is formed of a conductor. A current (voltage) supplied from a predetermined supply source provided in the tape printing apparatus 610 is supplied to the conductor of the heat roller shaft 90. The heat roller shaft 90 is rotated by a driving mechanism not shown here.

(Auxiliary Cassette)

The specific configuration of the auxiliary cassette 88 and the heat roller 89 mounted on the auxiliary cassette 88 will now be described. The auxiliary cassette 88 is provided with a heat roller 89, in addition to the auxiliary sheet medium spool 81 and the feed roller 82 described above. The printed film tape 17 is conveyed between the feed roller 82 and the heat roller 89.

The outer shape of the auxiliary cassette 88 is defined by the cassette case 96. In other words, the auxiliary cassette 88 is configured so that the auxiliary sheet medium 74, the feed roller 82, and the heat roller 89 are accommodated inside the cassette case 89.

The cassette case 96 is provided with a tape discharge port 93 and a tape charge port 94. The printed film tape 17 to which the auxiliary sheet medium 74 has been adhered is discharged from the tape discharge port 93. The printed film tape 17 is inserted into the auxiliary cassette 88 through the tape charge port 94.

The cutter unit 14 is thus located at the tape charge port 94 side of the auxiliary cassette 88. The second cutter unit 87 is located at the tape discharge port 93 side of the auxiliary cassette 88.

A conductor is formed in the shaft hole of the heat roller 89. This conductor comes into contact with the conductor of the heat roller shaft 90. As a result, current (voltage) supplied from a predetermined supply source provided in the tape printing apparatus 610 is transmitted to the heat roller 89. The front surface of the heat roller 89 is thus heated by the supplied current. As a result of heating the front face of the heat roller 89, the adhesive layer 24 of the film tape 17 that contacts the heat roller 89 starts exhibiting adhesive properties.

The configuration of the heat roller as described above is merely one example thereof. Specifically, any configuration may be employed as long as it is possible to generate an amount of heat sufficient to cause the adhesive layer 24 to exhibit adhesive properties at a front face of the heat roller.

The heat roller 89 is rotated by the rotational driving of the heat roller shaft 90. As a result, the printed film tape 17 can be conveyed.

According to the fourth embodiment, since the heat roller is not mounted on the tape printing apparatus, even in the event the heat roller fails, it is sufficient to replace the auxiliary cassette alone. Thus, the tape printing apparatus itself need not be replaced.

Figure 16:
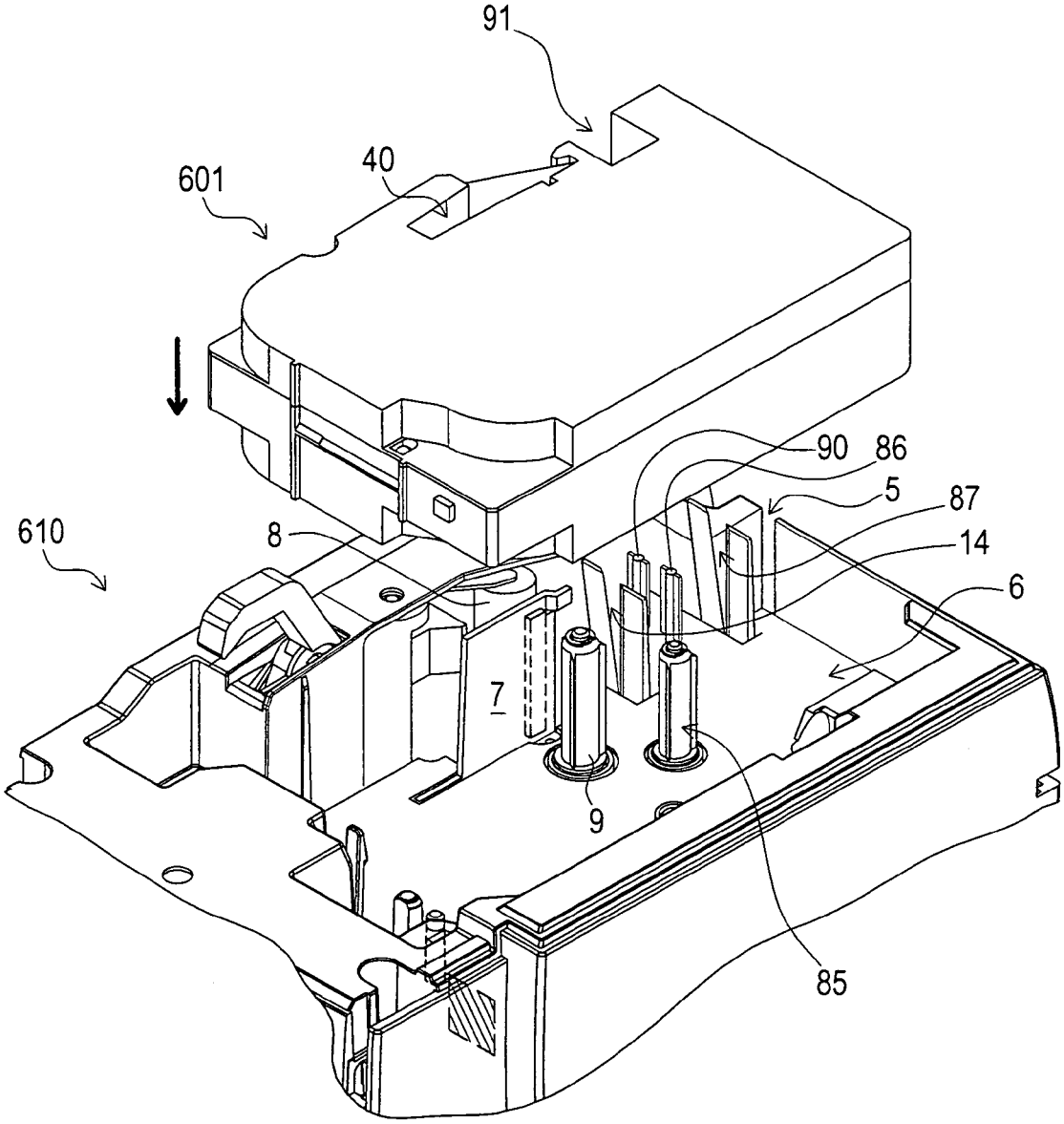
FIG. 16 is an enlarged perspective view of a relevant part showing mounting of a tape cassette in a cassette housing part of a tape printing apparatus according to the fourth embodiment.
Figure 17:
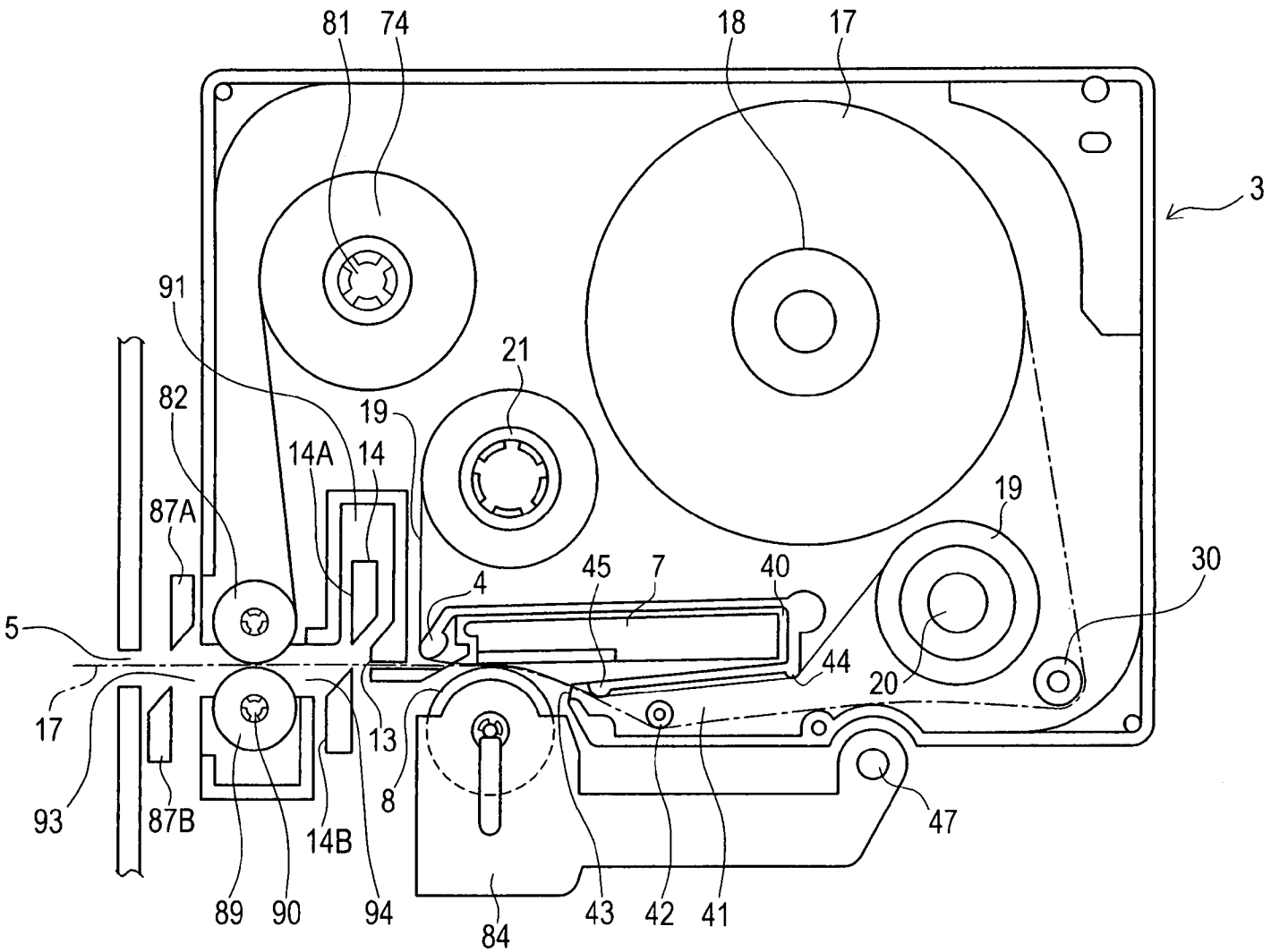
FIG. 17 is plan view showing a pattern of an internal configuration of the tape cassette according to the fourth embodiment.

In the fourth embodiment, the tape cassette 101 and the auxiliary cassette 88 are configured as individual units (namely, configured separately), but the tape cassette and the auxiliary cassette can also be integrally configured, as shown in FIG. 16 and FIG. 17. In this case, the tape cassette 601 is provided with the auxiliary sheet medium 74, the conveying roller 77, the heat roller 89, the film 17, the ribbon 19 and the like.

As shown in FIG. 16, the tape cassette 601 has a notch part 91. The tape cassette 601 has a notch part 91. If this notch part 91 is present between the tape conveying roller 82 and the tape discharge port 13. When the tape cassette 601 is mounted on the tape printing apparatus 610, the cutter 14A of the tape printing apparatus 610 is positioned in the notch part 91. When the printed film tape 17 is heated in the tape printing apparatus 610 which employs the tape cassette 601, the adhesive layer of the printed film tape 17 does not come into contact with the feed roller 82. As a result, the adhesive agent never adheres to the feed roller 82, which thus helps prevent any conveyance failures. Since the adhesive layer is protected by the auxiliary sheet medium 74, the film tape discharged from the discharge port 5 is easily stored. The auxiliary sheet medium 74 is peeled off when the film tape is adhered to the adhered. Since the adhesive layer 24 and the feed roller 82 do not come into contact with each other, the adhesive agent of the adhesive layer 24 is unlikely to adhere to the feed roller 82.

The outer shape of the tape printing apparatus, the tape cassette, and the auxiliary cassette as shown in the description of the fourth embodiment are given as merely one example, and the one or more aspects of the disclosure is not limited to this outer shape.

Fifth Embodiment

Next, a tape cassette and a tape printing apparatus according to a fifth embodiment will now be described based on FIG. 18 and FIG. 19.

A tape cassette and a tape printing apparatus according to the fifth embodiment have the same basic configuration as the tape cassette 1 and the tape printing apparatus 110 according to the first embodiment. Consequently, in the description to follow, elements which are the same as those in the tape cassette 101 and the tape printing apparatus 110 according to the first embodiment will be denoted by the same numerical symbol, the description will be focused on elements that differ from those in the tape cassette 101 and the tape printing apparatus 110 according to the first embodiment.

Figure 18:
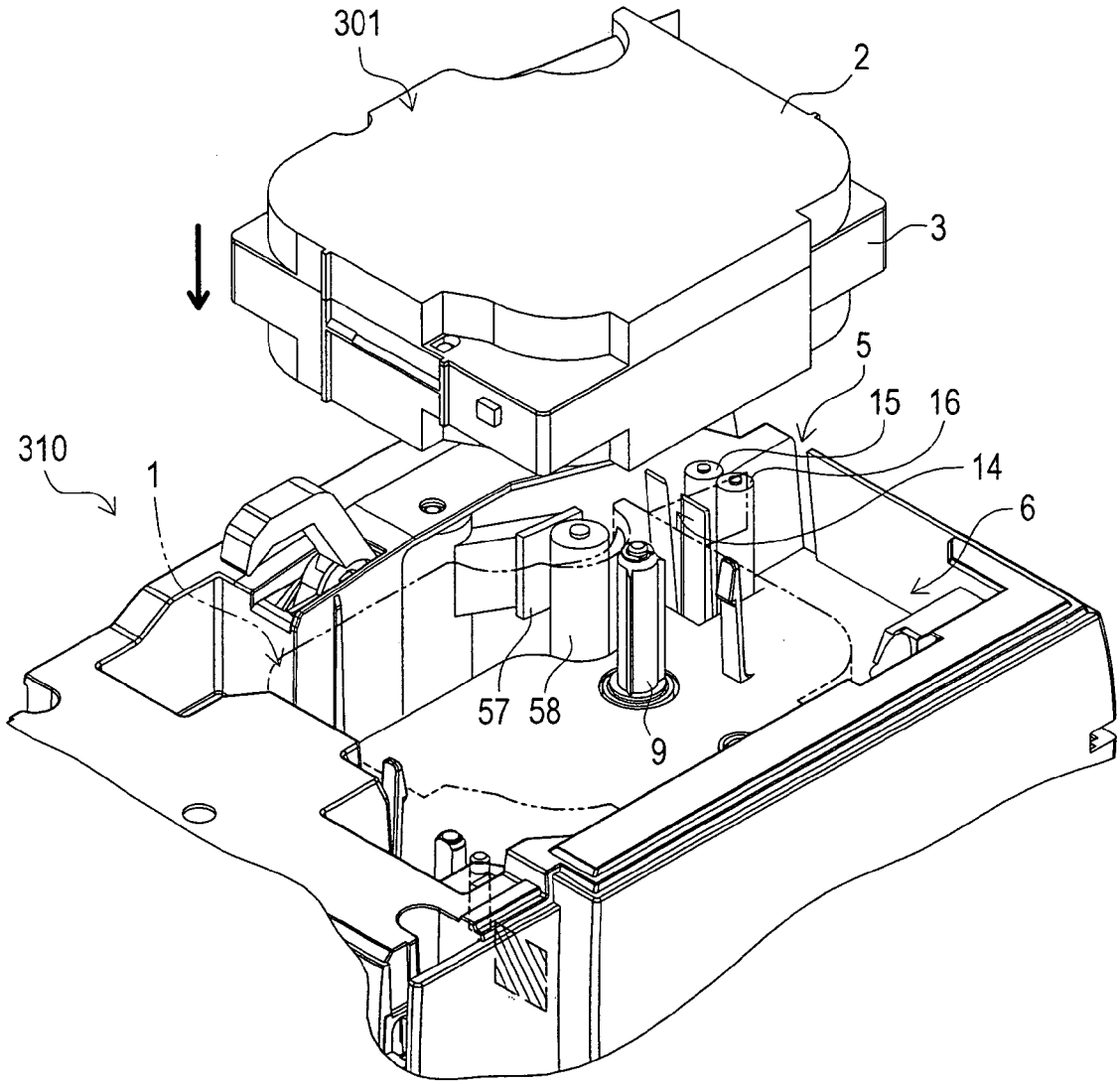
FIG. 18 is an enlarged perspective view of a relevant part showing mounting of a tape cassette in a cassette housing part of a tape printing apparatus according to a fifth embodiment.
Figure 19:
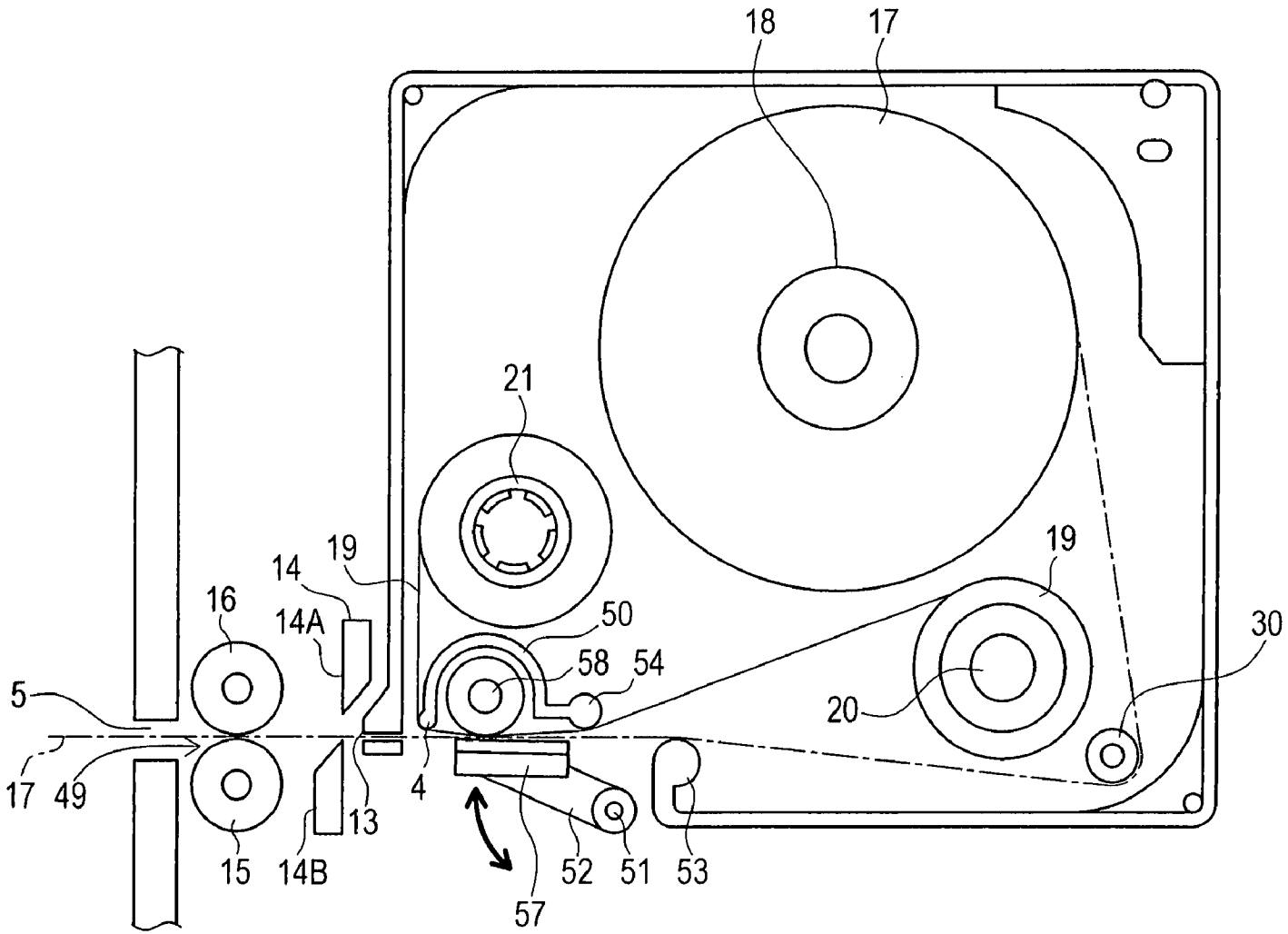
FIG. 19 is plan view showing a pattern of an internal configuration of the tape cassette according to the fifth embodiment.

In FIG. 18, a tape cassette 301 having an upper case 2 and a lower case 3 is detachably mounted on the cassette housing part 6 provided in a tape printing apparatus 301. The upper case 2 serves as a lid member that covers an upper surface of the lower case 3. The lower case 3 has a tape spool 18 onto which the film tape 17 is wound, arranged at a slightly upper position from its center, as shown in FIG. 18. The lower case 3 has a ribbon spool 20 onto which the ink ribbon 19 is wound, arranged at a slightly lower right position of the tape spool 18. The lower case 3 also has a ribbon reel-in spool 21 which draws the ink ribbon 19 from the ribbon spool 20 and reels in the ink ribbon 10 which was used in character printing.

The tape cassette 301 has a roller arranging part 50 formed so as to penetrate the upper case 2 and the lower case 3. Upon loading the tape cassette 301 in the cassette housing part 6, the platen roller 58 to be described later is arranged in the roller arranging part 50. The roller arranging part 50 has a separating member 4 formed downstream the thermal head 57 (center left side in FIG. 19). As will be described later, at the time of character printing by the thermal head 57, the separating member 4 has the role of reversing the feed direction of the ink ribbon 19 which is pressed onto the film tape 17 when clamped between the platen roller 58 and the thermal head 57 and separating the ink ribbon 19 from the film tape 17.

The tape cassette 301 has a discharge port 13 formed therein for discharging the film tape 17 onto which characters and the like have been printed to the exterior of the tape cassette 301 after the ink ribbon 19 has been separated therefrom by the separating member 4.

The configuration of the tape housing part 6 in the tape printing apparatus 310 will now be described. As shown in FIG. 18 and FIG. 19, the cassette housing part 6 of the tape printing apparatus 310 has a thermal head 57 mounted on the head supporting member 52 which is arranged so as to be able to rotate around the head supporting shaft 51. The thermal head 57 is tabular with a substantially rectangular shape in a longitudinal direction thereof when viewed from the front, and has a predetermined number of heat generating elements formed at a left margin of a front surface thereof and aligned along the left margin. The cassette housing part 6 has a platen roller 58 rotatably supported therein.

The head supporting member 52 is biased in a counter-clockwise direction around the head supporting shaft 51 by an elastic member which is not shown. At the time of printing onto the film tape 17, the head supporting member 52 is driven in a clockwise direction by a motor or the like, thereby enabling the thermal head 57 to come into contact and move away with respect to the platen roller 58.

The cassette housing part 6 has a ribbon reel-in shaft 9 that is coupled to the ribbon reel-in spool 21 of the tape cassette 301. The ribbon reel-in shaft 9 is coupled to a driving mechanism such as a motor and the like which is not shown and is adapted to drive and rotate the ribbon reel-in spool for taking up ink ribbon 19 which has been separated from the film tape 17 by the separating member 4, as described above.

The cassette housing part 6 has a clipper-type cutter unit 14 arranged adjacent the tape discharge port 13 of the tape cassette 301. The cutter unit 14 is composed of a fixed blade 14A and a movable blade 14B which is actuated with respect to the fixed blade 14A to cut the post-printing film tape 17.

A pair of conveying rollers 49 are arranged downstream the cutter unit 14. The conveying rollers 49 are composed of a heat roller 15 that heats the adhesive layer (to be described later) formed in the film tape 17 and a tape conveying roller 16 arranged opposite the heat roller 15 and adapted to feed the post-printing film tape 17 to the exterior of the tape printing apparatus 310 through the cooperation with the heat roller 15.

When the tape cassette 301 having the above-described configuration is loaded in the cassette housing part 6 of the printing apparatus 310 for character printing onto the film tape 17, the film tape 17 wound onto the tape spool 18 is guided over the tape guiding skid 30 provided at a corner of the lower case 3 and a guiding supporting part 53 formed in an inner wall of the lower case 3 towards the thermal head 57 and the platen roller 58. Also, the ink ribbon is guided toward the thermal head 57 and the platen roller 58 while being guided and supported by the guiding supporting part 54 formed at an end part of the roller arranging part 50.

The film tape 17 and the ink ribbon 19 guided as described above are superimposed between the thermal head 57 and the platen roller 58. Each of the heat generating elements of the thermal head 57 is driven to generate heat, with the film tape 17 being superimposed on the ink ribbon 19. As a result, characters and the like are printed onto the film tape 17 through the ink ribbon 19. Thereafter, the ink ribbon 19 is fed downstream the thermal head 57, and after being separated from the film tape 17 through the separating member 4, it is reeled in by the ribbon reel-in spool 21.

After characters and the like are printed onto the film tape through the ink ribbon 19 and the thermal head 57, and the ink ribbon 19 is separated therefrom through the separating member 4, the film tape 17 is discharged to the exterior of the tape cassette 301 from the tape discharging port 13 and is further discharged to the exterior of the tape printing apparatus 310 through the pair of conveying rollers 49. At this time, the adhesive layer of the film tape 17 is heated by the heat roller 15 of the pair of conveying rollers 49, thereby making the adhesive layer exhibit adhesive properties as will be described later.

Then, when the film tape 17 has reached a predetermined length, the cutter unit 14 is driven to cut the film tape 17 at a predetermined length through the cooperation of the fixed blade 14A and the movable blade 14B.

Figure 20:
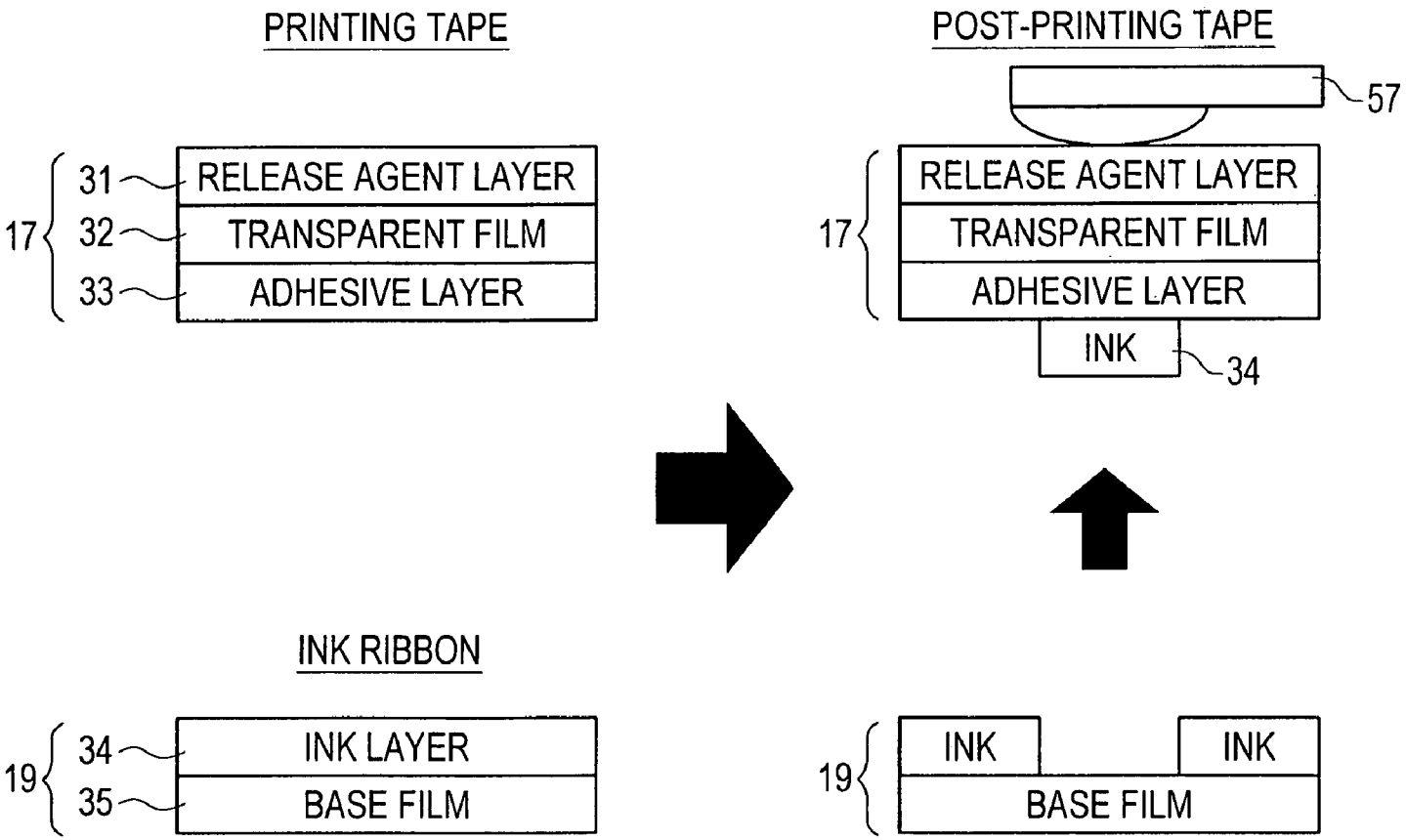
FIG. 20 is an explanatory diagram showing a pattern of the relationship between the ink ribbon and the film tape in a character printing process according to the fifth embodiment.

The configuration of the ink ribbon and the printing tape according to the fifth embodiment will now be described based on FIG. 20. As shown in FIG. 20, the ink ribbon 19 is composed of a base film 35 and an ink layer 34. The film tape 17 serving as a printing tape has an adhesive layer 33 formed on one surface (in FIG. 20, lower side of the transparent film) of the transparent film tape 32, and a release adhesive layer 31 formed on the other surface (upper side of the transparent film in FIG. 20) of the transparent film.

The above-described adhesive layer 33 is composed of a material having special properties in that it does not exhibit adhesive properties at ambient temperature, but starts exhibiting adhesive properties upon being heated, and maintains these adhesive properties after it has been heated once, even if its temperature decreases. Similarly with the first embodiment, the adhesive agent 24 may include an adhesive agent employed for heat seal labels, as described in U.S. Pat. No. 5,614,928, for instance. This type of adhesive agent melts upon being heated to 80° C. to 100° C. by the heat roller and the like, thereby exhibiting adhesive properties. In the fifth embodiment, the heat roller heats the adhesive agent up to 80° C. or above but below 90° C., similarly with the first embodiment.

The above-described film tape 17, having the adhesive layer 33 superimposed on a single surface thereof, is wound in the tape spool 18 with the adhesive layer 33 at the inner side, for loading. Since the film tape 17 has a release agent layer 31 formed on a back surface side of the adhesive layer 33 of the transparent film tape 32, the adhesive layer 33 never adheres to the transparent film 17, to an inner side of the tape cassette and to other parts in the printing apparatus, even in the case a part of the adhesive layer should exhibit adhesive properties when it is already wound onto the tape spool 18.

As described above, when the adhesive layer 33 of the film tape 17 and the ink layer 34 of the ink ribbon 19 come into contact, the contact location where the adhesive layer 33 and the ink layer 34 come into contact with each other is clamped between the thermal head 57 and the platen roller 58 and, as shown in FIG. 11, the thermal head 57 comes into contact with the release adhesive layer 31 side of the base film 32. As a result, the adhesive layer 33 exhibits adhesive properties upon being heated by the thermal head 57 and the ink layer 34 of the ink ribbon 19 melts upon being heated by the thermal head 57. The melted ink layer 34 is adhered to the adhesive layer, whereby characters and the like are transferred to the film tape 17.

As described above, when the adhesive layer 33 of the film tape 17 and the ink layer 34 of the ink ribbon 19 come into contact, the contact location where the adhesive layer 33 and the ink layer 34 come into contact with each other is clamped between the thermal head 57 and the platen roller 58 and, as shown in FIG. 11, the thermal head 57 comes into contact with the release adhesive layer 31 side of the base film 32. As a result, the adhesive layer 33 exhibits adhesive properties upon being heated by the thermal head 57 and the ink layer 34 of the ink ribbon 19 melts upon being heated by the thermal head 57. The melted ink layer 34 is adhered to the adhesive layer, whereby characters and the like are transferred to the film tape 17.

The tape printing apparatus 310 is provided with a drive control apparatus (not shown) for driving and controlling the heat generating parts of the thermal head 57. Thus, since control is carried out so that the transferred ink layer 34 is printed as mirror image with respect to the film tape 17, characters and the like printed as a normal image can be visually checked when looking from the side of the transparent film tape 32 of the film tape 17.

Figure 21:
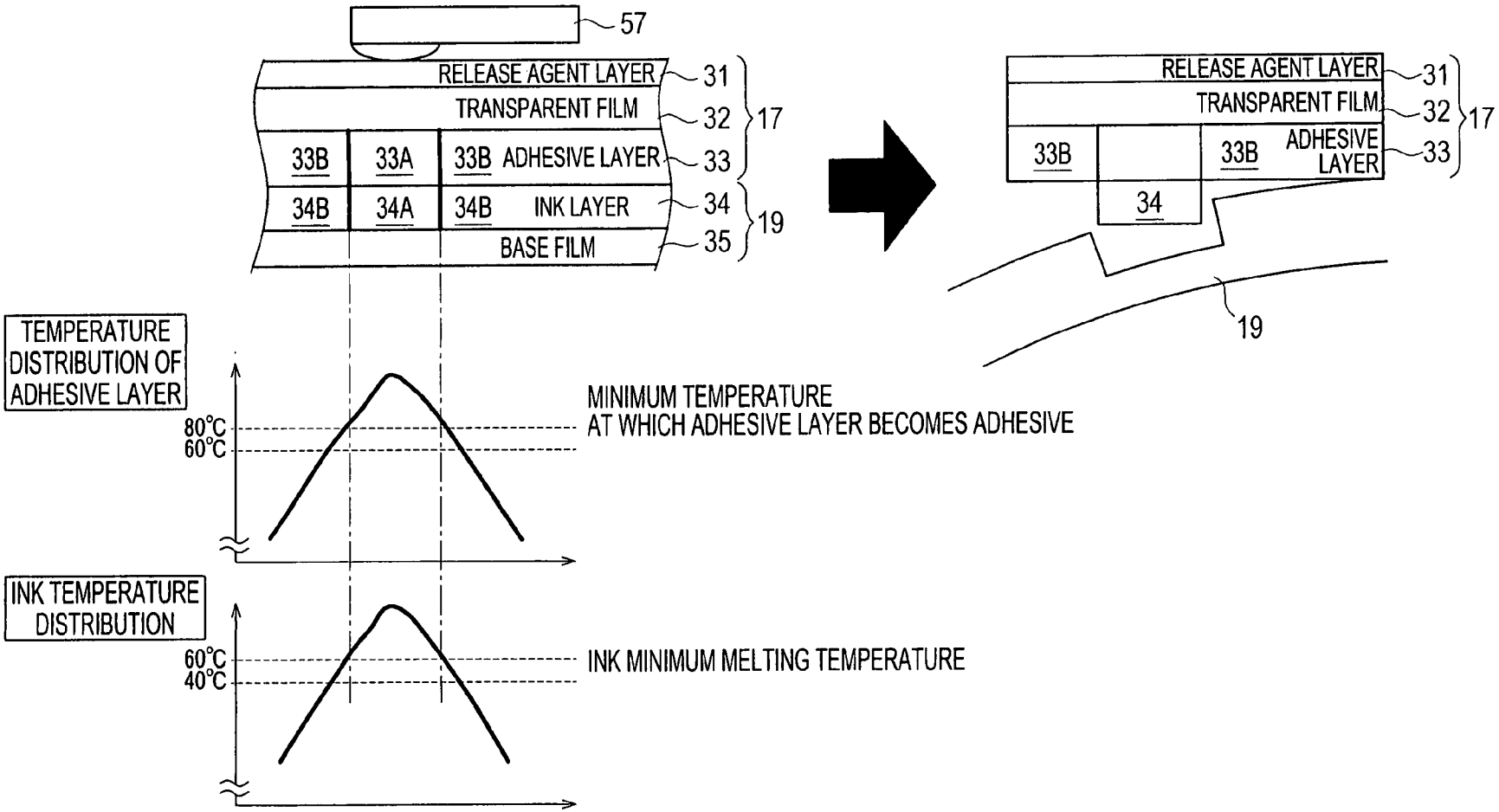
FIG. 21 an explanatory diagram showing a pattern of a transferring mechanism in which the ink layer is transferred to the adhesive layer upon being heated by the thermal head according to the fifth embodiment.

A transfer mechanism in which an ink layer is transferred to an adhesive layer upon being heated by the thermal head 57 will now be described based on FIG. 21. As shown in FIG. 21, when the film tape 17 and the ink ribbon 19 are superimposed at a printing position, between the thermal head 57 and the platen roller 58, the adhesive layer 33 of the film tape 17 is brought in contact with the ink layer 34 of the ink ribbon 19. Although the adhesive layer 33 and the ink layer 34 are simultaneously heated at the above described contact part by the thermal head 57, heat transfer losses occur at the boundary portion when heat is transferred from the adhesive layer 33 to the ink layer 34, which leads to differences in temperature at the boundary part of the ink layer 34 and the adhesive layer 33. Since the adhesive layer 33 of the film tape 17 to be used in the tape cassette 301 according to the third embodiment employs an adhesive agent that exhibits adhesive properties when heated to 80° C. or above, and the ink layer 34 of the ink ribbon 19 employs a high melting point-type ink which melts at a temperature of 60° C. or above, when the temperature at a heated portion of the adhesive layer 33A becomes 80° C. or above, the temperature at a heated portion of the ink layer 34A as well, becomes 60° C. or above. As a result, the adhesive layer 33A and the ink layer 34A are adhered at their heated portions, respectively.

Since the temperature of the adhesive layer 24B when it is not heated by the thermal head 57 is below 80° C. and thus exhibits no adhesive properties, and the temperature of the ink layer 34B at a portion corresponding to the adhesive layer 33B, as well, is below 90° C., after these layers pass the thermal head 57 and the separating part 4 arranged downstream the thermal head 57, they are heated and only the ink layer 34A which has been adhered to the adhesive layer 33A is transferred to the film tape 17, as shown in FIG. 21. The remaining portions of the ink ribbon are reeled in by the ribbon reel-in spool 21, as consumed ink ribbon 19.

As shown in FIG. 21, the thermal head 57 has a heat concentrated-type glaze structure. The ink layer 34 and the adhesive layer 33 are heated by focusing the heat into a pin-point. Accordingly, since the temperature difference between the heated portions of the ink layer 34A and the adhesive layer 33A and the unheated portions of the ink layer 34B and the adhesive layer 33B becomes large, the ink layer and the adhesive layer can be adhered, with the boundary between the heated portions 34A and the unheated portions 34B of the ink layer and the heated portion 33A and the unheated portion 33B of the adhesive layer clearly defined.

The ink layer 34 includes a wax-type ink so that only the heated portions of the ink later 34 are transferred, even if they cool down after being heated. Accordingly, the heated ink layer 34 can be reliably adhered to the adhesive agent 33A at the heated portion even if the ink layer 34 cools down, thereby being reliably transferred to a film tape 17 onto which characters and the like are printed.

The film tape 17 onto which characters and the like are printed is drawn up to a clipper-type cutter unit 14 serving as a cutting device, through the cooperation of the tape conveying roller 16 and the heat roller 15 as described above. The post-printing film tape 17 can be cut to a predetermined length through the cooperation of the fixed blade 14A and the movable 14B of the cutter unit 14. The cut film tape 17 is passed between the tape conveying roller 16 and the heat roller 15 where it is heated by the heat roller to exhibit adhesive properties in the adhesive layer 33B at portions other than portions where the ink layer 34 is adhered. Thereafter, the post-printing film tape 17 which exhibits adhesive properties is discharged to the exterior of the tape printing apparatus, as a linerless tape as was cut.

As described above, since the tape cassette 301 does not house the adhesive tape spool and the pasting roller and the tape conveying roller 16 and the heat roller 15 are arranged downstream of the cutter unit 14, the post-printing film tape 17 can be cut by the cutter unit 14 arranged immediately downstream of the thermal head 57 immediately after characters and the like have been printed thereon. This makes it possible to shorten the front blank spaces of the post-printing film tape 17, thereby reducing the running cost of the film tape 17.

Further, when the heat roller 15 heats the target layers to 80° C. or above but below 90° C., the temperature inside the ink layer becomes 60° C. or above, but because the ink used in the ink layer 34 is a low melting point-type ink (the melting point of the ink becomes 60° C. or above), the ink is once fused in the adhesive agent having high viscosity at the time of character printing. As a result, melting of the ink under the heat from the heat roller 15 becomes difficult, thereby eliminating the risk of faulty printing caused by ink re-melting when being heated by the heat roller 15. Here, the release adhesive layer is also transparent. Needless to say, the adhesive layer present between the film layer and the ink layer is necessarily transparent or semi-transparent, to thus make the ink layer visible through the transparent film.

Since the heat roller contacts the film tape 17 onto which characters and the like have been printed from the release agent layer 31 side thereof (back surface side of the adhesive layer 33), it is possible to avoid direct contact with the adhesive layer 33, thereby preventing the heated adhesive layer 33 from adhering to the heat roller 15.

Since the heated adhesive layer 33 maintains its adhesive properties even after its temperature decreases, the user can paste the linerless tape produced as described above onto the target body. As a result, the user no longer needs to remove the release sheet, as was done in the case of using the conventional laminated tape. Further, since the transferred ink layer 34 is printed as mirror image with respect to the film tape 17, as described above, the user can recognize the characters and the like printed as normal image, through the transparent film.

The outer shape of the tape printing apparatus 310 and the tape cassette 301 as shown in the description of the fifth embodiment is given as merely one example, and one or more aspects of the disclosure is not limited to this outer shape.

Sixth Embodiment

The tape cassette and the tape printing apparatus according to the sixth embodiment will now be described based on FIG. 22 and FIG. 23.

The configuration of the tape cassette according to the sixth embodiment is the same as the configuration of the tape cassette 301 according to the fifth embodiment. Also, the configuration of the tape printing apparatus according to the sixth embodiment is substantially the same as the configuration of the tape printing apparatus 310 according to the fifth embodiment. In the following description, elements which are the same as those of the tape cassette 301 and the tape printing apparatus 310 according to the fifth embodiment are denoted by the same numerical symbols.

The tape printing apparatus 310 according to the fifth embodiment has a tape conveying roller 16 arranged in the tape printing apparatus 310, but in the sixth embodiment, the conveying roller 77 having the same function as the tape conveying roller 16 according to the third embodiment is arranged in the auxiliary cassette 70. The tape printing apparatus 410 does not have a tape conveying roller arranged therein. In the sixth embodiment, the tape printing apparatus 410 has a conveying roller shaft 72 for coupling with the conveying roller 77 and an auxiliary sheet medium reel-in shaft 73 for coupling to the auxiliary sheet medium reel-in spool 76 arranged therein.

Figure 22:
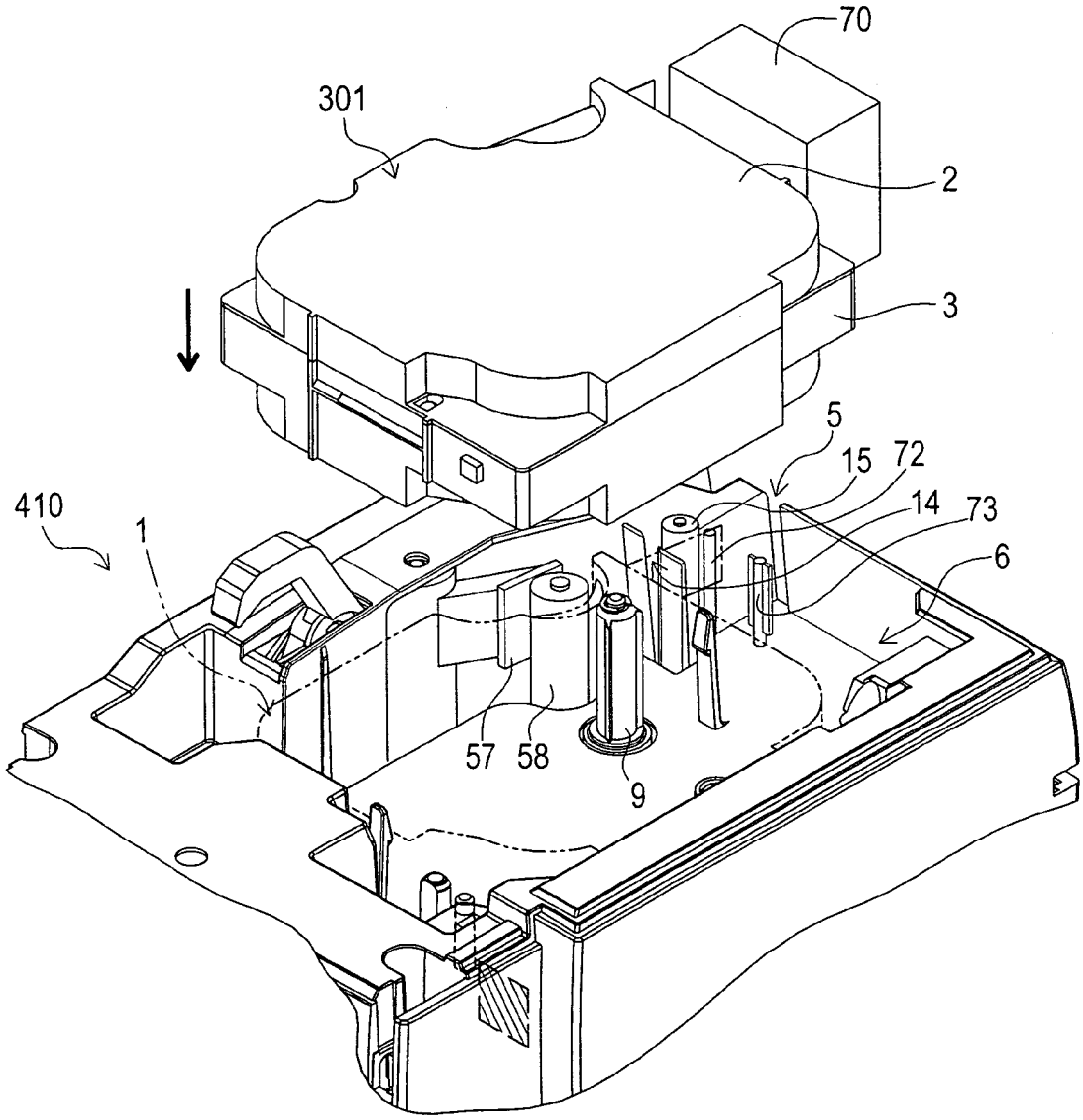
FIG. 22 is an enlarged perspective view of a relevant part showing mounting of a tape cassette in a cassette housing part of a tape printing apparatus according to a sixth embodiment.

In FIG. 22, the auxiliary cassette 70 is detachably loaded in the cassette housing part 6 provided in the tape printing apparatus 410. Since the tape cassette 301 of the sixth embodiment has the same configuration as the tape cassette 301 of the fifth embodiment, further description thereof is hereby omitted.

Figure 23:
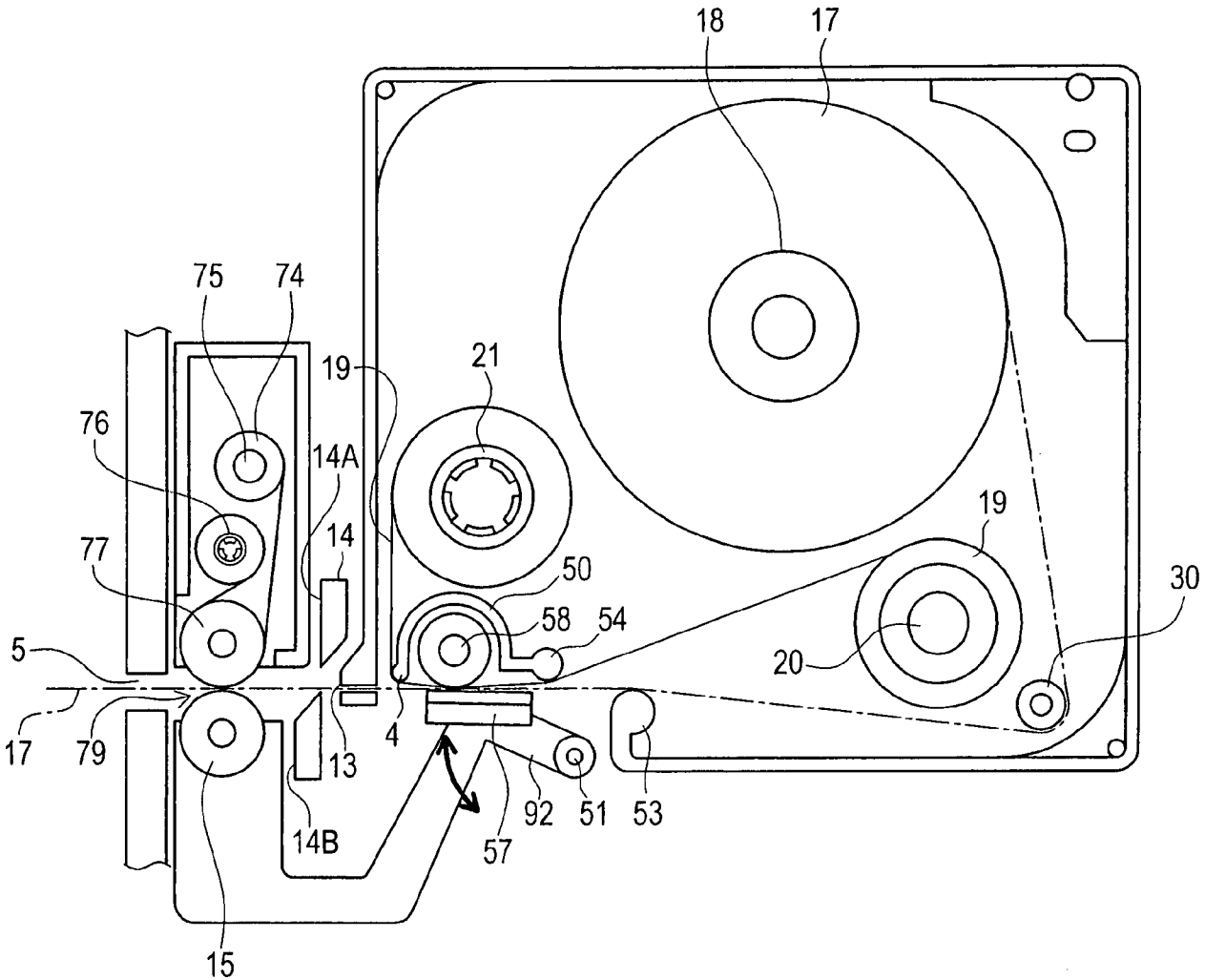
FIG. 23 is plan view showing a pattern of an internal configuration of the tape cassette according to the sixth embodiment.
Figure 25:
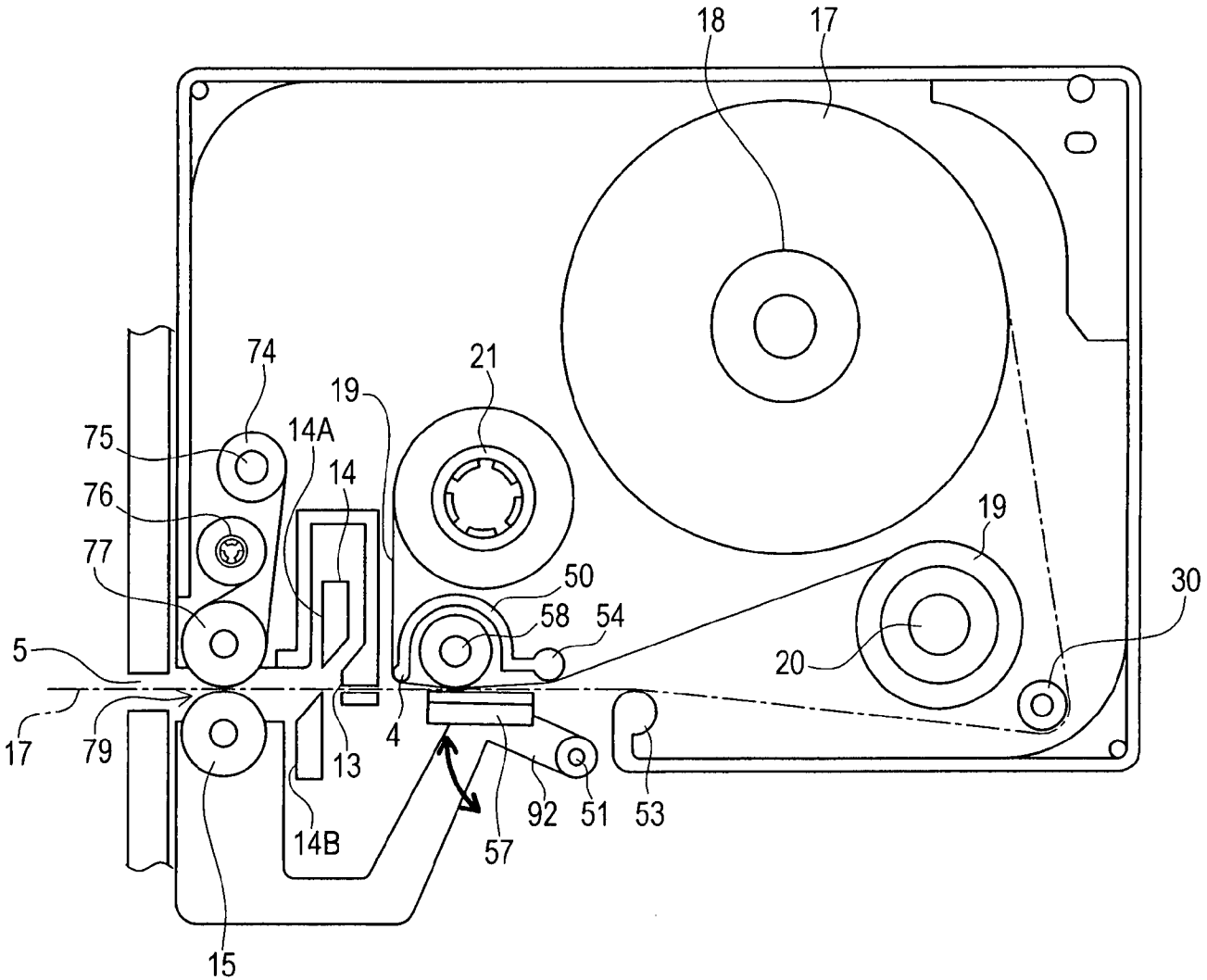
FIG. 25 is plan view showing a pattern of an internal configuration of the tape cassette according to the sixth embodiment.

As shown in FIG. 23, the auxiliary cassette 70 is detachably loaded in the cassette housing part 6 provided in the tape printing apparatus 410. The auxiliary cassette 70 is provided with an auxiliary sheet medium spool 75 onto which an auxiliary sheet medium 74 is wound, as shown in FIG. 25. The auxiliary cassette 70 is also provided with an auxiliary sheet medium reel-in spool 76 that draws and reels in the auxiliary sheet medium 74 from the auxiliary sheet medium spool 75. Further, the conveying roller 77 is rotatably provided in the auxiliary cassette 70, with a portion thereof being exposed from the auxiliary cassette 70. At the time of printing, the conveying roller 77 faces the heat roller 15 of the tape printing apparatus 410. A portion of the feed roller 77 is exposed from the auxiliary cassette 71. At the time of printing, the feed roller 77 faces the heat roller 15 provided in the tape printing apparatus 410.

At the time of printing, the auxiliary sheet medium 74 is fed to the conveying roller 77, which further feeds it in a downstream direction together with the film tape 17. The auxiliary sheet medium 74 and the film tape 17 are then fed to an auxiliary sheet medium reel-in spool 76. In other words, since the film tape 17 and the auxiliary sheet medium 74 come into contact at the time of printing, the conveying roller 77 does not touch the film tape 17. The position at which the film tape 17 and the auxiliary sheet medium 74 come into contact is the position at which the heat roller 15 and the conveying roller 77 face each other, as shown in FIG. 23.

The configuration of the tape housing part 6 in the tape printing apparatus 410 will now be described. As shown in FIG. 22 and FIG. 23, the cassette housing part 6 of the tape printing apparatus 410 has a thermal head 57 mounted on the head supporting member 92 which is arranged so as to be able to rotate around the head supporting shaft 51. The thermal head 57 is tabular with a substantially rectangular shape in a longitudinal direction thereof when viewed from the front as shown in FIG. 23, and has a predetermined number of heat generating elements formed at a left margin of a front surface thereof and aligned along the left margin. The cassette housing part 6 has a platen roller 58 rotatably supported therein. The head supporting member 92 is biased in a counterclockwise direction around the head supporting shaft 51 by an elastic member which is not shown. At the time of printing onto the film tape 17, the head supporting member 92 is driven in a clockwise direction by a motor or the like, thereby enabling the heat roller to come into contact and move away with respect to the conveying roller 77.

The cassette housing part 6 has the auxiliary sheet medium reel-in shaft 73 that is coupled to the auxiliary sheet medium reel-in spool 76 of the auxiliary cassette 70. The auxiliary sheet medium reel-in shaft 73 is coupled to a driving mechanism such as a motor or the like, not shown, and serves to drive and rotate the auxiliary sheet medium reel-in spool 76. The cassette housing part 6 is also provided with a conveying roller shaft 72. The conveying roller shaft 72 is coupled to a driving mechanism such as a motor and the like, not shown, and serves to drive and rotate the conveying roller 77.

The heat roller 15 is arranged downstream the cutter unit 14 for heating the adhesive layer formed in the film tape 17. The post-printing film tape 17 is discharged to the exterior of the tape printing apparatus 410 through the cooperation of the heat roller 15 and the tape conveying roller 77. For convenience of the description to follow, the pair including the heat roller 15 and the tape conveying roller 77 may be denoted as the pair of conveying rollers 79. The auxiliary sheet medium reel-in spool 76 as well is driven to rotate and thus convey the auxiliary sheet medium, together with the post-printing film tape 17 through the cooperation of the heat roller 15 and the tape conveying roller 77.

After characters and the like are printed onto the film tape through the ink ribbon 19 and the thermal head 57, and the ink ribbon 19 is separated therefrom through the separating member 4, the film tape 17 is discharged to the exterior of the tape cassette 301 from the tape discharging port 13 and is further discharged to the exterior of the tape printing apparatus 410 through the pair of conveying rollers 79. At this time, the adhesive layer of the film tape 17 is heated by the heat roller 15 of the pair of conveying rollers 79, thereby making the adhesive layer exhibit adhesive properties.

Since the ink ribbon and the printing tape according to the sixth embodiment have the same configuration as that described in the fifth embodiment (refer to FIG. 19), further description thereof is hereby omitted. Also, since the transfer mechanism in which the ink layer is transferred to the adhesive layer upon being heated by the thermal head 57, according to the sixth embodiment is the same as the mechanism in the fifth embodiment (refer to FIG. 20 and FIG. 21), further description thereof is hereby omitted.

The film tape 17 onto which characters and the like are printed is drawn up to the clipper-type cutter unit 14 serving as a cutting device, through the cooperation of the tape conveying roller 77 and the heat roller 15, as described above. The post-printing film tape 17 can thus be cut to a predetermined length through the cooperation of the fixed blade 14A and the movable blade 14B of the cutter unit 14. The cut film tape 17 passes between the tape conveying roller 77 and the heat roller 15 and upon being heated, starts exhibiting adhesive properties in the adhesive layer 33 at portions other than portions where the ink layer 34 has been adhered. The post-printing film tape 17 exhibiting adhesive properties is then discharged to the exterior of the printing apparatus as a linerless tape as was cut.

As described above, the adhesive agent of the post-printing film tape 17 exhibits adhesive properties upon being heated by the heat roller 15. Here, if the adhesive force of the post-printing film tape 17 is strong, there is a risk that the adhesive agent will be transferred to the surface coming in contact with the adhesive layer. In the sixth embodiment, the auxiliary sheet medium 74 and the adhesive surface of the post-printing film tape 17 are configured so as to come into contact. New portions of auxiliary sheet medium 74 that come into contact with the adhesive surface are continuously fed to the pair of conveying rollers 79 by the auxiliary sheet medium reel-in spool 76. In this way, the adhesive agent of the post-printing film tape 17 never adheres to the tape conveying roller 77. Even if the adhesive agent of the post-printing film tape 17 adheres to the auxiliary sheet medium 74, since the auxiliary sheet medium 74 is fed to the auxiliary sheet medium reel-in spool 76, the auxiliary sheet medium 74 to which the adhesive agent has adhered never adheres to the post-printing film tape 17 that is to be subsequently fed.

As described in the above, since the tape cassette 301 does not accommodate the adhesive tape spool and the pasting roller and the tape conveying roller 77 and the heat roller 15 are arranged downstream of the cutter unit 14, the post-printing film tape 17 can be cut by the cutter unit 14 arranged immediately downstream of the thermal head 57 immediately after characters and the like have been printed onto the film tape 17. This makes it possible to shorten front blank spaces of the post-printing film tape 17, thereby reducing the running cost of the film tape 17.

Further, when the heat roller 15 heats the target layer to 80° C. or above but below 90° C., the temperature inside the ink layer becomes 60° C. or above, but because the ink used in the ink layer 34 is a low melting point-type ink (the melting point of the ink becomes 60° C. or above), the ink is once fused in the adhesive agent having high viscosity at the time of character printing. As a result, melting of the ink under the heat from the heat roller 15 becomes difficult, thereby eliminating the risk of faulty printing caused by ink re-melting when being heated by the heat roller 15. Here, the release adhesive layer is also transparent. Needless to say, the adhesive layer present between the film layer and the ink layer is necessarily transparent or semi-transparent, to thus make the ink layer visible through the transparent film.

Since the heat roller comes into contact with the film tape 17 onto which characters and the like are printed from the release agent layer 31 side (back surface side of the adhesive layer 33), direct contact with the adhesive layer 33 can be avoided. As a result, the heated adhesive layer 33 does not adhere to the heat roller 15.

Since the heated adhesive layer 33 maintains its adhesive properties even after its temperature decreases, the user can paste the linerless tape produced as described above onto the target body. As a result, the user no longer needs to remove the release sheet, as was done in the case of using the conventional laminated tape. Further, since the transferred ink layer 34 is printed as mirror image with respect to the film tape 17, as described above, the user can recognize the characters and the like printed as normal image, through the transparent film.

In the sixth embodiment, since the adhesive layer of the post-printing film 17 does not touch the conveying roller 77 when the post-printing film 17 is heated, there is no risk of the adhesive agent adhering to the conveying roller 77. This can prevent faulty conveyance from occurring and can also prevent the adhered adhesive agent from smearing the printing tape 17.

The auxiliary sheet medium can employ a medium having a release adhesive layer coated on a surface thereof contacting the post-printing film 17. As a result, the auxiliary sheet medium 74 and the heated post-printing film 17 can be smoothly released, thereby enabling excellent tape conveyance.

Figure 24:
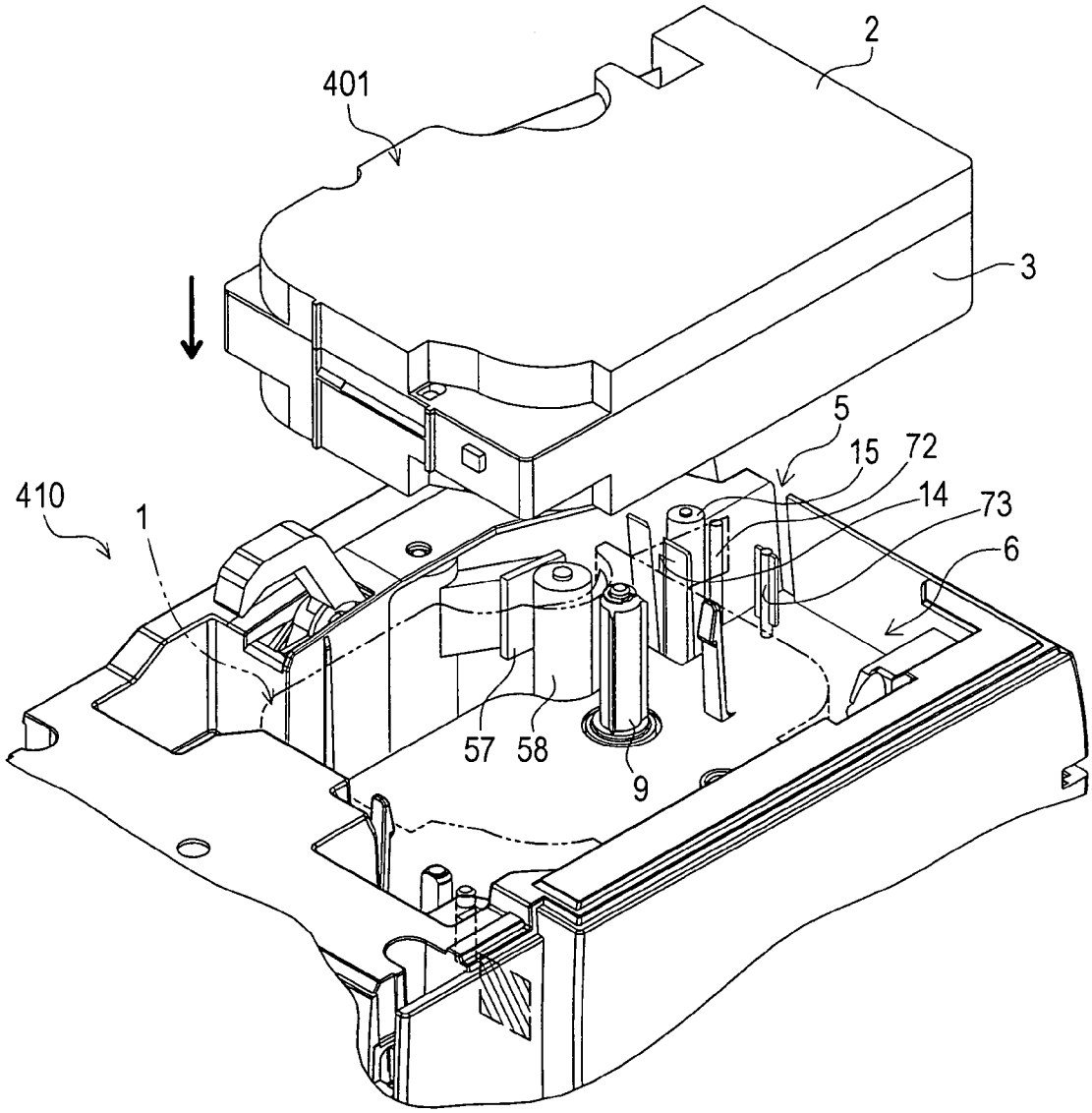
FIG. 24 is an enlarged perspective view of a relevant part showing mounting of a tape cassette in a cassette housing part of a tape printing apparatus according to the sixth embodiment.

In the sixth embodiment, the tape cassette 301 and the auxiliary cassette 70 are configured as individual units (namely, configured separately), but the tape cassette and the auxiliary cassette can also be integrally configured, as shown in FIG. 24. In this case, the tape cassette 401 is provided with the auxiliary sheet medium 74, the auxiliary sheet medium reel-in spool 76, the conveying roller 77, the film tape 17, the ribbon 19 and the like, as shown in FIG. 25. The tape cassette 401 has a notch part, as shown in FIG. 25. If this notch part is present between the conveying roller 77 and the tape discharge port 13. When the tape cassette 401 is mounted on the tape printing apparatus 410, the cutter 14A of the tape printing apparatus 410 is positioned in this notch part. In the tape printing apparatus 410 using the tape cassette 401, as well, since the adhesive layer of the post-printing film tape 17 does not come into contact with the conveying roller 77 when the post-printing film tape 17 is heated, the adhesive agent does not adhere to the conveying roller 77, thereby making it possible to prevent faulty conveyance from occurring. Thus, even if the adhesive agent adheres to the auxiliary sheet medium 74, it is possible to prevent the adhesive agent that adhered to the auxiliary sheet medium from smearing the post-printing film tape 17 that is subsequently fed.

The outer shape of the tape printing apparatus 410, the tape cassette 301, the tape cassette 401, and the auxiliary cassette 70 as shown in the description of the sixth embodiment is given as merely one example, and the present disclosure is not limited to this outer shape.

Other Embodiments

The tape printing apparatus and the like shown in the fifth embodiment and sixth embodiment as described above can employ the respective elements of the tape printing apparatus and the like shown in the third embodiment and fourth embodiment as described above.

Figure 26:
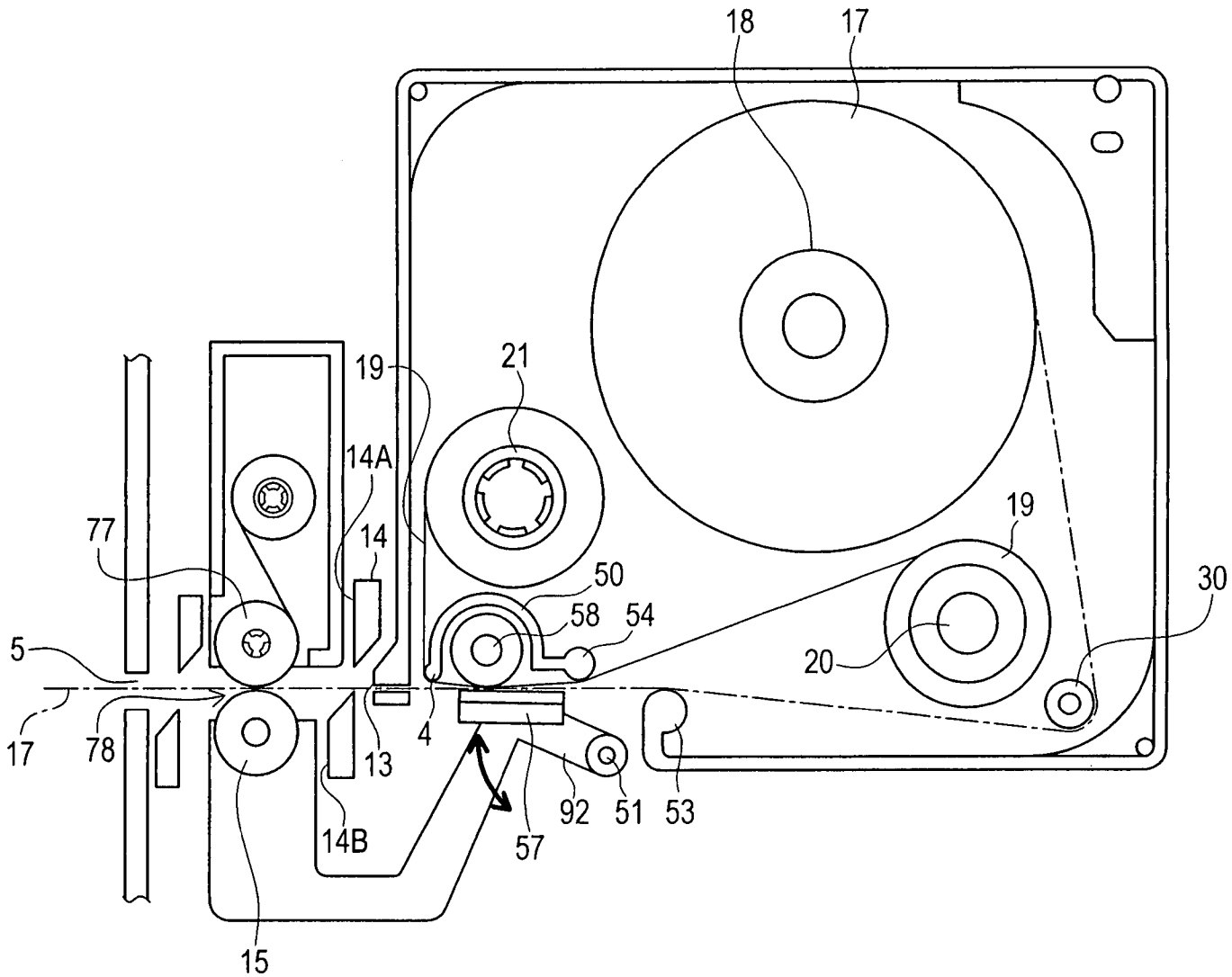
FIG. 26 is plan view showing a pattern of an internal configuration of the tape cassette according to another embodiment.

For instance, as shown in FIG. 26, the tape printing apparatus may be configured so as to accommodate the auxiliary cassette 71.

Figure 27:
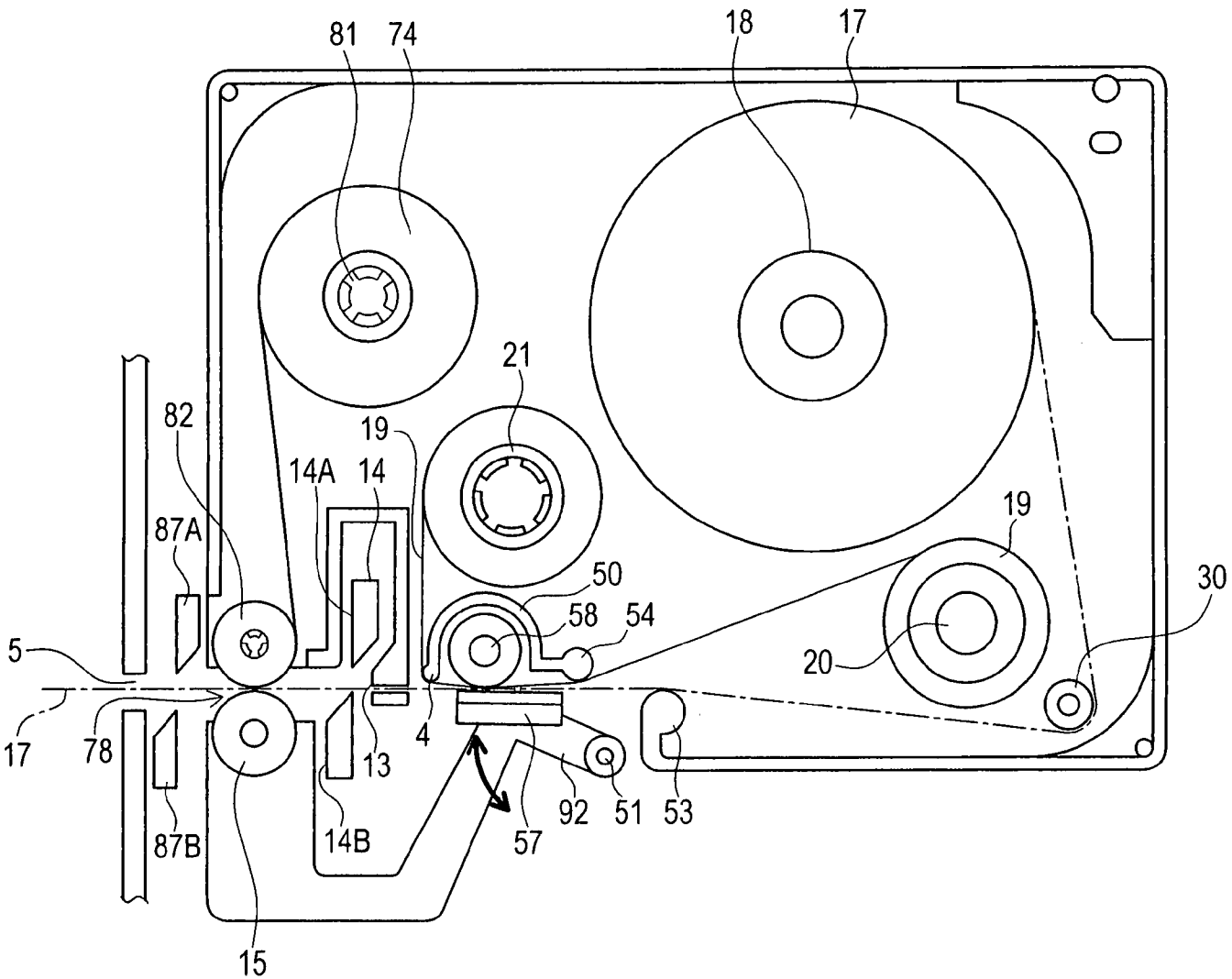
FIG. 27 is plan view showing a pattern of an internal configuration of the tape cassette according to another embodiment.

Also, as shown in FIG. 27, the tape printing apparatus may be configured so as to accommodate the auxiliary sheet medium 74 in the tape cassette.

Figure 28:
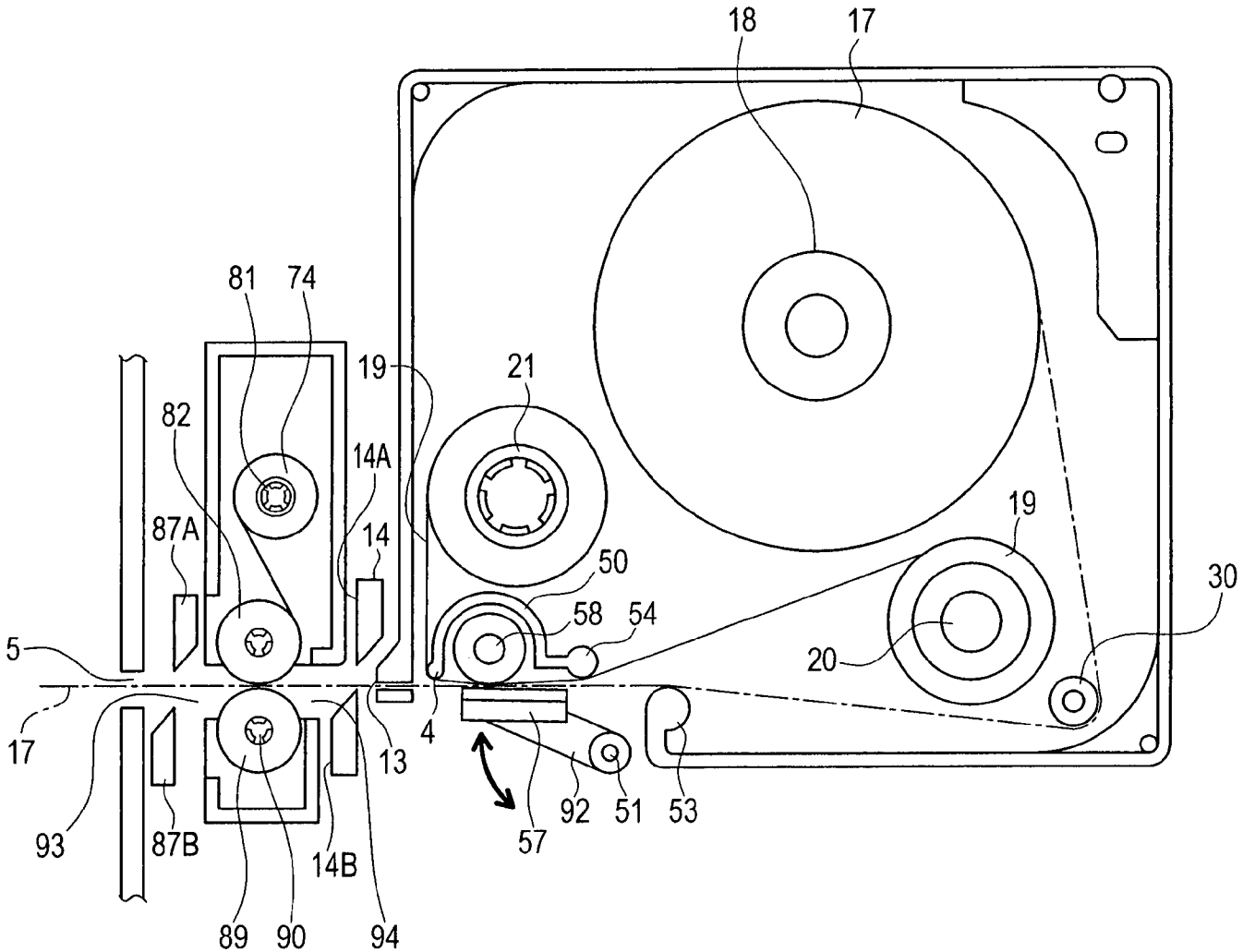
FIG. 28 is plan view showing a pattern of an internal configuration of the tape cassette according to another embodiment.

Also, as shown in FIG. 28, the tape printing apparatus may be configured so as to accommodate the auxiliary cassette 88.

Figure 29:
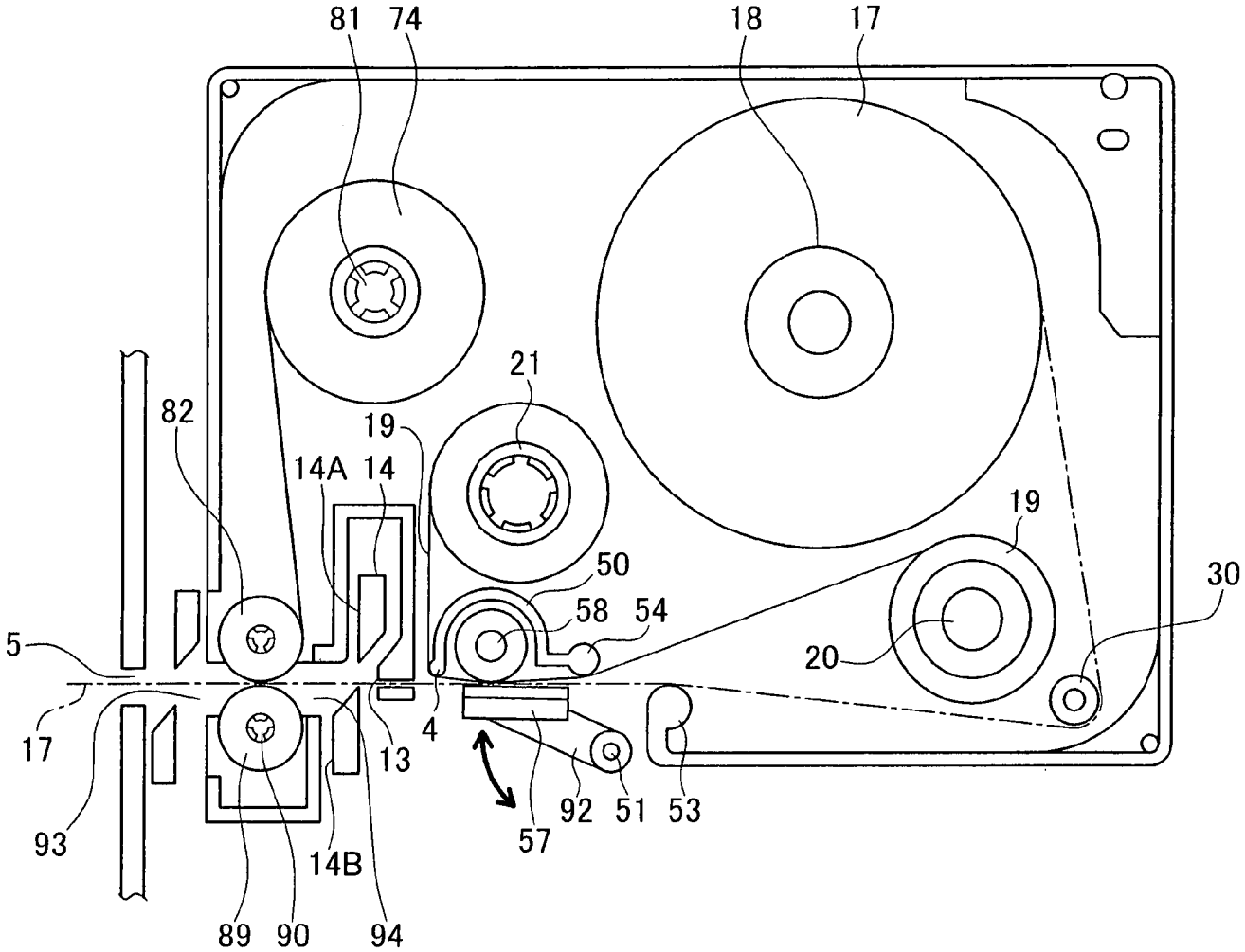
FIG. 29 is plan view showing a pattern of an internal configuration of the tape cassette according to another embodiment.
Figure 30:
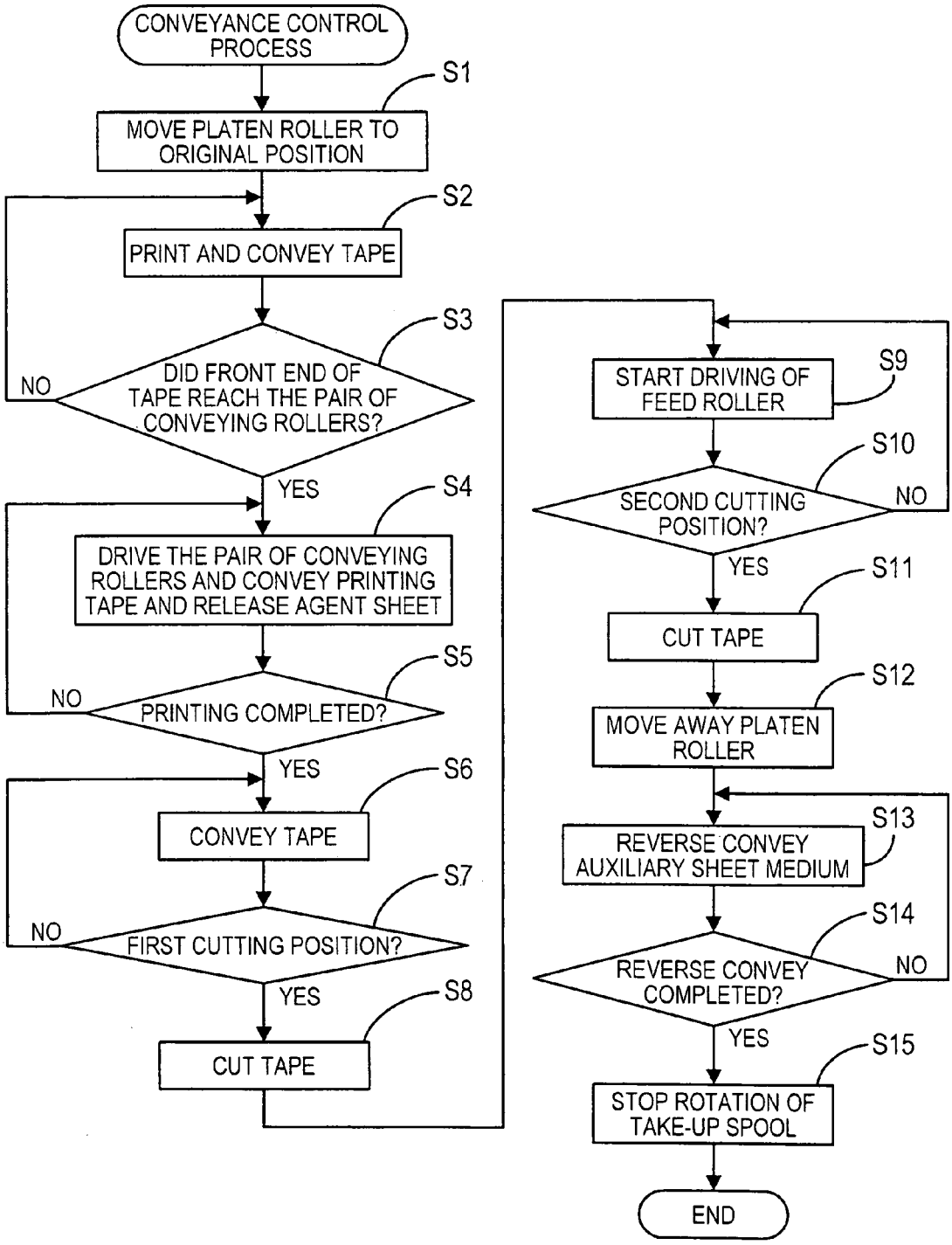
FIG. 30 is a flowchart showing a conveyance control process.

Also, as shown in FIG. 29, the tape printing apparatus may be configured so as to accommodate the auxiliary sheet medium 74 and the heat roller 89 in the tape cassette.

Use of the above-described configurations will naturally require changes to a part of the configuration of the tape cassette.

The operation of the respective driving device in the tape printing apparatus having the second cutter unit 87 as described above will next be described. The following description is based on the third embodiment as described above (FIG. 9 and FIG. 10), with the basic operation being the same in the other embodiments.

The conveyance control process is executed by a processor (not shown) which is provided in the tape printing apparatus 510. Execution of the conveyance control process is started by output of an instruction signal for print control.

Figure 31:
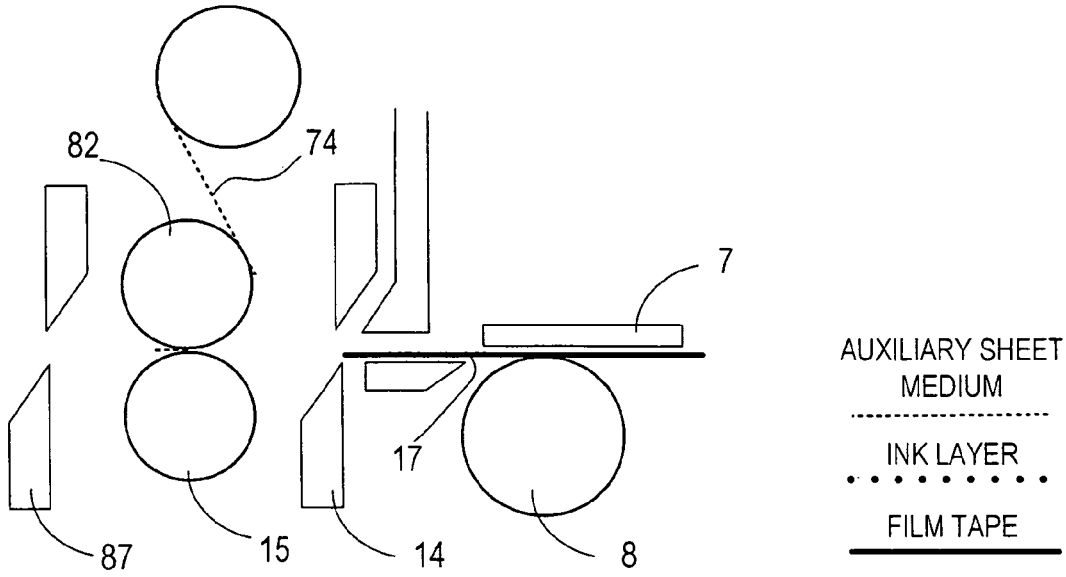
FIG. 31 is schematic diagram showing a condition where the auxiliary sheet medium and the film tape are conveyed.
Figure 32:
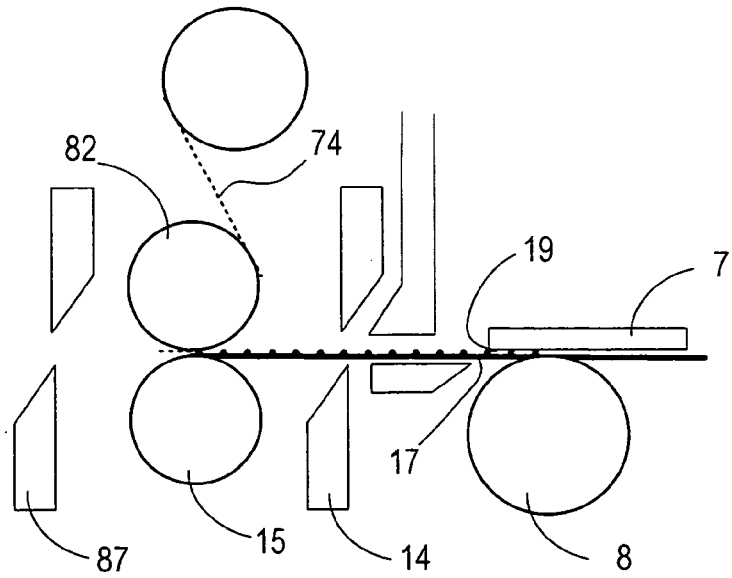
FIG. 32 is a schematic diagram showing a condition where the front end of the printed film tape has reached the pair of conveying rollers.

First, at S1, the platen roller 8 is moved to its original position (refer to FIG. 31). At this time, the front end of the film rape 17 is located at the periphery of the cutter unit 14 (refer to FIG. 31).

At S2, the print operation to the film tape 17 and the conveyance operation of the film tape 17 are carried out. As these operations have already been described above, further description thereof is hereby omitted.

At S3, a judgment is made as to whether the front end of the film tape 17 has reached the pair of conveying rollers (heat roller 15 and feed roller 82). This judgment is carried out by calculating the amount of the conveyed film tape 17 based on the number of rotations of the platen roller. The front end position of the film tape 17 may also be detected by use of a sensor which is not shown here.

If it is judged that the front end of the printed film tape 17 does not reach the pair of conveying rollers (S3: NO), the flow returns to S2. As a result, during the period of time required by the front end of the printed film tape 17 to reach the pair of conveying rollers, the print operation and the conveying operation with respect to the film tape 17 are successively carried out.

If it is judged that the front end of the printed film tape 17 has reached the pair of conveying rollers (S3: YES), the flow proceeds to S4.

At S4, the drive operation of the pair of conveying rollers is started. The auxiliary sheet medium 74 is adhered to the printed film tape 17 (ink layer side) based on the rotation of the pair of conveying rollers. The printed film tape 17 to which the auxiliary sheet medium 74 has been adhered is conveyed towards the second cutter unit 87.

Figure 33:
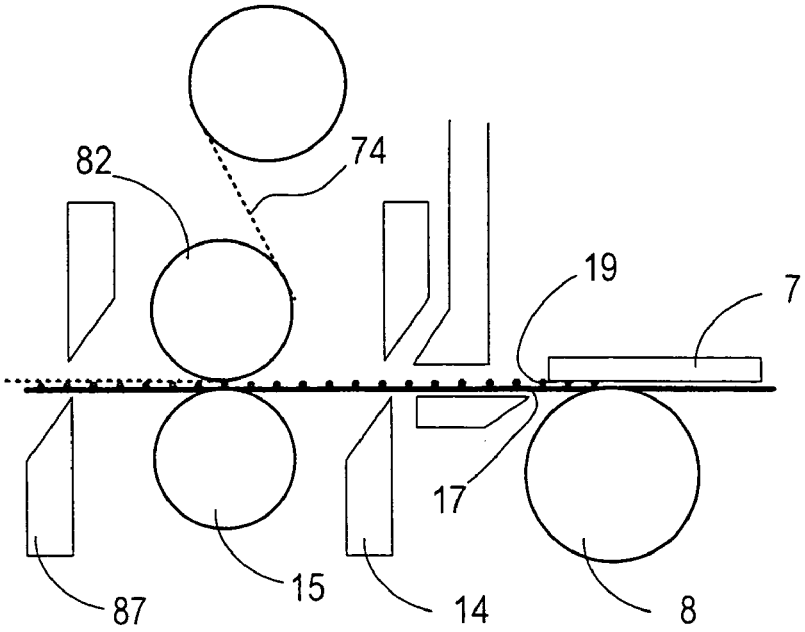
FIG. 33 is schematic diagram showing a condition where the auxiliary sheet medium and the film tape are conveyed.

At S5, a judgment is made as to whether printing is completed. The operation at S4 (specifically, the print operation and the conveyance operation with respect to the film rape 17) is repeated until printing is completed (refer to FIG. 33).

Figure 34:
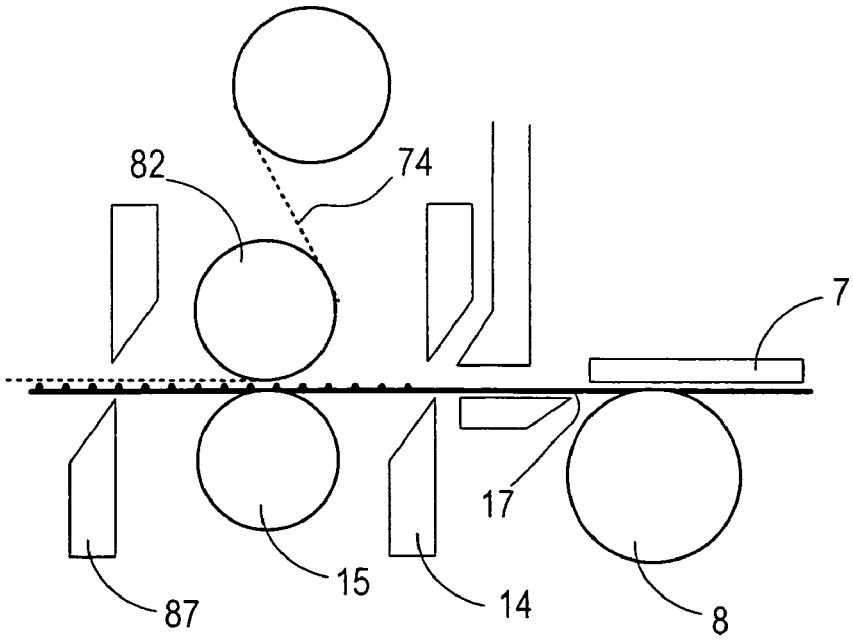
FIG. 34 is schematic diagram showing a condition where the printed film tape is present at the first cutting position.
Figure 35:
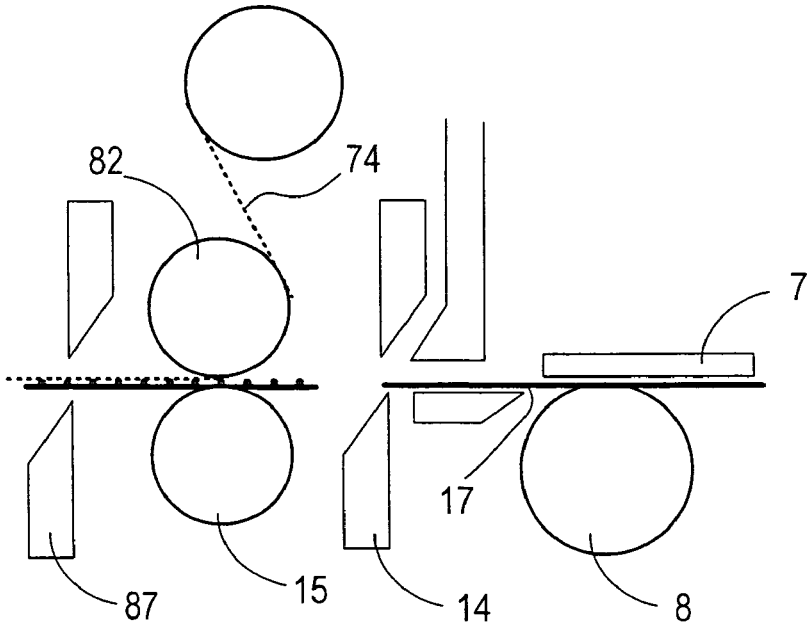
FIG. 35 is a view showing a condition where the printed film tape that was cut is conveyed towards the second cutter unit while the auxiliary sheet medium is adhered thereto.
Figure 36:
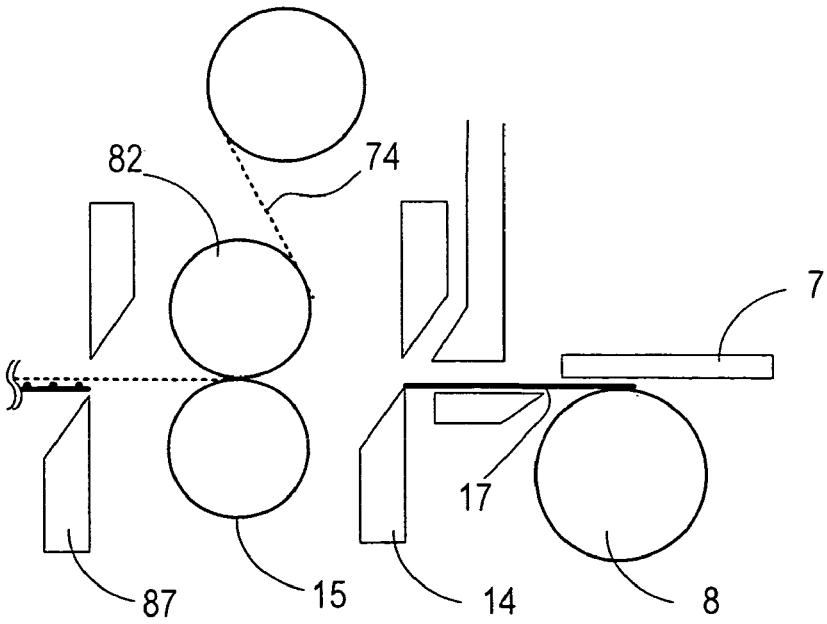
FIG. 36 is a view showing a condition where the printed film tape is present at the second cutting position.
Figure 37:
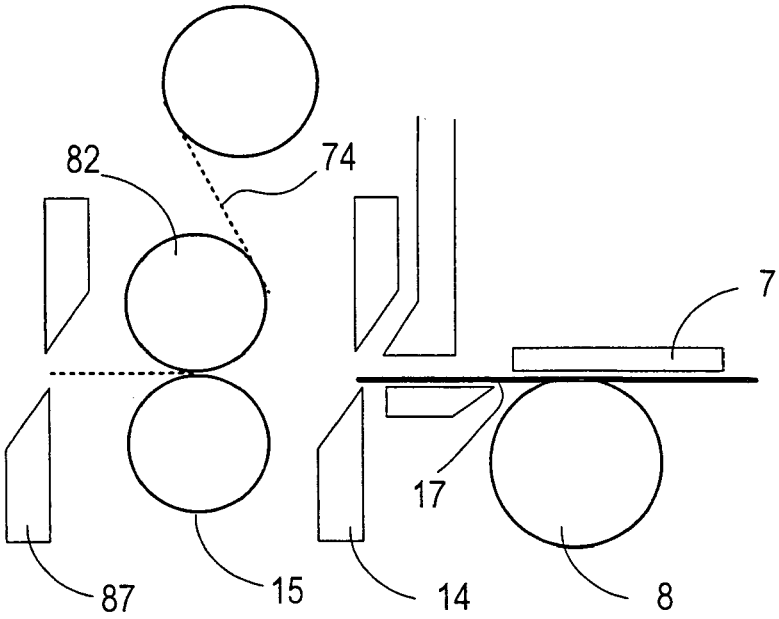
FIG. 37 is a view showing a condition where the auxiliary sheet medium after being cut by the second cutter unit.

If it is judged that printing has been completed (S5: YES), the flow shifts to S6. At S6, the printed film tape 17 is conveyed towards the pair of conveying rollers (refer to FIG. 34).

At S7, a judgment is made as to whether the back end of the printed film tape 17 is present at the cutting position (first cutting position) using the cutter unit 14 (first cutter). This judgment is carried out using the amount of the conveyed film tape 17 which is calculated based on the amount of rotation of the platen roller 8. A judgment may be made as to whether cutting will be made at the first cutting position by carrying out a predetermined printing at a first cutting scheduled position and then reading the print contents by a sensor which is not shown here.

If it is judged that the back end of the printed film tape 17 is not present at the first cutting position (S7: NO), the flow returns to S6. As a result, during the time required by the printed film tape 17 to be conveyed to the first cutting position, the conveying operation of the printed film tape 17 is carried out successively.

On the other hand, if it is judged that the back end of the printed film tape 17 is present at the first cutting position (S7: YES), the flow shifts to S8.

At S8, the printed film tape 17 is cut. At this time, the movable blade 14B is drive-controlled. At the time of cutting the printed film tape 17, the rotating platen roller 8 is stop driven.

After the printed film tape 17 has been cut, the flow shifts to S9. At S9, rotation driving of the heat roller 15 is started again. Since the printed film tape 17 is cut, the platen roller 8 is not driven to rotate. As a result, the printed film tape 17 that was cut is conveyed by rotational driving of the heat roller 15.

At S10, a judgment is made as to whether the back end of the printed film tape 17 is present at the cutting position (second cutting position) using the second cutter unit 87 (second cutter). This judgment is carried out based on the amount of the conveyed printed film tape 17 that is calculated based on the rotation amount of the heat roller 15.

If it is judged that the back end of the printed film tape 17 is not present at the second cutting position (S10: NO), the flow returns to S9. As a result, during the time required by the printed film tape 17 to be conveyed to the second cutting position, the conveyance operation of the printed film tape 17 is successively carried out.

On the other hand, if it is judged that the back end of the printed film tape 17 is present at the second cutting position (S10: YES), the flow shifts to S11.

At S11, the auxiliary sheet medium 74 is cut. At this time, the movable blade 87B is drive controlled. At the time the auxiliary sheet medium 74 is cut, the heat roller 15 is stop driven.

After the auxiliary sheet medium 74 has been cut, the flow shifts to S12. At S12, the platen roller 8 is moved away from the thermal head 7. Then, the flow shifts to S13.

At S13, the auxiliary sheet medium 74 is conveyed in a reverse direction. More specifically, the auxiliary sheet medium 74 is rewound in a reverse direction with the conveying direction at the time of printing. At this time, the auxiliary sheet medium spool 81 is rotated in a reverse direction with the rotation direction at the time of printing. As a result, the auxiliary sheet medium 74 is rewound onto the auxiliary sheet medium spool 81.

At S14, a judgment is made as to whether to terminate the reverse conveyance of the auxiliary sheet medium 74. This judgment is carried out based on the amount of the auxiliary sheet medium 74 that was conveyed in a reverse direction, which is calculated based on the amount of rotation of the feed roller 82. When the front end portion of the auxiliary sheet medium 74 has been rewound up to near the heat roller 15, the reverse conveyance is terminated.

If it is judged not to terminate the reverse conveyance of the auxiliary sheet medium (S14: NO), the flow returns to S13. As a result, during the time required until reverse conveyance of the auxiliary sheet medium 74 is completed, the rewind operation of the auxiliary sheet medium 74 is successively carried out.

On the other hand, if it is judged to terminate the reverse conveyance of the auxiliary sheet medium (S14: YES), the flow returns to S15.

At S15, reverse rotational driving of the auxiliary sheet medium spool 81 is stopped.

Figure 38:
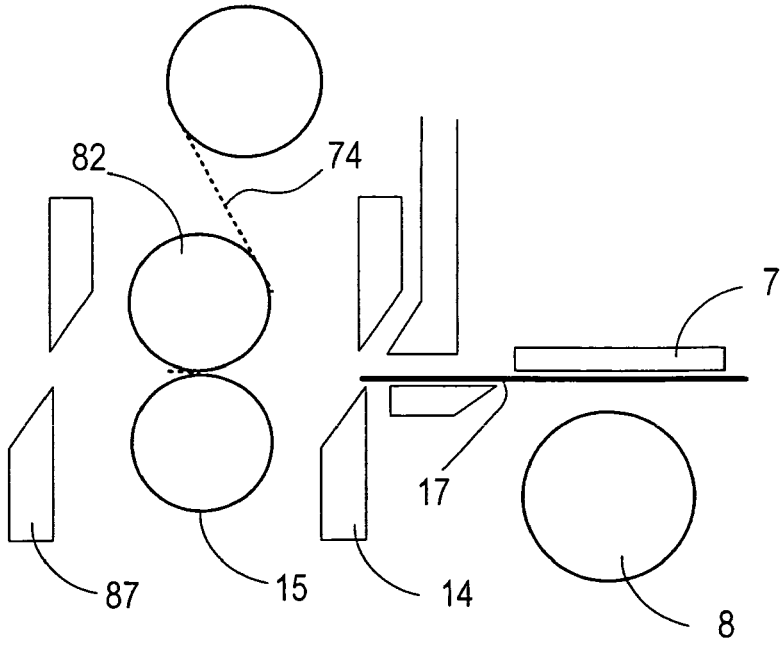
FIG. 38 is a view showing a condition where inverse rotation of the auxiliary sheet medium spool has been stopped.
Figure 39:
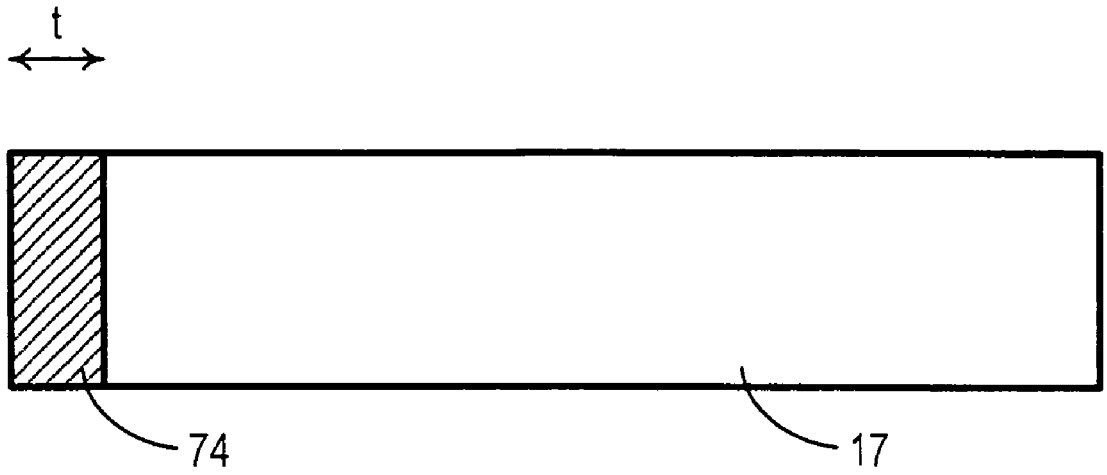
FIG. 39 is a view showing a location of the medium on the printing tape.

In the above processes, after the printed film tape 17 has been cut by the second cutter unit 87, the auxiliary sheet medium 74 is rewound onto the auxiliary sheet medium spool 81. The auxiliary sheet medium 74 can thus be efficiently used. The front end portion of the rewound auxiliary sheet medium 74 awaits at the position shown in FIG. 38 until the next adhering operation. Thus, the film tape 17 thus formed includes only a portion of auxiliary sheet medium 74 having length "t", as shown in FIG. 39. As a result, the film tape 17 thus formed can be stored in a state in which the auxiliary sheet medium 74 can be easily peeled off therefrom.

Figure 40:
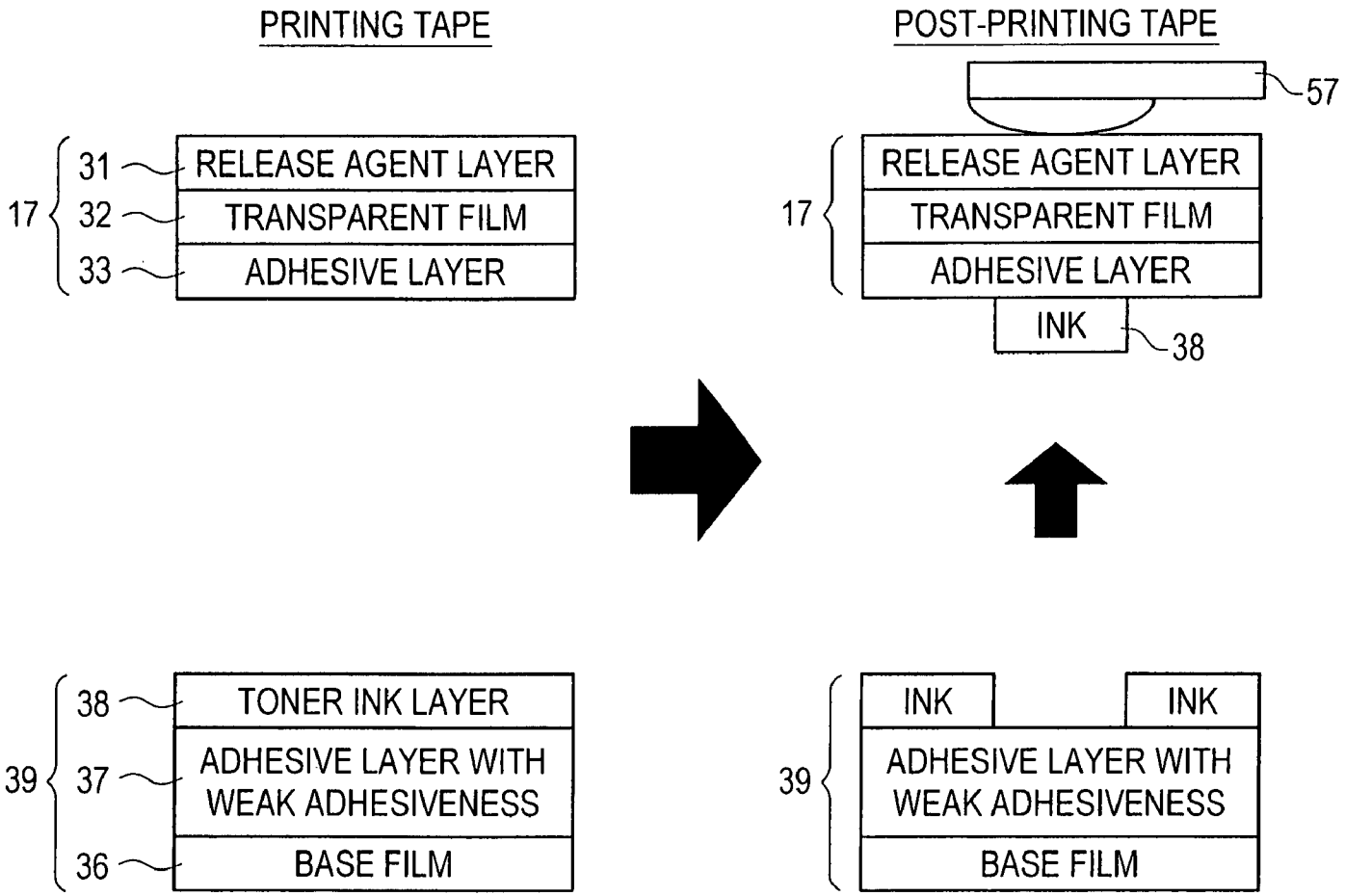

One or more aspects of the disclosure is not limited to the above-described embodiments, and needless to say, various alterations and modifications can be made thereto without departing from the scope of the disclosure. For instance, in the fifth embodiment and the like, the ink ribbon 19 employs a thermofusion-type thermal ink ribbon, but can also employ a toner ink ribbon 39 comprising a toner ink layer 38 which has toner ink applied on one surface thereof through an adhesive layer having weak adhesive properties with respect to the base film 36 as shown in FIG. 40.

According to a transfer mechanism in which an ink layer is transferred to the adhesive layer upon being heated by the thermal head 57, the adhesive layer 33A of the film tape 17 heated by the thermal head 57, similarly with FIG. 21, is heated to a to a temperature of 80° C. or above but below 90° C. which is equal to or higher than its melting temperature, thereby exhibiting adhesive properties. Then, the toner ink layer 38 of the toner ink ribbon 39 which came in contact with the adhesive layer 33A of the film tape 17 is adhered to the adhesive layer 33A, thereby being transferred to the film tape 17. In this case, the toner ink does not melt at a temperature below 90° C. and is transferred to the film tape 17 in a powdery state.

The post-printing film tape 17 passes between the tape conveying roller 16 and the heat roller 15, and upon being heated by the heat roller 15 to 80° C. or above but below 90° C., its adhesive layer 33B exhibits adhesive properties, and the toner ink is kept in a transferred state to the film tape 17 without melting.

Accordingly, heating of the post-printing film tape 17 does not cause the ink to melt, thereby eliminating the risk of faulty printing.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A tape printing system comprising: a tape cassette, the tape cassette comprising; a conveying roller, a tape-shaped auxiliary medium, a cassette case that accommodates the conveying roller and the tape-shaped auxiliary medium, and an opening arranged on the cassette case, a printing tape conveying apparatus, the printing tape conveying apparatus comprising; a heat roller, wherein the tape cassette is detachably mounted on a printing tape conveying apparatus, the conveying roller comes into contact with the heat roller through the opening, the conveying roller and the heat roller face each other when the tape cassette is mounted on the printing tape conveying apparatus, the conveying roller and the heat roller mounted on the printing tape conveying apparatus cooperate with each other to convey a printing tape having an adhesive layer formed thereon, the adhesive layer exhibiting adhesive properties when one face thereof is heated, the tape-shaped auxiliary medium comes into contact with the printing tape, the tape-shaped auxiliary medium is sequentially conveyed as the printing tape is conveyed, and the heat roller conveys the printing tape when the tape cassette is mounted on the printing tape conveying apparatus.

2. The tape printing system according to claim 1, further comprising a first tape cutter that cuts the printing tape, the first tape cutter being arranged on an upstream side from the heat roller in a conveying direction of the printing tape.

3. The tape printing system according to claim 1, further comprising: a first tape cutter that cuts the printing tape; and a second tape cutter that cuts the printing tape to which the tape-shaped auxiliary medium is adhered; wherein the tape-shaped auxiliary medium is adhered to the adhesive layer of the printing tape, the adhered tape-shaped auxiliary medium is discharged to an exterior of the tape cassette, the first tape cutter is arranged on an upstream side from the heat roller in a conveying direction of the printing tape, and the second tape cutter is arranged on a downstream side from the heat roller in the conveying direction of the printing tape.

4. The tape printing system according to claim 1, comprising: a thermal head; and a drive control mechanism that drive controls a heat generating part of the thermal head; wherein the printing tape that comes into contact with the thermal head has a transparent film layer formed therein, and the heat generating part is controlled by a drive control mechanism so that an ink layer that was shifted to the adhesive layer of the printing tape can be visualized as normal image when the printing tape is viewed from a transparent film side thereof.

5. The tape printing system according to claim 1, wherein the printing tape has a transparent film layer, and the heat roller contacts the printing tape from the transparent film side thereof.

6. A tape cassette comprising:

a pair of conveying rollers;

a tape-shaped auxiliary medium;

a cassette case that accommodates the pair of conveying rollers and the tape-shaped auxiliary medium; and a tape discharge port arranged on the cassette case, wherein one conveying roller of the pair of conveying rollers is a heat roller, the tape cassette is detachably mounted on a printing tape conveying apparatus, the pair of conveying rollers including the heat roller mounted on the printing tape conveying apparatus cooperate with each other to convey a printing tape having an adhesive layer formed thereon, the adhesive layer exhibiting adhesive properties when one face thereof is heated, the tape-shaped auxiliary medium comes into contact with the printing tape, and the tape-shaped auxiliary medium is sequentially conveyed as the printing tape is conveyed, and the printing tape thus conveyed is discharged from the tape discharge port.

7. The tape cassette according to claim 6, further comprising an ink ribbon that has an ink layer formed thereon, wherein the adhesive layer of the printing tape and the ink layer of the ink ribbon come into contact with each other at a printing position.

8. The tape cassette according to claim 7, further comprising: an ink ribbon take-up spool; and a separating part that separates the ink ribbon and the printing tape on a downstream side from the printing position in a tape conveying direction; wherein after the ink ribbon has passed the separating part, the ink layer that came in contact with the adhesive layer of the printing tape shifts to the printing tape, and at same time the ink ribbon is wound onto the ink ribbon take-up spool.

9. The tape cassette according to claim 6, wherein the tape-shaped auxiliary medium has a release agent layer formed on a surface thereof that comes into contact with the adhesive layer of the printing tape.

10. The tape cassette according to claim 6, wherein the tape-shaped auxiliary medium is adhered to the adhesive layer of the printing tape, and the adhered tape-shaped auxiliary medium is discharged from the tape discharged port to an exterior of the tape cassette.

11. The tape cassette according to claim 6, further comprising a tape charge port provided in the cassette case, wherein the printing tape enters the tape cassette through the tape charge port when the tape cassette is mounted on the printing tape conveying apparatus.

* * * * *